US010791403B2

(12) United States Patent
Stallard et al.

(10) Patent No.: US 10,791,403 B2
(45) Date of Patent: Sep. 29, 2020

(54) EAR BAND APPARATUS

(71) Applicants: Phillip Stallard, Macquarie University (AU); Peter John Russell, Macquarie University (AU); Slobodan Ilic, Macquarie University (AU)

(72) Inventors: Phillip Stallard, Macquarie University (AU); Peter John Russell, Macquarie University (AU); Slobodan Ilic, Macquarie University (AU)

(73) Assignee: Cochlear Limited, Macquarie University, NSW (AU)

( * ) Notice: Subject to any disclaimer, the term of this patent is extended or adjusted under 35 U.S.C. 154(b) by 306 days.

(21) Appl. No.: 15/652,465

(22) Filed: Jul. 18, 2017

(65) Prior Publication Data

US 2019/0028821 A1 Jan. 24, 2019

(51) Int. Cl.
*H04R 25/00* (2006.01)
*H04R 25/02* (2006.01)

(52) U.S. Cl.
CPC ..... *H04R 25/65* (2013.01); *H04R 25/02* (2013.01); *H04R 25/602* (2013.01); *H04R 25/606* (2013.01); *H04R 2225/021* (2013.01)

(58) Field of Classification Search
CPC .. H04R 25/02; H04R 25/65; H04R 2225/021; H04R 2225/0213
See application file for complete search history.

(56) References Cited

U.S. PATENT DOCUMENTS

| | | | | |
|---|---|---|---|---|
| 4,702,345 | A * | 10/1987 | Janssen | H04R 25/02 181/129 |
| 4,881,616 | A * | 11/1989 | Janssen | H04R 25/60 181/129 |
| 7,729,774 | B1 * | 6/2010 | Lynch | H04R 25/65 607/57 |
| 7,983,439 | B2 * | 7/2011 | Bruckhoff | H04R 1/105 381/381 |
| 8,605,927 | B2 * | 12/2013 | Fretz | H04R 25/02 381/328 |
| 9,571,939 | B2 * | 2/2017 | Fretz | G06K 7/10554 |
| 9,961,458 | B1 * | 5/2018 | Tourdot | H04R 25/65 |
| 2011/0022121 | A1 * | 1/2011 | Meskins | A61N 1/37229 607/57 |
| 2013/0101148 | A1 * | 4/2013 | Karlsen | H04R 25/65 381/323 |

(Continued)

OTHER PUBLICATIONS http://www.cochlear.com/wps/wcm/connect/au/home/support/accessories/accessories-baha-5-superpower, believed available before Jul. 2017, Cochlear Limited, accessed Dec. 14, 2017. This is believed to be prior art. Applicant reserves the right to present future evidence that this is not the case.

(Continued)

*Primary Examiner* — Matthew A Eason
(74) *Attorney, Agent, or Firm* — Pilloff Passino & Cosenza LLP; Martin J. Cosenza

(57) ABSTRACT

A device, including a behind-the-ear (BTE) device ear interface fixture, the fixture including a loop portion configured to enable a pinna of a recipient to be inserted there through and an attachment portion configured to removably attach the fixture to a BTE electronics module and/or a BTE battery, wherein the inner perimeter of the loop portion is non-circular when the loop portion is in a relaxed state.

20 Claims, 52 Drawing Sheets

(56) References Cited

U.S. PATENT DOCUMENTS

| | | | | |
|---|---|---|---|---|
| 2013/0121519 | A1* | 5/2013 | Karlsen | H04R 25/02 381/330 |
| 2019/0028816 | A1* | 1/2019 | Russell | H04R 25/02 |

OTHER PUBLICATIONS http://www.cochlear.com/wps/wcm/connect/uk/home/support/baha-system/baha-5-superpower-support/accessories, believed available before Jul. 2017, Cochlear Limited, accessed Dec. 14, 2017. This is believed to be prior art. Applicant reserves the right to present future evidence that this is not the case.

http://www.cochlear.com/wps/wcm/connect/us/recipients/nucleus-6/nucleus-6-accessories/retention-options, believed available before Jul. 2017, Cochlear Limited, accessed Dec. 14, 2017. This is believed to be prior art. Applicant reserves the right to present future evidence that this is not the case.

http://www.cochlear.com/wps/wcm/connect/us/recipients/nucleus-hybrid-implant-system/hybrid-accessories/retention-options, believed available before Jul. 2017, Cochlear Limited, accessed Dec. 14, 2017. This is believed to be prior art. Applicant reserves the right to present future evidence that this is not the case.

Huggie Aids Too, "Huggie Aids Too Catalog, How did We do Without Them," believed available before Jul. 2017. This is believed to be prior art. Applicant reserves the right to present future evidence that this is not the case.

Martin Cosenza, "Believed Prior Art", believed to be known or used by others before Jul. 2017. This is believed to be prior art. Applicant reserves the right to present future evidence that this is not the case.

* cited by examiner

EAR BAND APPARATUS

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses a component positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, certain types of hearing prostheses, commonly referred to as bone conduction devices, convert a received sound into mechanical vibrations. The vibrations are transferred through the skull to the cochlea causing generation of nerve impulses, which result in the perception of the received sound. Bone conduction devices may be a suitable alternative for individuals who cannot derive sufficient benefit from acoustic hearing aids. Other types of hearing prostheses, such as cochlear implants and middle ear implants, can be a suitable alternative for individuals.

SUMMARY

In an exemplary embodiment, there is a device, comprising a behind-the-ear (BTE) device ear interface fixture, the fixture including a loop portion configured to enable a pinna of a recipient to be inserted there through and an attachment portion configured to removably attach the fixture to a BTE electronics module and/or a BTE battery, wherein the inner perimeter of the loop portion is non-circular when the loop portion is in a relaxed state.

In an exemplary embodiment, there is a behind-the-ear (BTE) device, comprising a BTE electronics module and an ear interface, wherein the ear interface includes a portion configured to extend completely about a pinna when the BTE device is worn behind the ear, and the ear interface is an integral component.

In an exemplary embodiment, there is a method, comprising obtaining a behind-the-ear (BTE) assembly including a BTE electronics module, obtaining an ear interface, placing the interface against the BTE electronics module such that a portion of the interface extends into an area of the behind-the-ear assembly, and completely securing the interface to the BTE assembly without placing a component completely about a main body of the BTE electronics module and, if present, a main body of a battery.

BRIEF DESCRIPTION OF THE DRAWINGS

Embodiments of the present invention are described below with reference to the attached drawings, in which.

DETAILED DESCRIPTION

The teachings detailed herein can be used as part of a BTE device or a device that includes a connector that is part of a partially implantable or a totally implantable cochlear implant. It is noted that in alternate embodiments, the teachings detailed herein and/or variations thereof can be applicable to other types of hearing prostheses, such as, for example, bone conduction devices (e.g., active transcutaneous bone conduction devices, passive transcutaneous bone conduction devices, and percutaneous bone conduction devices), Direct Acoustic Cochlear Implant (DACI), middle ear implants, etc. Embodiments can include any type of hearing prosthesis that can utilize the teachings detailed herein and/or variations thereof. It is further noted that in some embodiments, the teachings detailed herein and/or variations thereof can be utilized in other types of prostheses beyond hearing prostheses. Thus, any disclosure herein corresponds to a disclosure of such used with/in any of the aforementioned devices.

Figure 1:
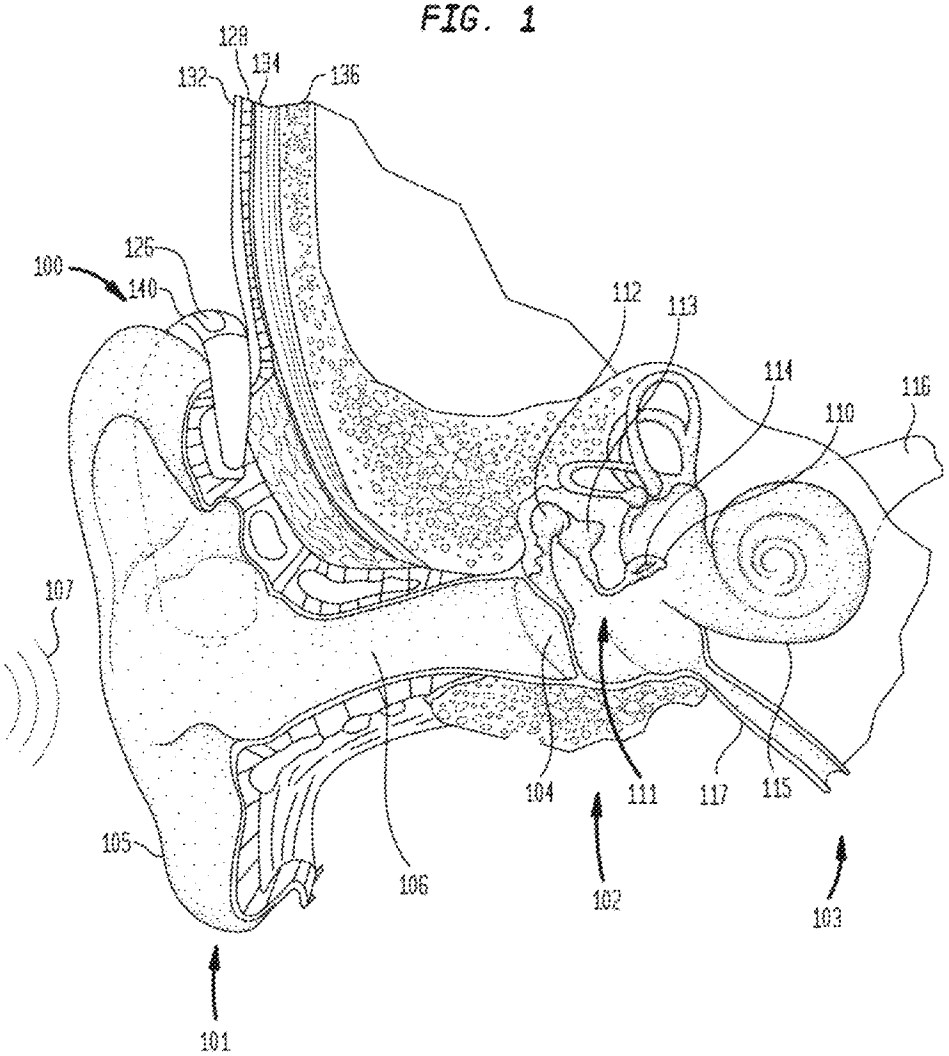
FIG. 1 is a perspective view of an exemplary bone conduction device in which embodiments of the present invention can be implemented.

FIG. 1 is a perspective view of a passive transcutaneous bone conduction device 100 in which embodiments of the present invention can be implemented, worn by a recipient. As shown, the recipient has an outer ear 101, a middle ear 102, and an inner ear 103. Elements of outer ear 101, middle ear 102, and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113, and the stapes 114. The ossicles 111 of middle ear 102 serve to filter and amplify acoustic wave 107, causing oval window 110 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102, and inner ear 103 of a recipient of device 100. As shown, bone conduction device 100 is positioned behind outer ear 101 of the recipient. Bone conduction device 100 comprises an external component 140 in the form of a behind-the-ear (BTE) device.

External component 140 typically comprises one or more sound input elements 126, such as a microphone, for detecting and capturing sound, a sound processing unit/sound processor (not shown) and a power source (not shown). The external component 140 includes an actuator (not shown), which in the embodiment of FIG. 1, is located within the body of the BTE device, although in other embodiments, the actuator can be located remote from the BTE device (or other components of the external component 140 having a sound input element, a sound processing unit and/or a power source, etc.).

It is noted that sound input element 126 can comprise, for example, devices other than a microphone, such as, for example, a telecoil, etc. In an exemplary embodiment, sound input element 126 can be located remote from the BTE device and can take the form of a microphone or the like located on a cable or can take the form of a tube extending from the BTE device, etc. Alternatively, sound input element 126 can be subcutaneously implanted in the recipient, or positioned in the recipient's ear. Sound input element 126 can also be a component that receives an electronic signal indicative of sound, such as, for example, from an external audio device. For example, sound input element 126 can receive a sound signal in the form of an electrical signal from an MP3 player electronically connected to sound input element 126.

The sound processing unit/sound processor of the external component 140 processes the output of the sound input element 126, which is typically in the form of an electrical signal. The processing unit generates control signals that cause the actuator to vibrate. In other words, the actuator converts the electrical signals into mechanical vibrations for delivery to the recipient's skull.

As noted above, with respect to the embodiment of FIG. 1, bone conduction device 100 is a passive transcutaneous bone conduction device. That is, no active components, such as the actuator, are implanted beneath the recipient's skin 132. In such an arrangement, as will be described below, the active actuator is located in external component 140.

The embodiment of FIG. 1 is depicted as having no implantable component. That is, vibrations generated by the actuator are transferred from the actuator, into the skin directly from the actuator and/or through a housing of the BTE device, through the skin of the recipient, and into the bone of the recipient, thereby evoking a hearing percept without passing through an implantable component. In this regard, it is a totally external or non-surgical bone conduction device. Alternatively, in an exemplary embodiment, there is an implantable component that includes a plate or other applicable component, as will be discussed in greater detail below. The plate or other component of the implantable component vibrates in response to vibration transmitted through the skin.

Figure 2A:
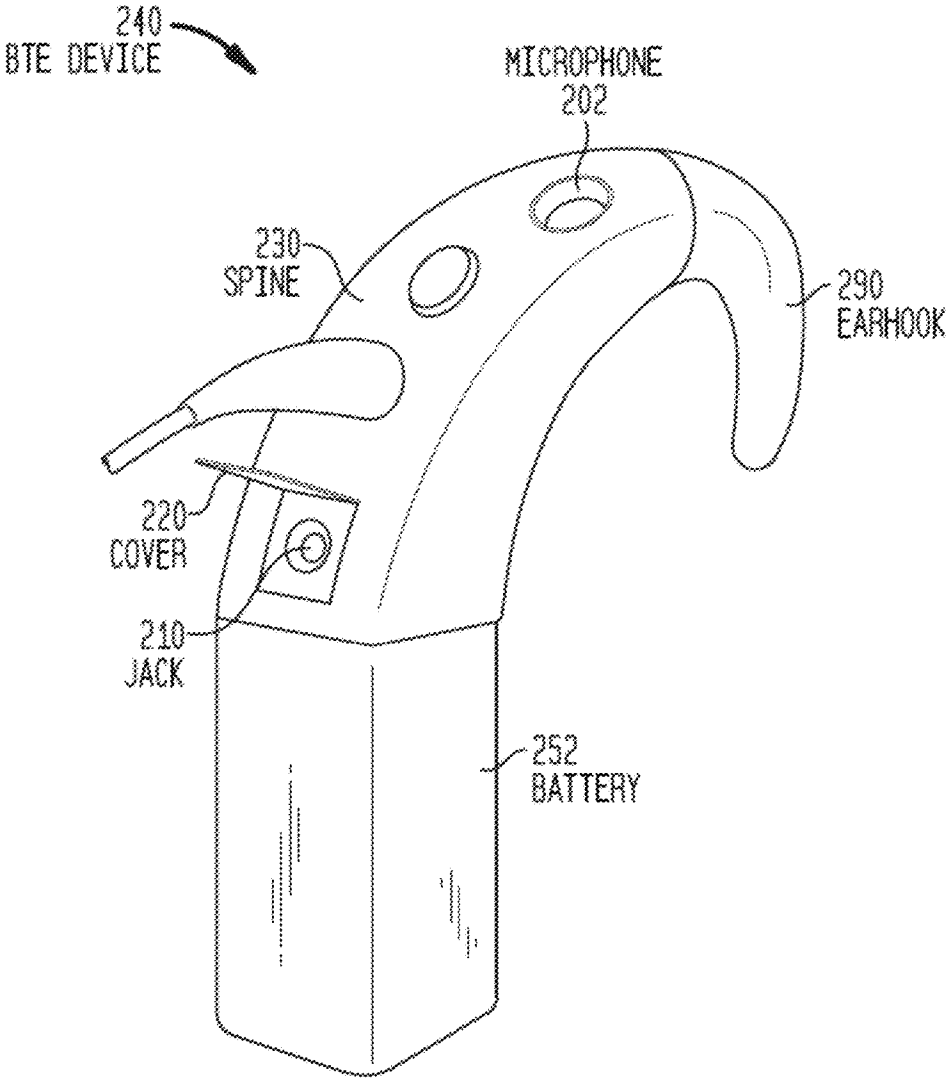
FIG. 2A is a perspective view of a Behind-The-Ear (BTE) device according to an exemplary embodiment.

FIG. 2A is a perspective view of a BTE device 240 of a hearing prosthesis, which, in this exemplary embodiment, corresponds to the BTE device (external component 140) detailed above with respect to FIG. 1. BTE device 240 includes one or more microphones 202, and may further include an audio signal jack 210 under a cover 220 on the BTE electronics module (sometimes referred to in the art and herein as a spine or sound processor or sound processor sub-assembly) 230 of BTE device 240. It is noted that in some other embodiments, one or both of these components (microphone 202 and/or jack 210) may be located on other positions of the BTE device 240, such as, for example, the side of the BTE electronics module 230 (as opposed to the back of the BTE electronics module 230, as depicted in FIG. 2), the ear hook 290, etc. FIG. 2A further depicts battery 252 and ear hook 290 removably attached to BTE electronics module 230.

Figure 2B:
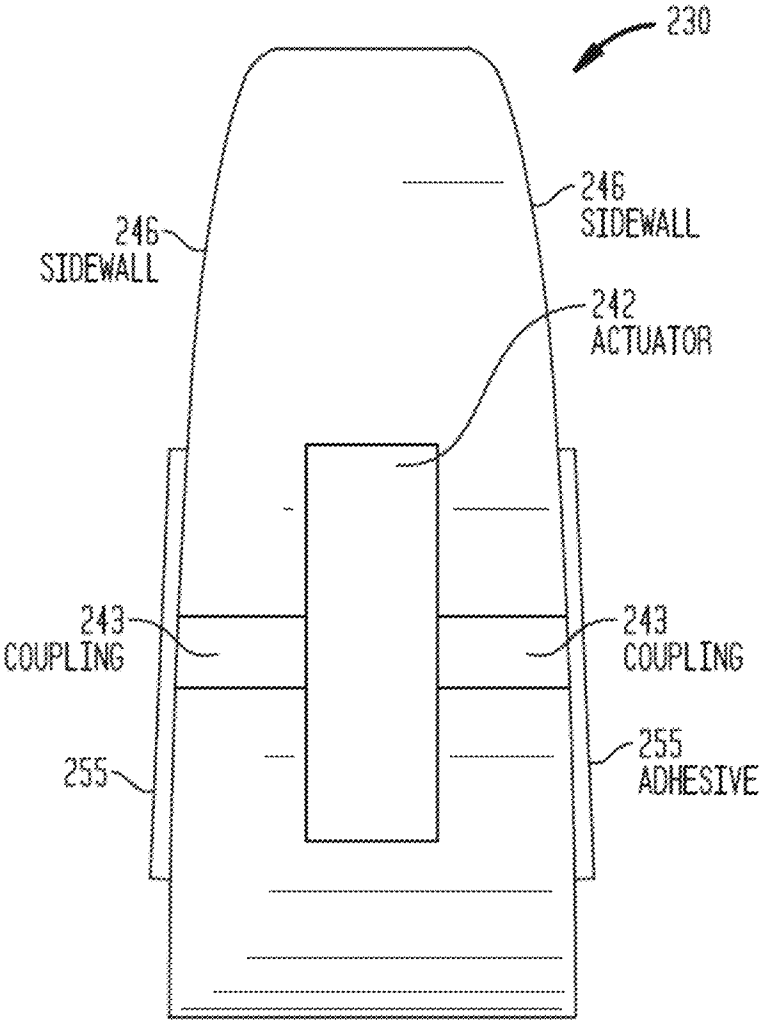
FIG. 2B is a cross-sectional view of a BTE electronics module (sometimes referred to in the art as a spine) of the BTE device of FIG. 2A.

FIG. 2B is a cross-sectional view of an exemplary BTE electronics module 230 of BTE device 240 of FIG. 2A. Actuator 242 is shown located within the BTE electronics module 230 of BTE device 242. Actuator 242 is a vibrator actuator, and is coupled to the sidewalls 246 of the BTE electronics module 230 via couplings 243 which are configured to transfer vibrations generated by actuator 242 to the sidewalls 246, from which those vibrations are transferred to skin 132. In an exemplary embodiment, couplings 543 are rigid structures having utilitarian vibrational transfer characteristics. The sidewalls 246 form at least part of a housing of BTE electronics module 230. In some embodiments, the housing hermetically seals the interior of the BTE electronics module 230 from the external environment.

In the embodiment of FIGS. 2A and 2B, the BTE device 240 forms a self-contained transcutaneous bone conduction device. It is a passive transcutaneous bone conduction device in that the actuator 242 is located external to the recipient.

FIG. 2B depicts adhesives 255 located on the sidewalls 246 of the BTE device 240. As will be detailed below, adhesives 255 form coupling portions that are respectively configured to removably adhere the BTE device 240 to the recipient via adhesion at the locations of the adhesives 255. This adherence being in addition to that which might be provided by the presence of the ear hook 290 and/or any grasping phenomenon resulting from the auricle 105 of the outer ear and the skin overlying the mastoid bone of the recipient. Accordingly, in an exemplary embodiment, there is an external component, such as a BTE device, that includes a coupling portion that includes a surface configured to directly contact the outer skin. This coupling portion is configured to removably attach the external component to an outer surface of skin of the recipient via attraction of the contact surface to the respective contact portion of the outer skin.

It is noted that the embodiment of FIG. 2B is depicted with adhesives 255 located on both sides of the BTE device. In an exemplary embodiment of this embodiment, this permits the adherence properties detailed herein, and/or variations thereof, to be achieved regardless of whether the recipient wears the BTE device on the right side (in accordance with that depicted in FIG. 1) or the left side (or wears two BTE devices). In an alternate embodiment, BTE device 240 includes adhesive only on one side (the side appropriate for the side on which the recipient intends to wear the BTE device 240). An embodiment of a BTE device includes a dual-side compatible BTE bone conduction device, as will be detailed below.

The adhesives 255 are depicted in FIG. 2B in an exaggerated manner so as to be more easily identified. In an exemplary embodiment, the adhesives 255 are double sided tape, where one side of the tape is protected by a barrier, such as a silicone paper, that is removed from the skin-side of the double-sided tape in relatively close temporal proximity to the placement of the BTE device 240 on the recipient. In an exemplary embodiment, adhesives 255 are glue or the like. In an exemplary embodiment where the adhesives 255 are glue, the glue can be applied in relatively close temporal proximity to the placement of the BTE device 240 on the recipient. Such application can be applied by the recipient to the BTE electronics module 230, in an exemplary embodiment.

In an alternate embodiment, the adhesives 255 are of a configuration where the adhesive has relatively minimal adhesive properties during a temporal period when exposed to some conditions, and has relatively effective adhesive properties during a temporal period, such as a latter temporal period, when exposed to other conditions. Such a configuration can provide the recipient control over the adhesive properties of the adhesives.

By way of example, the glue and/or tape (double-sided or otherwise) may be a substance that obtains relatively effective adhesive properties when exposed to oil(s) and/or sweat produced by skin, when exposed to a certain amount of pressure, when exposed to body heat, etc., and/or a combination thereof and/or any other phenomena that may enable the teachings detailed herein and/or variations thereof to be practiced. Such exemplary phenomena may be, for example, heat generated via friction resulting from the recipient rubbing his or her finger across the glue. In an exemplary embodiment, the pressure can be a pressure above that which may be expected to be experienced during normal handling of the BTE electronics module 230.

In an exemplary embodiment, the adhesives 255 are contained in respective containers that exude glue or the like when exposed to certain conditions, such as by way of example and not by way of limitation, the aforementioned conditions. Alternatively, and/or in addition to this, the recipient may puncture or otherwise open the containers to exude the glue or the like.

Any device, system, and/or method that will enable a recipient to practice the teachings detailed herein and/or variations thereof associated with the adherence of the bone conduction device to skin of the recipient for vibration transmission can be utilized in some embodiments.

In an exemplary embodiment, the vibrator actuator 242 is a device that converts electrical signals into vibration. In operation, sound input element 202 converts sound into electrical signals. Specifically, these signals are provided to vibrator actuator 242, or to a sound processor (not shown) that processes the electrical signals, and then provides those processed signals to vibrator actuator 242. The vibrator actuator 242 converts the electrical signals (processed or unprocessed) into vibrations. Because vibrator actuator 242 is mechanically coupled to sidewalls 246, the vibrations are transferred from the vibrator actuator 342 to skin 132 of the recipient.

Figure 2C:
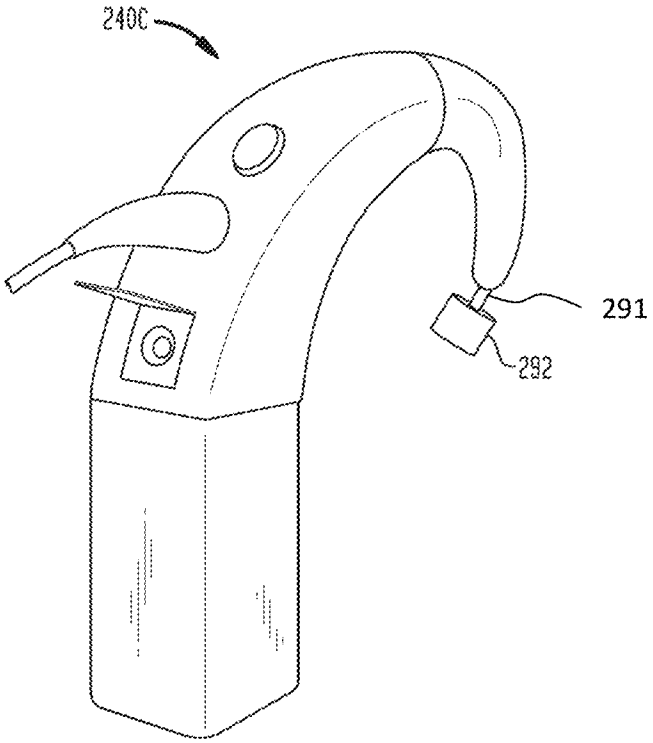
FIG. 2C is a perspective view of an alternate embodiment of a BTE device.

FIG. 2A depicts the sound input element 202 as being located at about the apex of BTE electronics module 230. FIG. 2C depicts an alternate embodiment of a BTE device 240C in which the sound input element 292 is mounted on a stem 291 extending from the ear hook 290. In an exemplary embodiment, the stem 291 is such that during normal use, the sound input element 292 is located below the ear, in the area of the auricular concha, or in the ear canal. Such a configuration can have utilitarian value by way of reducing feedback as compared to that which may result from the embodiment of FIG. 2A.

Figure 3A:
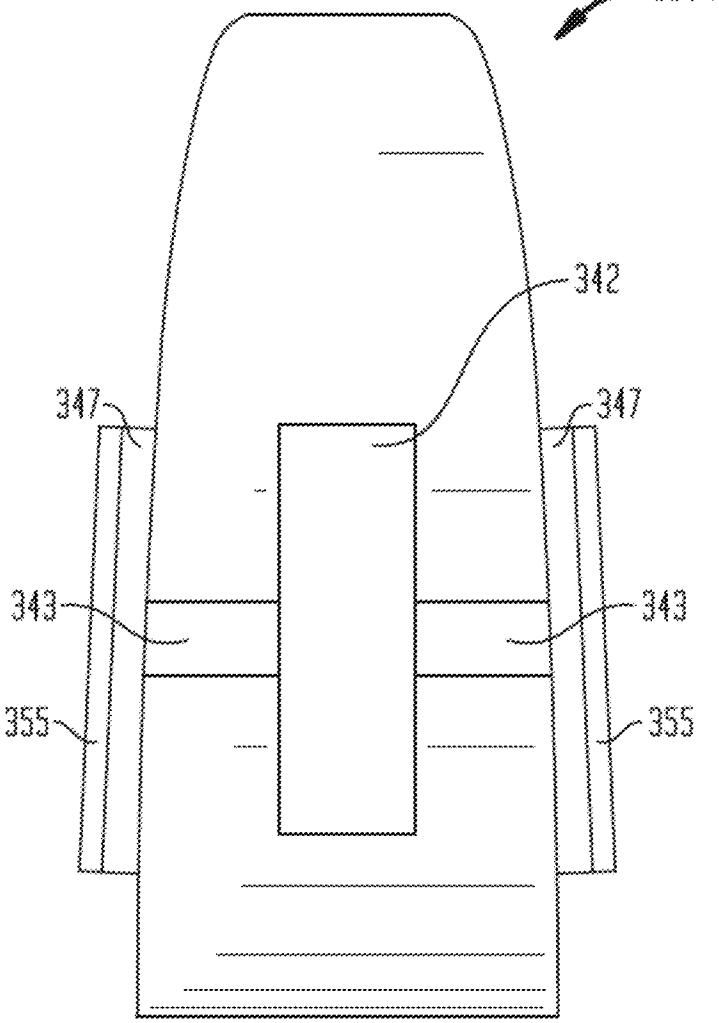
FIG. 3A is a cross-sectional view of a BTE electronics module (sometimes referred to in the art as a spine) of a BTE device according to an alternate embodiment.

It is noted that while the embodiments depicted in FIGS. 2A and 2B detail the vibrations being transferred from the vibrator actuator 242 to the sidewalls 246 via the couplings 243, in other embodiments, the vibrations are transferred to plates or other devices that are located outside of the sidewalls 246. FIG. 3A depicts such an exemplary embodiment, where BTE electronics module 330A includes couplings 343 extending through sidewalls 346 to plates 347, on which adhesives 355 are located.

Figure 3B:
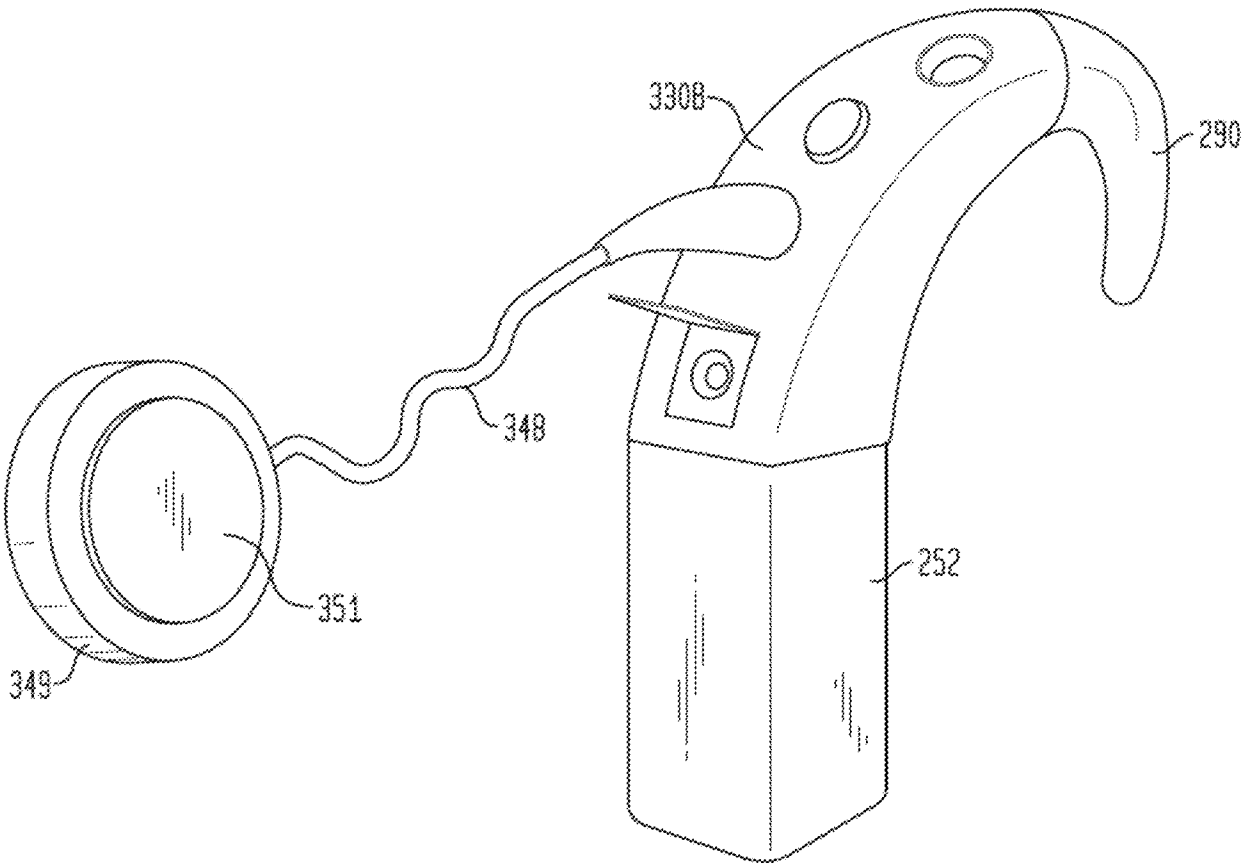
FIG. 3B is a perspective view of an alternate embodiment of an external device including a BTE device.

FIG. 3B depicts an alternate embodiment of an external component of a bone conduction device, BTE device 340, in which the vibrator actuator (such as actuator 242 detailed above, or a variation thereof) is located in a remote vibrator actuator unit 349 (sometimes referred to as a "button" in the art). This as opposed to the BTE electronics module 330B. Vibrator actuator unit 349 is in electronic communication with BTE electronics module 330B via cable 348. BTE electronics module 330B functionally corresponds to the BTE electronics modules detailed above, with the exception of the features associated with containing a vibrator actuator therein. In this regard, electrical signals are transferred to the vibrator actuator in vibrator actuator unit 349, these signals being, in some embodiments, the same as those which are provided to the other vibrator actuators detailed herein. Vibrator actuator unit 349 may include a coupling 351 to removably attach the unit 349 to outer skin of the recipient. Coupling 351 can correspond to the couplings detailed herein. Such a coupling may include, for example, adhesive. Alternatively, and/or in addition to this, coupling 351 can correspond to a magnet that couples via magnetic attraction to an implanted magnet within the recipient (e.g., an implanted magnet attached to the mastoid bone of the recipient underneath the skin of the recipient).

Such a configuration as that of BTE device 340, can have utilitarian value by way of reducing feedback as compared to that which may result from the embodiment of FIG. 2A.

While the embodiment depicted in FIG. 3B utilizes a cable 348 to communicate with the remote vibrator actuator unit 349, in an alternative embodiment, a wireless link is utilized to communicate between the spine 330B and the remote vibrator actuator unit 349.

In at least some exemplary embodiments, the remote vibrator actuator unit 349 can contain a sound processor/sound processing unit or the like as opposed to, and/or in addition to, the BTE electronics module 330B. Accordingly, in an exemplary embodiment, the remote vibrator actuator unit 349 can be a button sound processor, where, in at least some embodiments, the functionality of the BTE device vis-à-vis sound capture and/or signal processing and/or power is instead present in the button sound processor, enabling, in at least some exemplary embodiments, the BTE device to be done away with.

It is noted that while the embodiment of FIG. 3B depicts the microphone being located on the BTE electronics module 330B at about the apex thereof, in an alternate embodiment, the microphone can be located in a manner corresponding to that of FIG. 2C. It is further noted that the microphone can be located on the ear hook 290 anywhere from and including the tip thereof to the location where the ear hook interfaces with the BTE electronics module. Such is also the case with respect to the microphone located on the BTE electronics module 330B—the microphone can be located anywhere on the BTE electronics module from the interface of the BTE electronics module in the ear hook 290 to the interface of the battery 252 with the BTE electronics module 330B. Still further, as noted above, BTE device 340 can include a plurality of microphones located according to the various teachings detailed herein and/or variations thereof. In this regard, the aforementioned locations of the various microphones are applicable to the other embodiments detailed herein, such as by way of example, the embodiment of FIG. 2A, along with the embodiments that will be detailed below. Any microphone placement that can enable the teachings detailed herein and/or variations thereof to be practiced can be utilized in at least some exemplary embodiments.

In some exemplary embodiments, any device, system, and/or method that will enable the teachings detailed herein and/or variations thereof associated with vibration transmission from the actuator to the skin and/or to bone of the recipient may be utilized.

It is briefly noted that in an exemplary embodiment, the arrangement of FIG. 3B can instead be that of a cochlear implant external component/removable component, or a middle ear implant external component/removable component, or an active transcutaneous bone conduction device external component/removable component, where element 349 is an RF inductance coil that transcutaneously communicates via inductance with an implanted RF inductance coil that is in signal communication with a stimulator when actuator alike of the implantable component.

Some additional embodiments of some exemplary embodiments will now be described.

Figure 4:
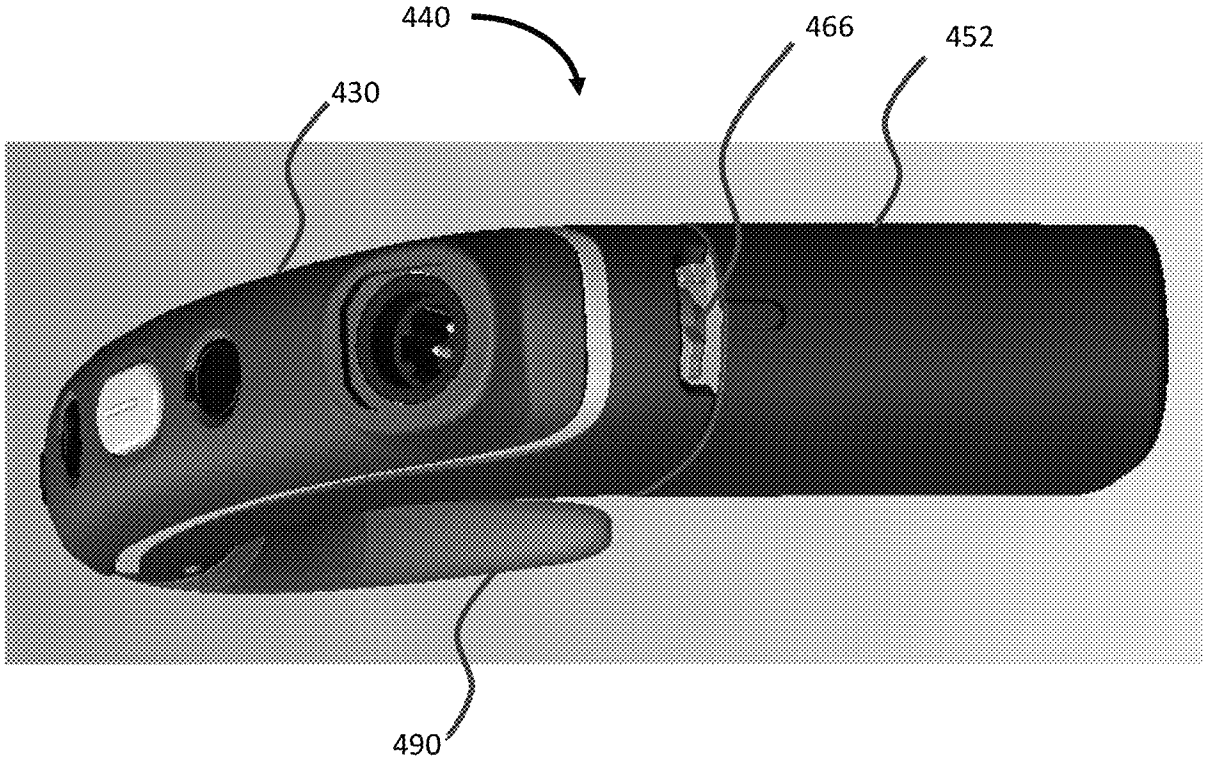
FIG. 4 is a perspective view of an alternate embodiment of a BTE device.

FIG. 4 depicts an exemplary BTE device 440 according to an exemplary embodiment. As seen BTE device 440 includes element 430, which functionally and structurally can correspond to element 330B above, and thus corresponds to the BTE electronics module of the BTE device. However, hereinafter, element 440 will be referred to by its more generic name as the signal processor sub-assembly, or sometimes the electronics component of the BTE device, or sometimes, for short, the signal processor. As can be seen, attached thereto is an element 452 which corresponds to element 252 above, and thus corresponds to a power component of the BTE device, which in some instances herein will be referred to as the battery sub-assembly, or the battery for short. Element 490 is an ear hook, and corresponds to element 290 above. The battery sub-assembly 452 is removably attached to the BTE electronics module, which here, is a sound processor sub-assembly 430 via a bayonet connector, the details of which will be described below. Latch 466 enables the recipient to unlock and lock the battery sub-assembly 452 from and to, respectively, the sound processor sub-assembly 430, via moving the handle of the latch 466 from one side of the BTE device 440 to the other side of the BTE device 440. In an exemplary embodiment, the ear hook 490 is a 70 Shore A, LSR KE-2093 overmolded body, or a separately molded body, or formed by any utilitarian manner enabled by the art that attaches permanently or removably to the BTE electronics module (e.g., by a snap coupling or an interference fit, etc.). In an exemplary embodiment, the ear hook 490 has a hardness of between 5 to 90 (inclusive, as is the case with respect to all ranges detailed herein unless otherwise noted) Shore A, and can have any value or range of values therebetween in about one increment. Any type of liquid silicone rubber material that can have utilitarian value can be utilized in at least some exemplary embodiments to make the ear hook 490.

Figure 5:
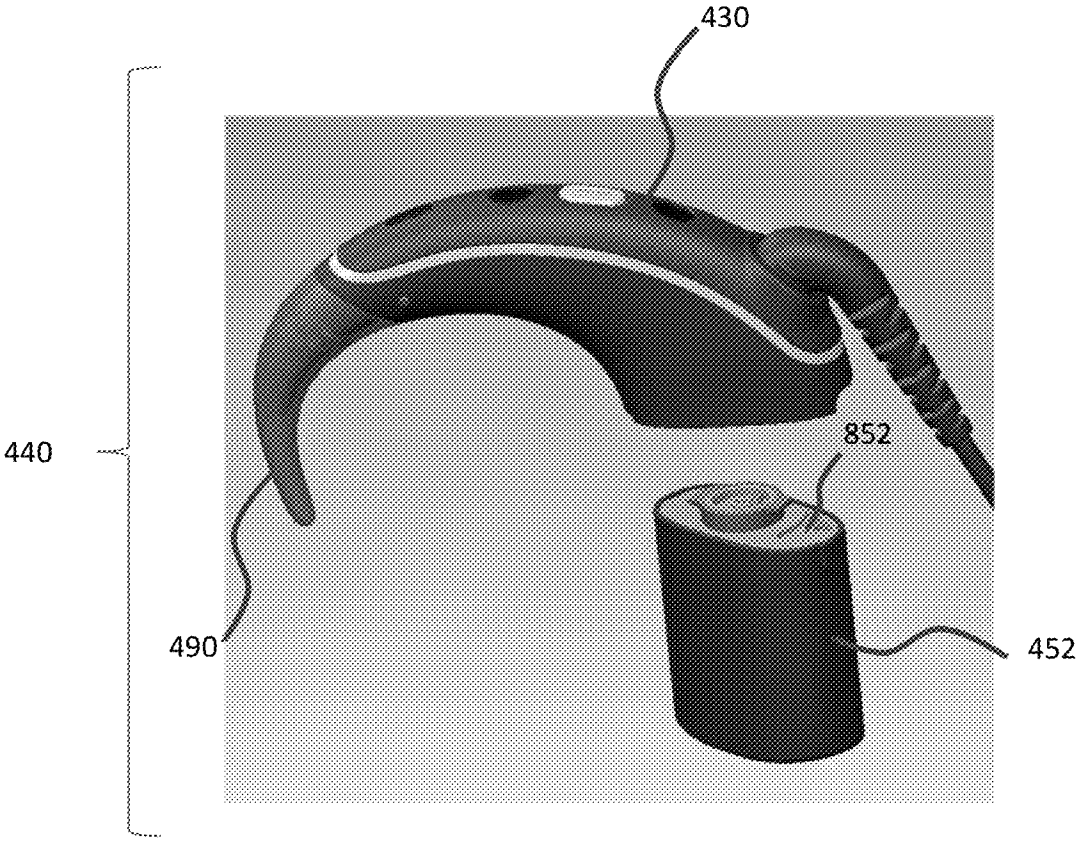
FIGS. 5, 6, and 7 are perspective views of attachment of a battery sub-assembly to a sound processor sub-assembly (another name in the art for a specific species of the genus of BTE electronics module) according to an exemplary embodiment.

FIG. 5 depicts the sound processor sub-assembly 430 and components connected thereto decoupled or otherwise unattached to the battery sub-assembly 452. The plug assembly 852 can be seen as part of the battery sub-assembly 452, which plug assembly interfaces with a corresponding socket assembly (not viewable in FIG. 5) of the electronics module 430 of the BTE device.

Figure 6:
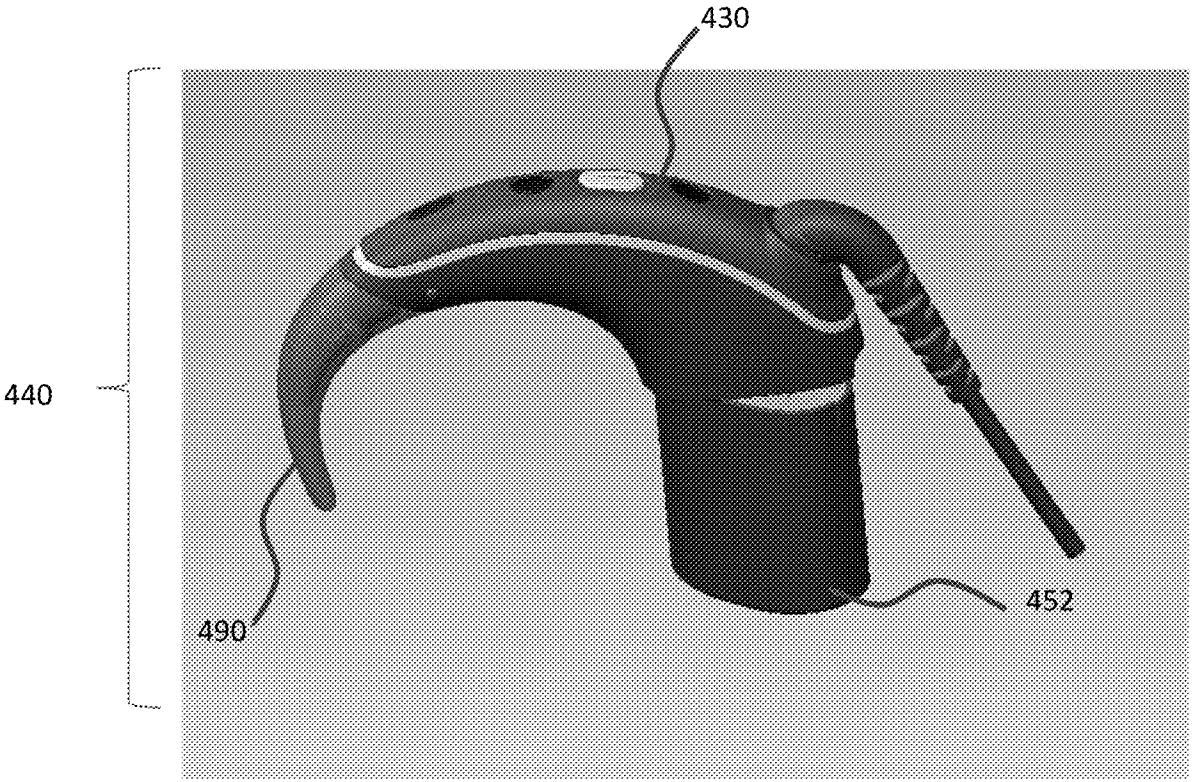
Figure 7:
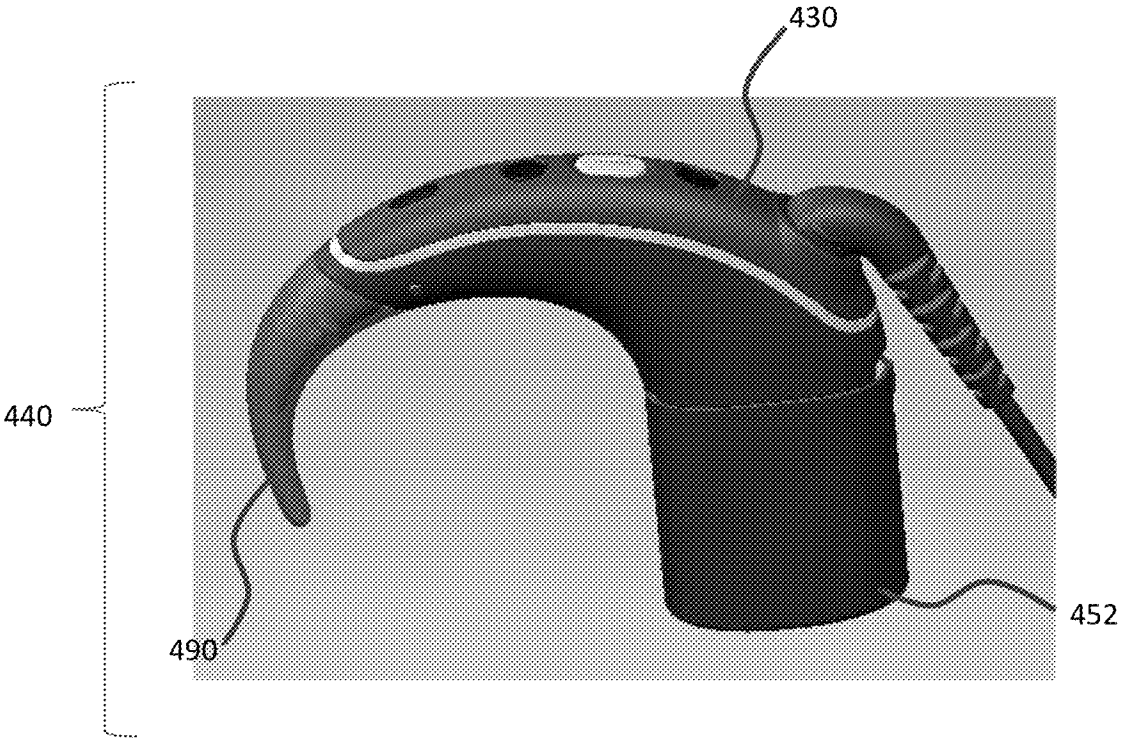

In an exemplary embodiment of attachment of the battery sub-assembly 452 to the sound processor sub-assembly 430, a recipient grasps the respective components with his or her left-hand and right-hand respectively, or vice versa, and moves the battery assembly 452 towards the sound processor sub-assembly 430, with the battery sub-assembly 452 canted about the longitudinal axis thereof relative to its final orientation when fully and completely attached to the sound processor sub-assembly 430. FIG. 6 depicts the battery sub-assembly 452 in contact with the sound processor sub-assembly 430 with some rotation about the longitudinal axis of the battery sub-assembly relative to that which is the case shown in FIG. 5. In an exemplary embodiment, this rotation engages the bayonet fittings to attach the battery sub-assembly 452 to the sound processor sub-assembly 430, as will be described in greater detail below. FIG. 7 depicts the battery sub-assembly 452 fully rotated about its longitudinal axis so as to fully connect or otherwise seat the battery sub-assembly 452 to/against the sound processor assembly 430. Subsequent this action, as noted above, the latch 466 is moved so as to lock the battery sub-assembly 452 to the sound processor sub-assembly 430. In an exemplary embodiment, to remove the battery sub-assembly 452 from the sound processor sub-assembly 430, the latch 466 is moved so as to unlock the components and then the battery sub-assembly 452 is rotated about its longitudinal axis so as to undo the bayonet fitting, and then put downward in the direction of its longitudinal axis, away from the sound processor sub-assembly 430, and thus decoupling the battery sub-assembly 452 from the sound processor sub-assembly 430.

Figure 8:
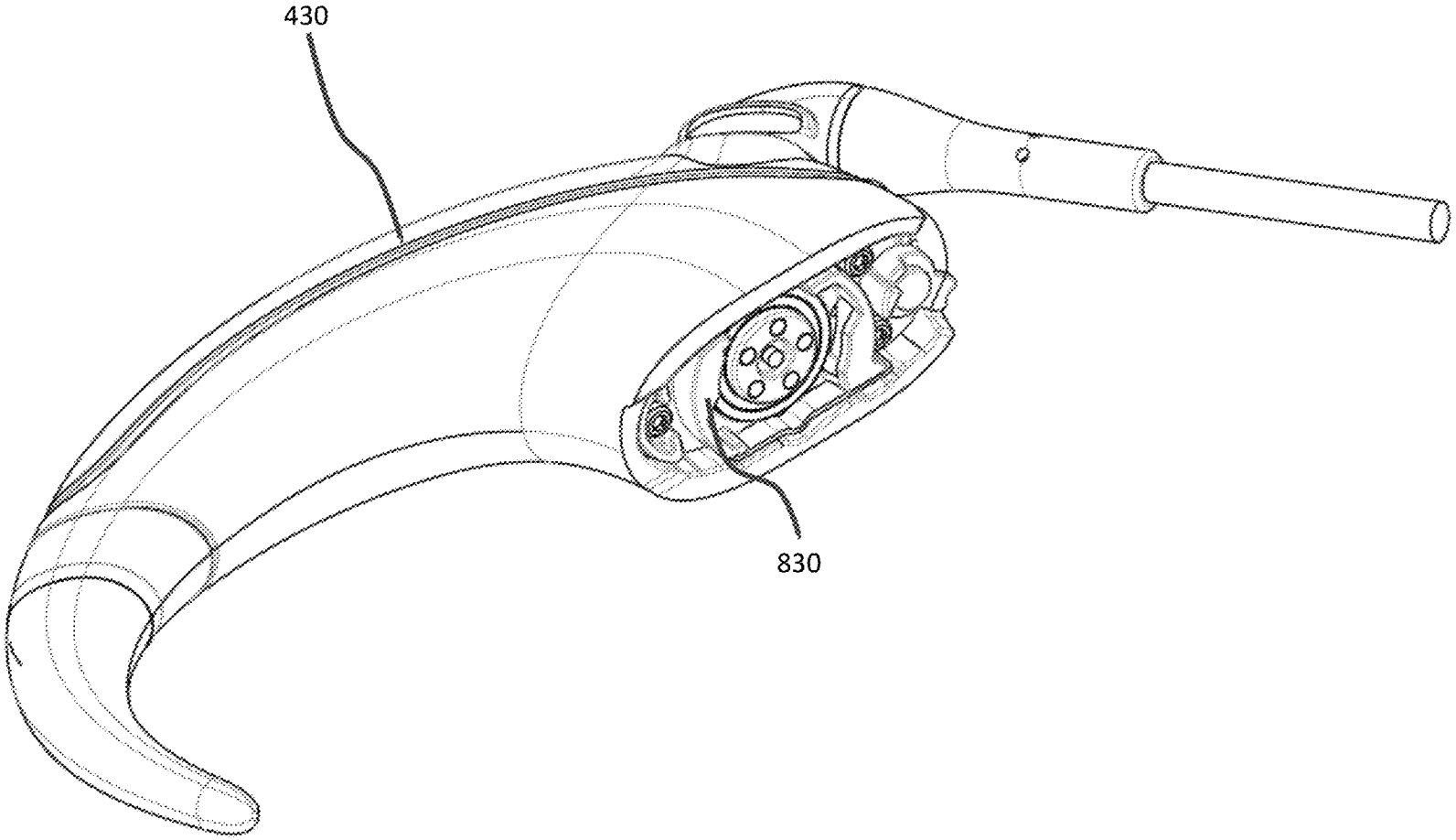
FIG. 8 is a bottom perspective view of a sound processor sub-assembly according to an exemplary embodiment.
Figure 9:
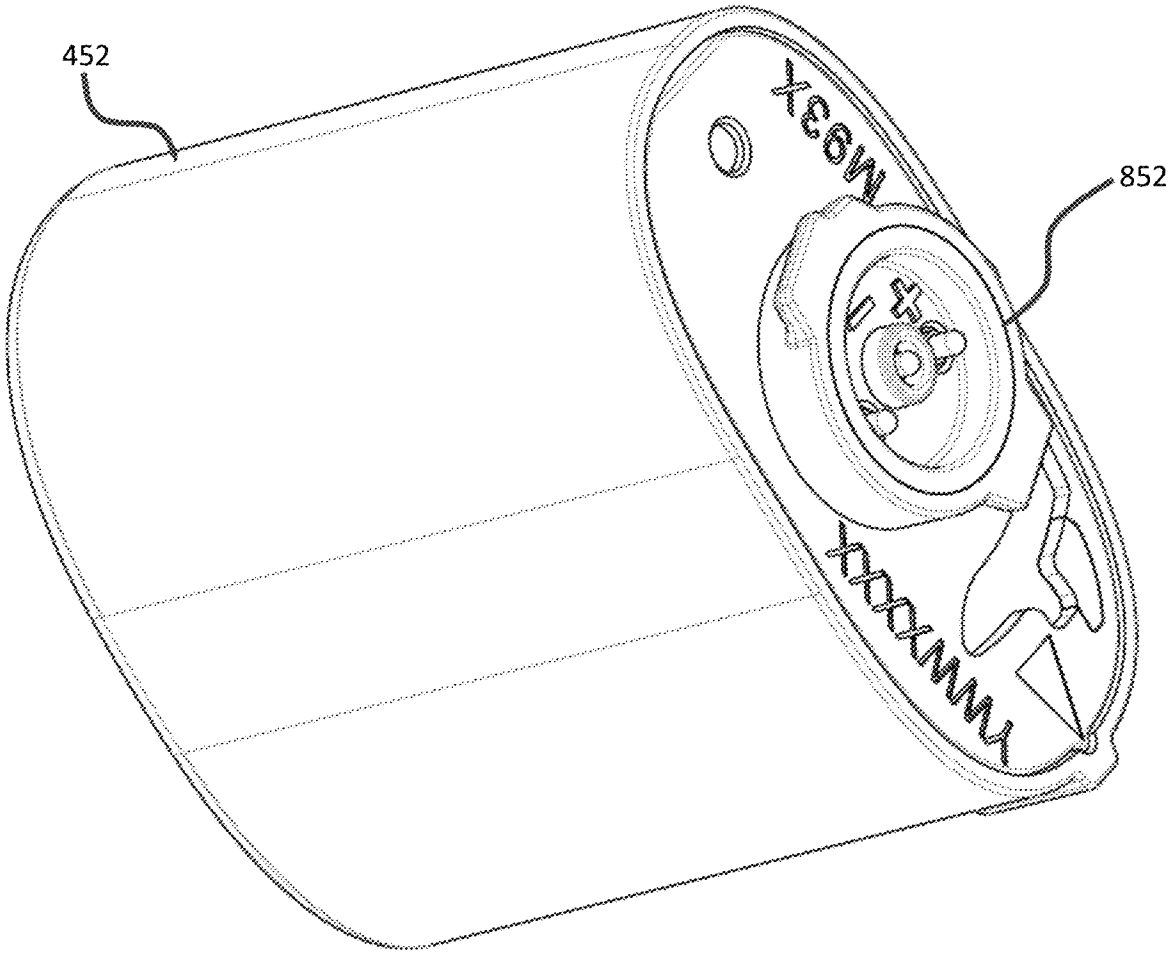
FIG. 9 is a top perspective view of a battery subassembly according to an exemplary embodiment.
Figure 10:
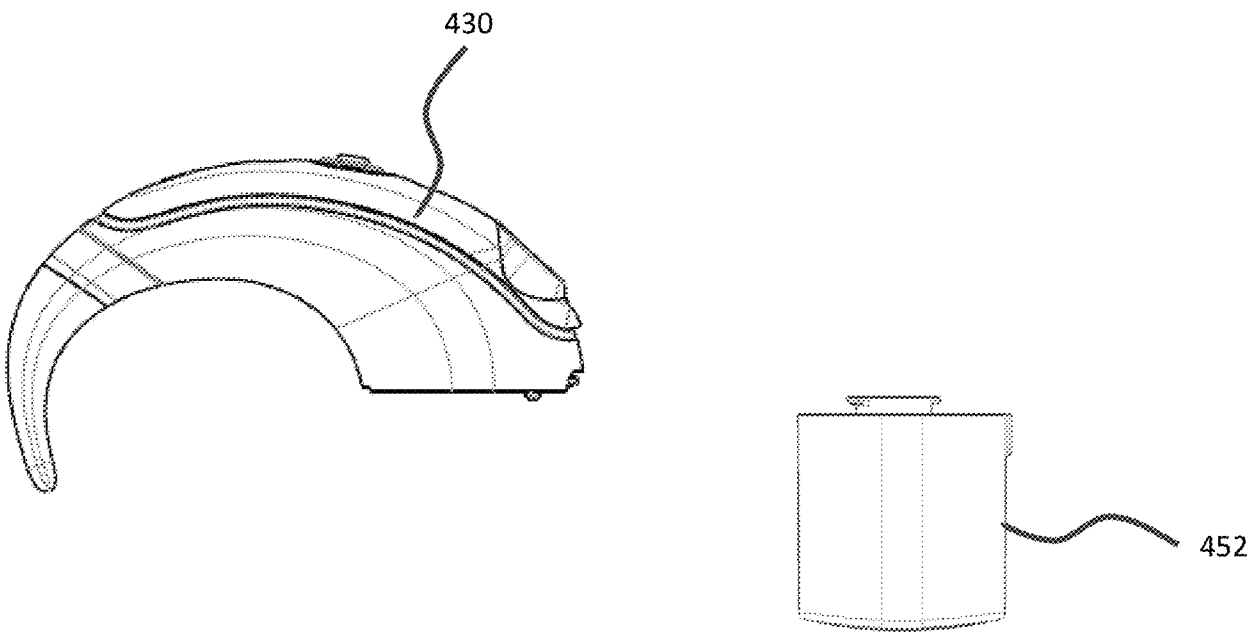
FIGS. 10, 11, and 12 schematically depict an alternate configuration where the battery sub-assembly is laterally moved to connect to the sound processor sub-assembly.
Figure 11:
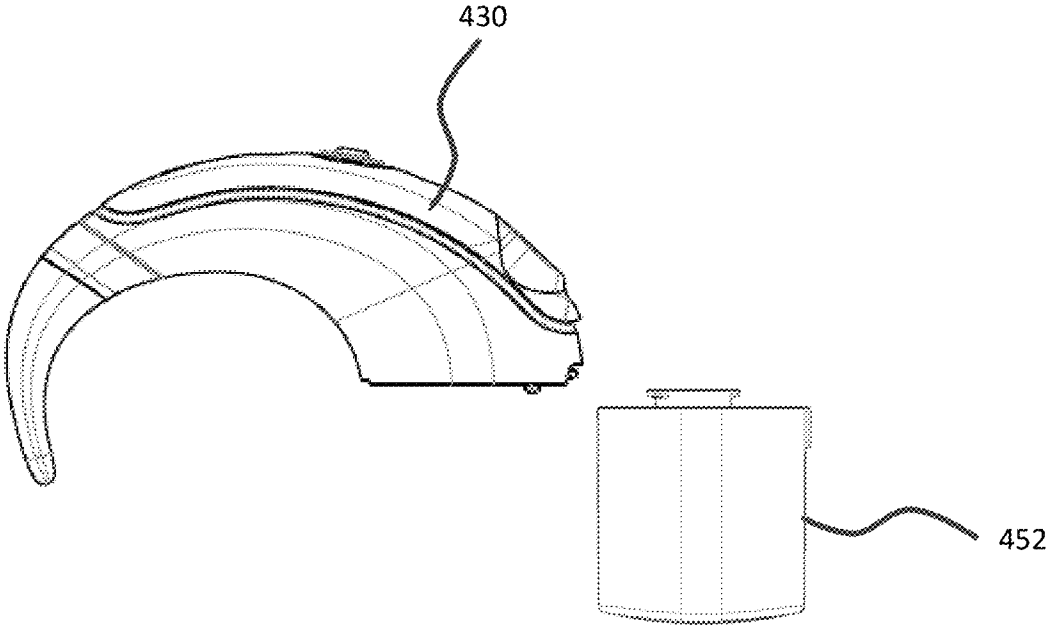

FIG. 8 depicts an isometric bottom view of the sound processor sub-assembly 430 which enables a view of the socket assembly 830 thereof. FIG. 9 depicts an isometric top view of the battery sub-assembly 452 which depicts the plug assembly 852 thereof. As noted above, the plug 852 and the socket 830 respectively cooperate to form a bayonet coupling/bayonet connector. FIGS. 10 and 11 respectively depict the socket assembly 830 and the plug assembly 852 in isolation from the rest of the sound processor sub-assembly and the battery sub-assembly.

Figure 12:
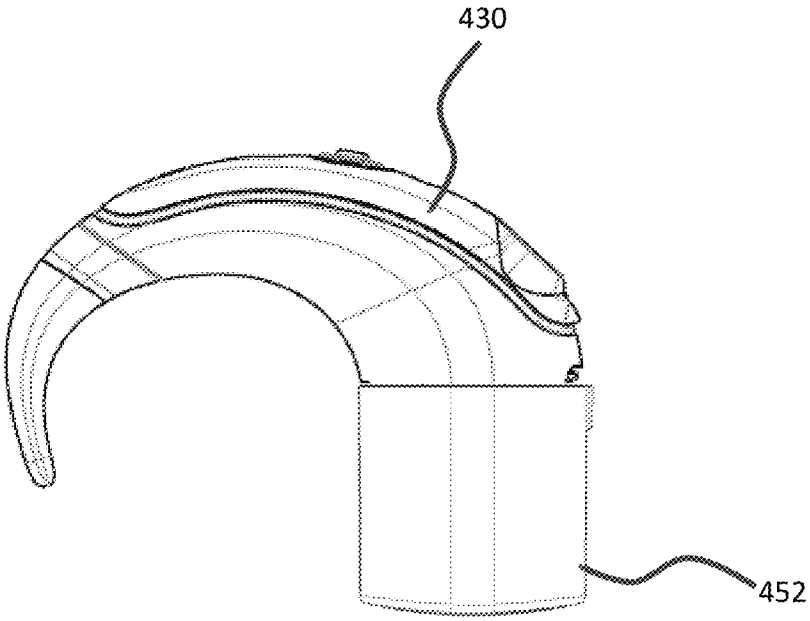

It is also noted that while the embodiments detailed above have focused on the male portion of the bayonet coupling being on the battery subassembly and the female portion of the bayonet coupling being on the sound processor subassembly, in some alternate embodiments, the reverse is the case. That is, the female portion of the banner coupling can be located on the battery subassembly, and the male portion of the bayonet coupling can be located on the sound processor subassembly. Any arrangement of any component of the connector assemblies of the battery subassembly and the sound processor subassembly that can have utilitarian value can be utilized in at least some exemplary embodiments. Literally any shape or configuration or dimensioning that can enable the removal and replacement of the battery subassembly from the sound processor subassembly can be utilized. Indeed, while the embodiments above have focused on an arrangement where a bayonet coupling is utilized so that the battery subassembly 452 can be moved in the vertical direction/in the longitudinal direction of the battery subassembly up to the sound processor subassembly 430 and then turned to couple the two subcomponents together in the traditional manner of a bayonet coupling, in an alternative embodiment, such as is schematically illustrated in FIGS. 10, 11, and 12, the battery subassembly 452 is moved in the lateral direction so as to connect to the sound processor subassembly 430, and moved in the opposite direction so as to disconnect from the sound processor subassembly 430. In such an embodiment, in at least some exemplary embodiments, instead of a bayonet coupling, a different type of coupling is utilized, such as a C shape female slotted connector and a male shape T extruded connector, where the head of the T fits into the concave portion of the C in a sliding manner (where the C and the T extend inward and outward of this page). Consistent with the above embodiments, the male portion can be on the battery assembly and the female portion can be on the sound processor subassembly or vice versa. Another type of coupling, such as a snap coupling, can be utilized in at least some alternative embodiments. Any arrangement whatsoever that can enable the battery subassembly to be removably coupled to the sound processor subassembly can be utilized in at least some exemplary embodiments.

Figure 13:
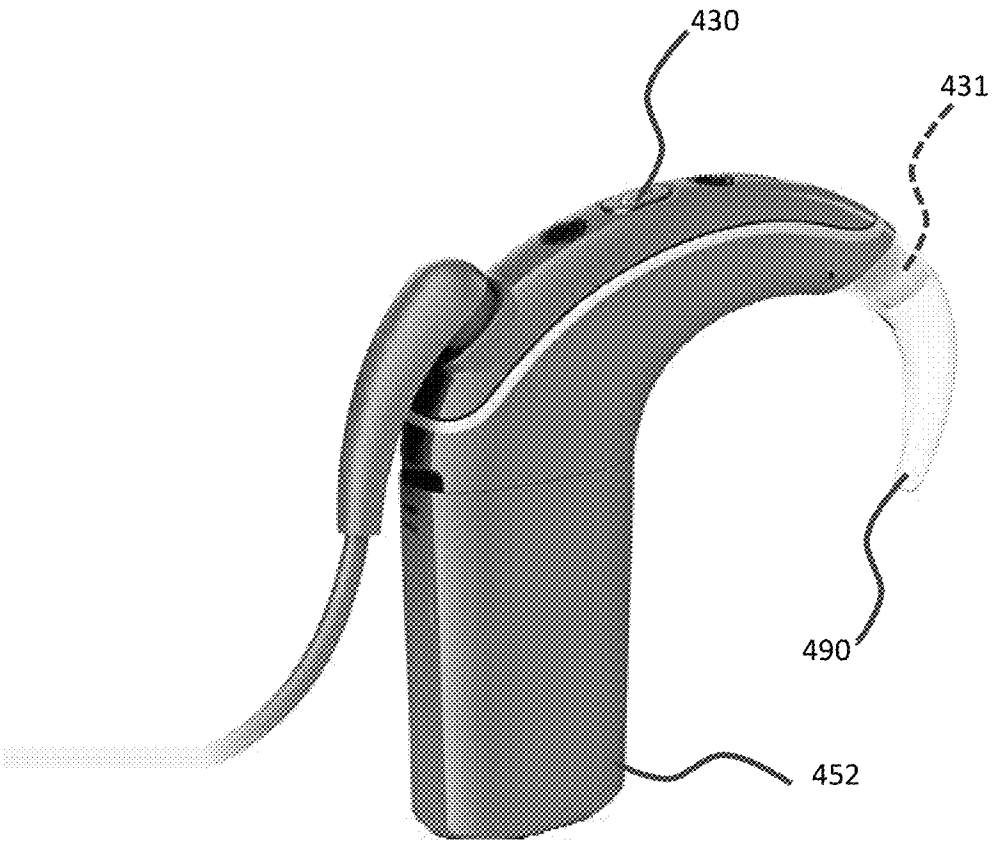
FIG. 13 depicts a BTE device including a transparent ear hook 490.

In at least some exemplary embodiments, there is utilitarian value with respect to the utilization of the ear hook 490. In this regard, in some exemplary embodiments, the ear hook 490 can have utilitarian value with respect to helping to maintain the BTE electronics module 430 on the pinna of the recipient. In at least some exemplary embodiments, there is a male portion of the BTE electronics module 430 at the apex thereof (opposite from the base of the BTE electronics module 430—the location where the battery subassembly 452 interfaces with the BTE electronics module 430) that is enveloped by the ear hook 490 female portion at the base thereof (the portion of the ear hook 490 that interfaces with the body/main body of the BTE electronics module 430). FIG. 13 depicts the male portion 431 of the BTE electronics module 430 (and can also be seen in other figures, such as those discussed below). The male portion 431 (in some embodiments, a female portion can instead be on the BTE electronics module, and a male portion can be on the apparatus that connects thereto) can be seen through the transparent/semitransparent material (in some embodiments, the material is not transparent) of the ear hook 490 (the male portion 431 can be seen in other figures above as well). In an exemplary embodiment, the male portion has a generally T shaped cross-section, the head/top of the T being opposite the base of the BTE electronics module 430 (other shapes can be used as well—indeed a pin through both parts aligned in a manner that enables retention can be used in some embodiments). Conversely, in an exemplary embodiment, the female portion of the ear hook 490 has a C shaped cross-section, the opening of the C facing the base of the ear hook 490/the apex of the BTE electronics module 430. In an exemplary embodiment, the flexible material of the ear hook 490 envelops the male portion 431 such that the tips of the C cross-section fit underneath/behind the top of the T of the cross-section of the male connector 431, thereby retaining the ear hook 490 to the BTE electronics module 430. Some additional details of this will be described in greater detail below.

While the embodiment just described details a flexible or otherwise elastomeric ear hook 490, which can be pushed over the male portion to retain the ear hook thereto, an alternative embodiment, the ear hook 490 is a rigid component that is molded about the male portion 431. That said, with respect to the embodiments where the ear hook is a flexible component, in some exemplary embodiments, the ear hook 490 is removable from the BTE electronics module 430. Indeed, it is typically readily removable by gripping the ear hook 490 between one's thumb and first finger and then pulling the ear hook away from the BTE electronics module 430. In at least some exemplary embodiments, the ear hook 490 is made of an elastomeric material that readily deforms to slip off of the male portion 431 of the BTE electronics module 430. Conversely, in the absence of this removal force, the ear hook 490 is retained on the BTE electronics module 430, and thus maintains that utility with respect to helping to keep the BTE device 440 on the pinna of the recipient.

That said, in at least some exemplary scenarios of use of the ear hook 490, BTE device associated there with can still fall off the recipient a statistically significant number of times. Accordingly, there can be utilitarian value with respect to providing an apparatus that better maintains the BTE device on the pinna of the recipient.

Accordingly, in at least some exemplary embodiments, there is a retention loop apparatus that attaches to the BTE device subassembly that includes the battery subassembly 452 and the electronics module 430. Hereinafter, this subassembly is referred to as the BTE device operational assembly. In this regard, the BTE device operational assembly includes the BTE electronics module 430 and the battery 452. It does not include the ear hook 490.

Figure 14A:
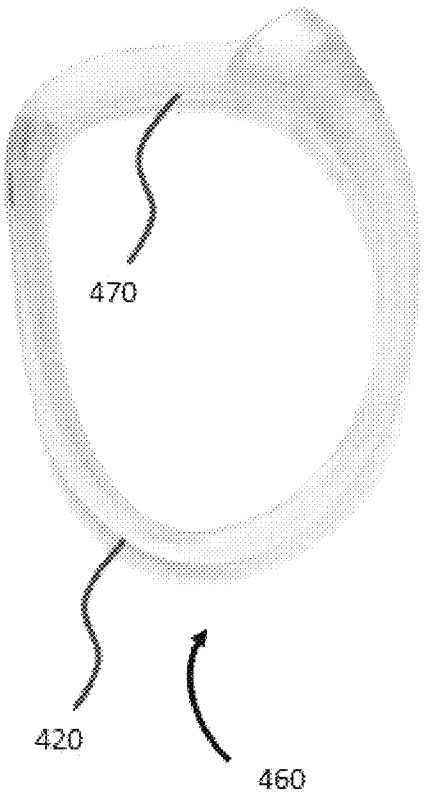
FIGS. 14A and 14B depict a retention loop apparatus according to an exemplary embodiment.

To this end, FIG. 14A depicts a retention loop apparatus 460 that provides ear hook functionality, and retention functionality. Retention loop apparatus 460 is configured to extend completely around the pinna, as opposed to the ear hook 490, which only extends to the front of the pinna. In this embodiment, the retention loop apparatus 460 extends all the way around the front of the pinna, and then under the pinna (with respect to looking at the recipient from the side, behind the ear lobe), and then back upwards behind the pinna, thus circumnavigating the pinna. In this exemplary embodiment, such can have utilitarian value with respect to improving the scenarios in which the BTE device will be less likely to fall off or otherwise leave the presence of the recipient relative to that which would be the case in embodiments utilizing the ear hook. (It is noted that the term "loop" as used herein means a loop that is closed.)

Figure 14B:
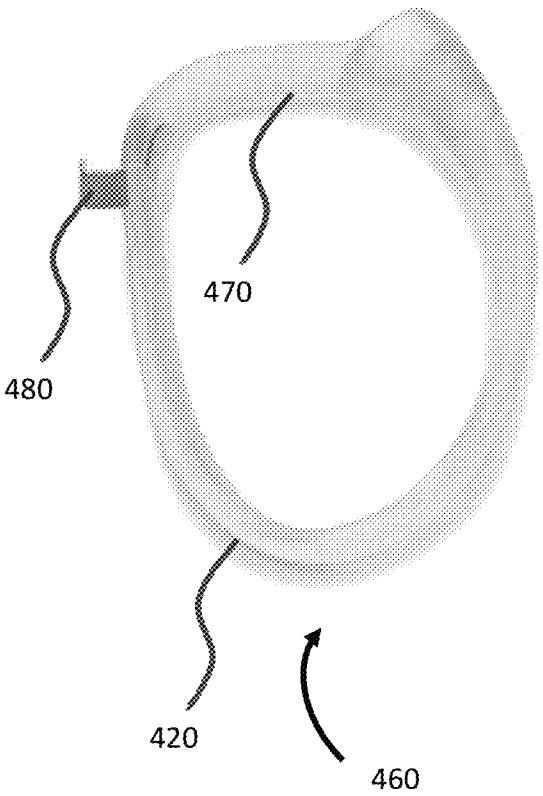

Briefly, in this exemplary embodiment, as will be described in greater detail below, the retention loop apparatus 460 includes two portions: a retention loop chassis 470 to which is connected a bottom body 420. In an exemplary embodiment, components 470 and 420 are separate components, but are integral and non-removable relative to one another (by non-removable, it means that at least one component must be broken or otherwise permanently deformed from a relaxed/steady state/normal state). FIG. 14B depicts an alternate embodiment, which is identical to that of FIG. 14A, but includes a connector 480. The retention loop apparatus 460 of FIG. 14B is configured to make it more difficult to remove from the BTE device operational assembly than that which is the case with respect to the embodiment of FIG. 14A. More particularly, with respect to this embodiment, the retention loop apparatus 460 includes a male connector 480 that includes a hook portion at a distal end thereof. In this exemplary embodiment, a portion of the male connector 480, a proximal portion, is embedded in a retention loop chassis 470. Connected to this retention loop chassis 470 is the bottom body 420. In an exemplary embodiment, components 480, 470, and 420 are separate components, but are integral and non-removable relative to one another (by non-removable, it means that at least one component must be broken or otherwise permanently deformed from a relaxed/steady state/normal state). Some additional features of the retention loop apparatus 460 will be described below, but first, briefly, the general interface of the retention loop apparatus 460 with the other components of the BTE device will now be described. For the most part, this description will focus on the embodiment of FIG. 14B, the embodiment that includes the male connector 480. That said, it is to be understood that these descriptions are also applicable to the embodiments without the male connector 480 vis-à-vis the other features.

Figure 15A:
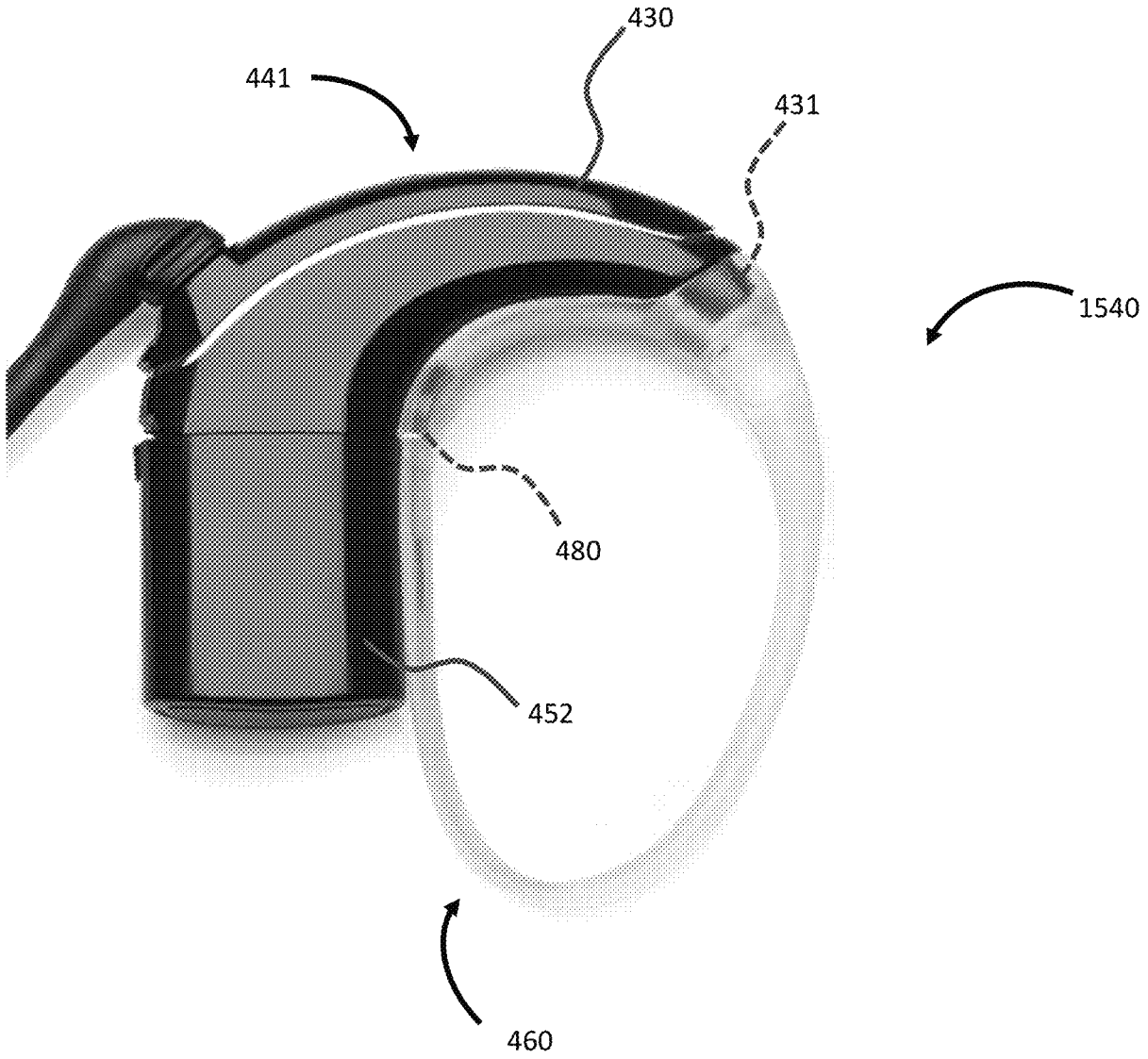
FIG. 15A depicts the retention loop apparatus of FIG. 14A attached to the BTE electronics component of the BTE device, to which a battery is attached.
Figure 15B:
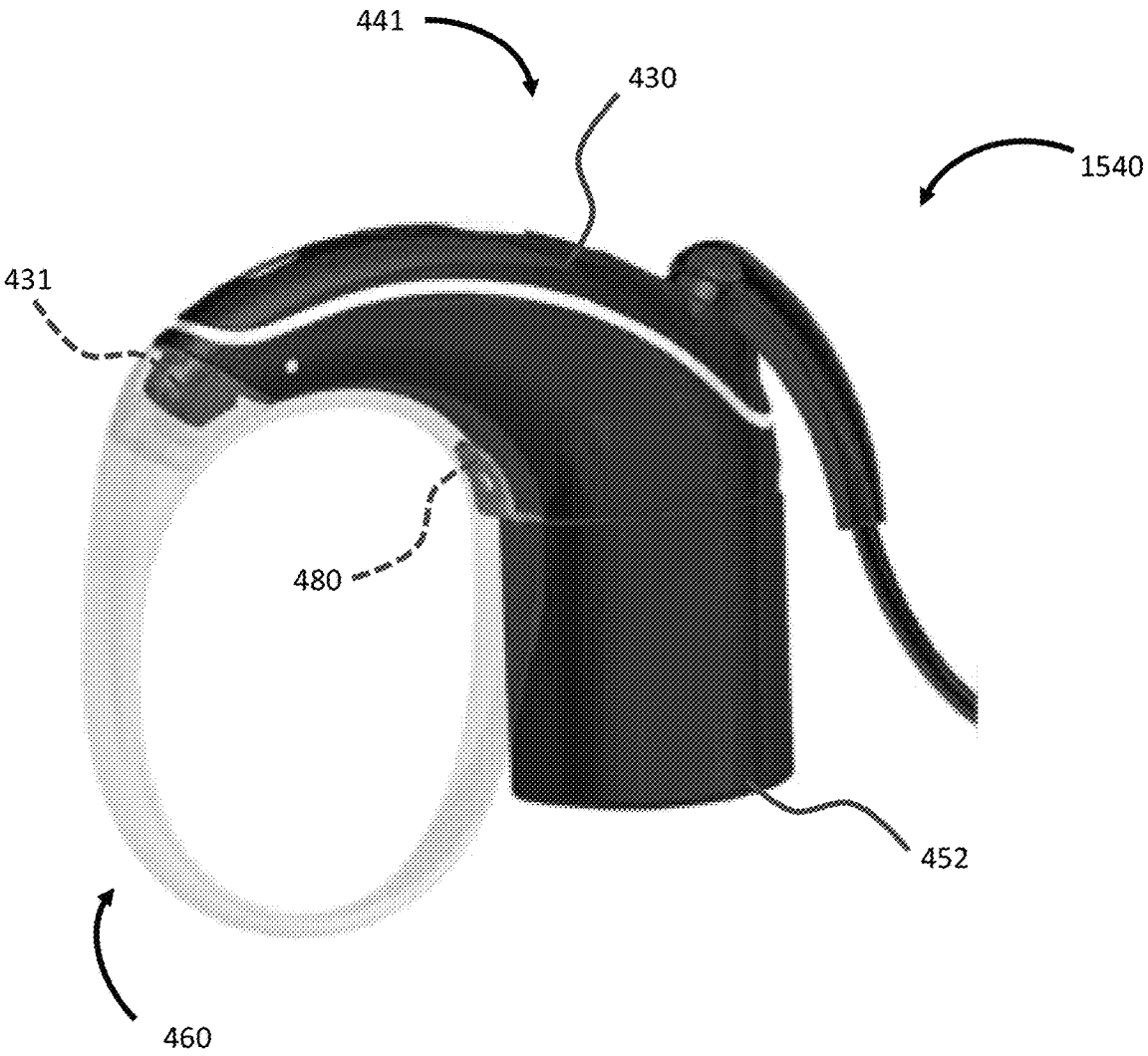
FIG. 15B depicts additional details of the teachings of FIG. 15A.

FIGS. 15A and 15B depict an exemplary embodiment of the retention loop apparatus 460 interfacing with the BTE device operational assembly 441 to establish a BTE device 1540. In the embodiment of FIG. 15A, the male connector 480 extends in between the base of the BTE electronics module 430 and the battery 452. In an exemplary embodiment, there is a recess that extends upwards from the base of the BTE electronics module 430 that accepts the hook portion of the distal portion of the male connector 480. Owing to the geometry of the battery 452 and the BTE electronics module 430, the male connector 480 cannot move upward or downward or to the left or to the right, at least not by any significant amount, when the BTE device operational assembly is assembled (i.e., the battery 452 is locked to the BTE device 430). By way of example only and not by way of limitation, in an exemplary embodiment, the BTE electronics module 430 includes a recess in the base thereof that receives the horizontal portion of the male connector 480. In effect, in at least some exemplary embodiments, when the battery subassembly 452 is connected to the BTE electronics module 430, the recess forms a tunnel from the outside and front of the BTE device operational assembly 441 to the recess that receives the hook portion (the vertical portion) of the male connector 480. By way of example only and not by way of limitation, in exemplary embodiment, the battery 452 has a recess in the top portion that receives the horizontal portion of the male connector 480, which too forms a tunnel from the outside front of the BTE device operational assembly 441. In an exemplary embodiment, the recess establishing the tunnel is entirely within the BTE electronics module 430. In an exemplary embodiment, the recess establishing the tunnel is entirely within the battery 452. Of course, in both instances, a portion of the tunnel is established by the other component. Here, there is simply no recess in that component. That said, in an exemplary embodiment, there is a recess in both the BTE electronics module 430 and the battery 452. In these exemplary embodiments, at least some of them, the tunnel prevents the male connector 480 from moving left, right, up and/or down (all directions relative to a view of the BTE device looking from the front (i.e., looking at the BTE device when worn on a person where the viewer is looking directly at the persons face).

Figure 16:
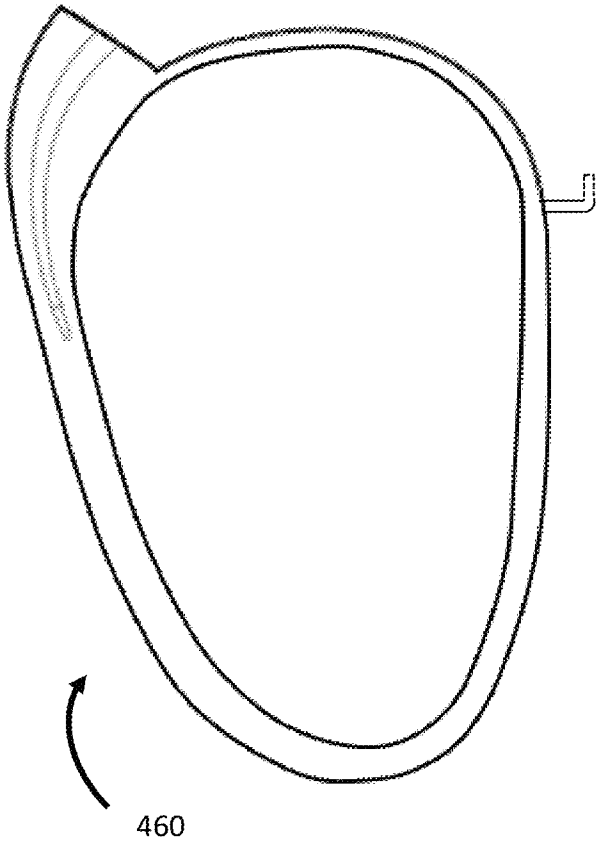
FIG. 16 depicts a side view of the retention loop apparatus of FIG. 14A.
Figure 17A:
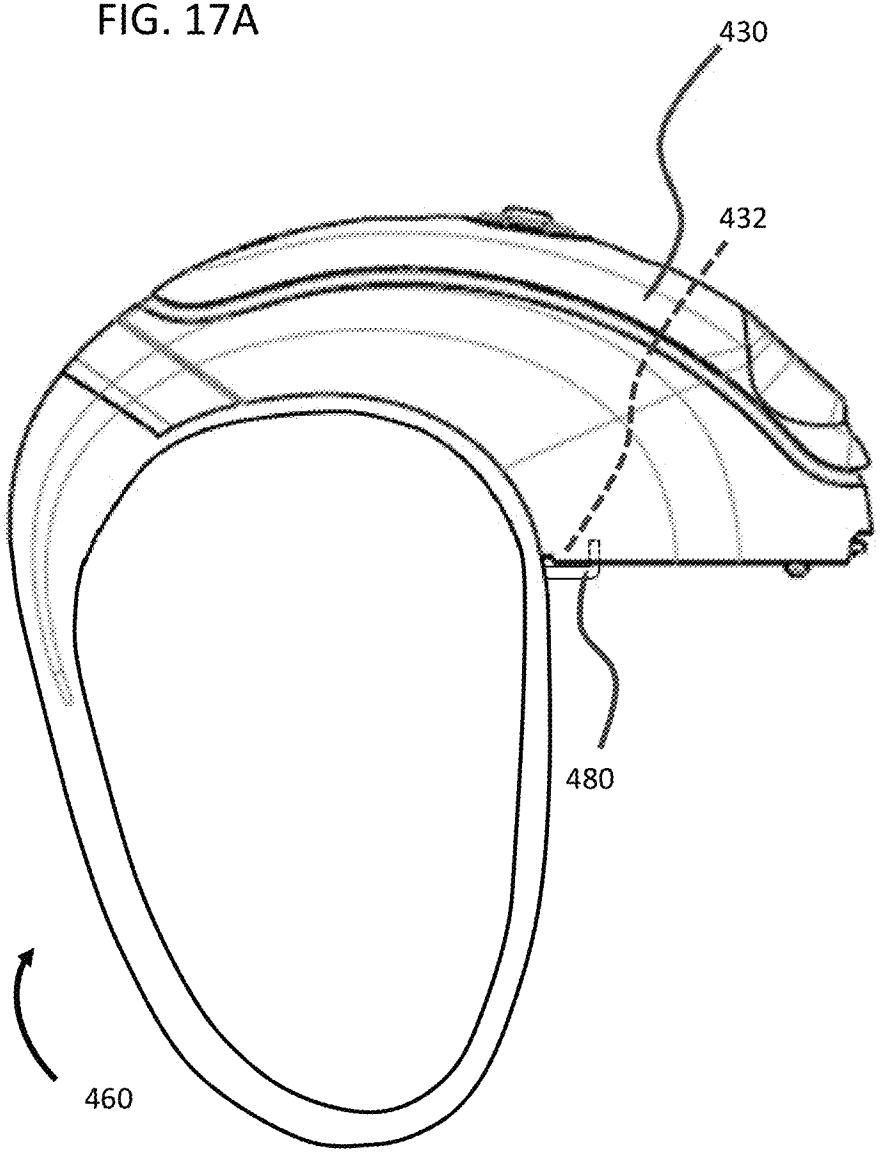
FIG. 17A depicts the retention loop apparatus of FIG. 14A attached to the BTE electronics component of the BTE device.
Figure 17B:
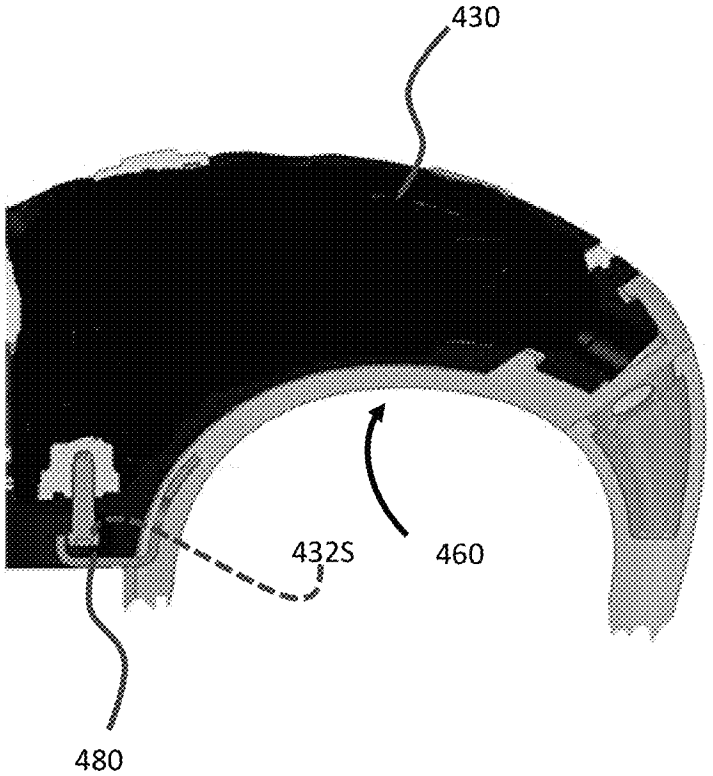
FIG. 17B depicts the retention loop apparatus of FIG. 14A attached to the BTE electronics component of the BTE device.

In an exemplary embodiment, the retention loop apparatus 460 is first put on the BTE electronics module 430 prior to attachment of the battery 452 thereto. In this regard, FIG. 16 depicts a side view of the retention loop apparatus 460, by itself, and FIG. 17A depicts the retention loop apparatus 460 interfacing with the BTE electronics module 430. As can be seen, the hook portion (vertical portion) of the male connector 480 extends upwards into the base of the BTE electronics module 430. In this embodiment, lead line 432 points to structure interposed between the hook portion and the outside of the BTE electronics module. FIG. 17B provides an exemplary embodiment of such structure, screw 432S, which is screwed into the plastic body of the BTE electronics module 430. In some embodiments, the screw 432S reacts against the hook portion of the connector 482 that prevents the male connector, and thus the apparatus 460, from being removed from the BTE device operational assembly 441.

In this regard, owing to the hook at the distal end of the male connector 480, and the geometry of the BTE electronics module 430, the male connector 480 cannot move forward away from the BTE electronics module 430 (because the hook portion extends into the recess, and the recess or other component of the BTE electronics module 430 includes a component that is located between the hook portion and the retention loop chassis 470). That is, when the chassis 470 is pulled forward/away from the BTE electronics module 430, the hook portion of the male connector 480 catches on the recess/the structure of the BTE electronics module 430 interposed between the hook portion and the outside of the BTE electronics module, thus preventing removal of the retention loop apparatus 460 from the BTE device operational assembly 441.

Figure 18A:
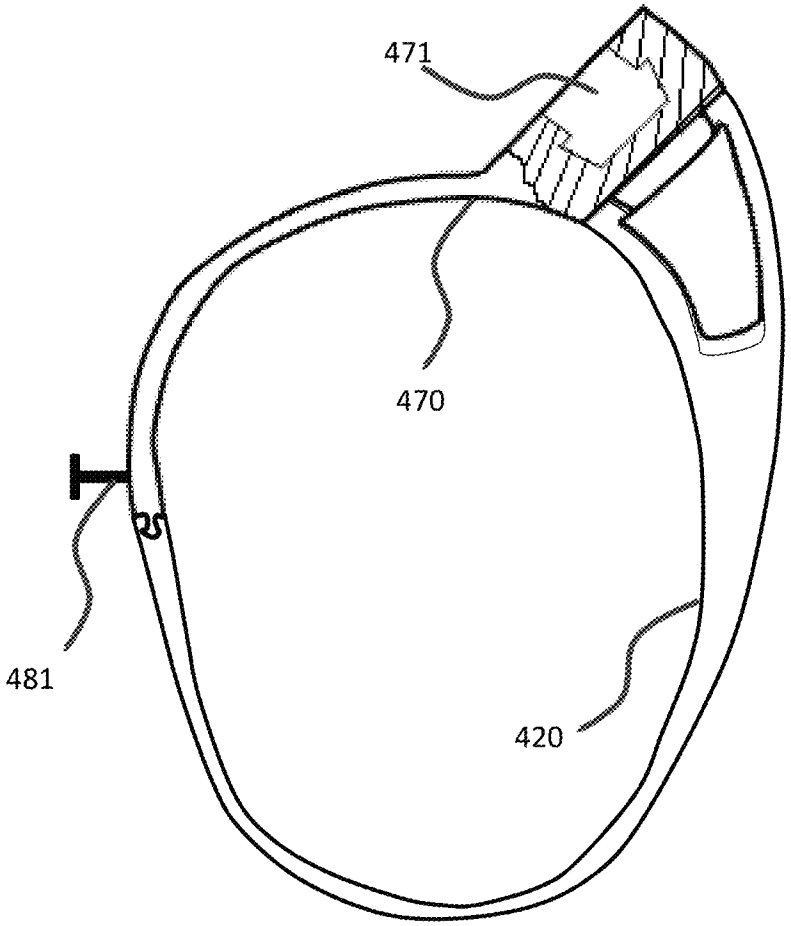
FIG. 18A presents an alternate embodiment of the retention loop apparatus.

In view of the above, it is to be understood that in an exemplary embodiment, there is a retention loop apparatus, such as retention loop apparatus 460, that includes a bottom body, such as bottom body 420, a retention loop chassis, such as chassis 470, and a male connector, such as male connector 480. In this exemplary embodiment, the retention loop apparatus is configured such that the male connector attaches to one or more components of a BTE device at and/or below the base of a BTE electronics module, such as module 430, of the BTE device. By attaches to one or more components of a BTE device at the base of a BTE electronics module, such corresponds to the embodiment of FIG. 17A and of FIG. 17B where the hook portion of the male connector 480 extends upwards, thus attaching to BTE electronics module 430, electronics module 430 corresponding to one component of a BTE device. By attaches to one or more components of a BTE device below a base of a BTE electronics module, such corresponds to an embodiment where the hook portion of the male connector 480 extends downwards, thus attaching to battery 452, battery 452 corresponding to one component of a BTE device. With respect to this latter embodiment, in an exemplary embodiment, the recess that receives the hook portion can be located in the battery 452. It is noted that with respect to one or more components of a BTE device at and/or below the base of a BTE electronics module, such includes an embodiment where the hook is a dual hook (e.g., a sideways T, such as that seen in FIG. 18), where there is a recess both in the BTE electronics module 430 and the battery 452. Any arrangement that can enable the retention loop apparatus 460 to be secured in a fashion that frustrates removal thereof from one or more of the various components of the BTE device can be utilized in at least some exemplary embodiments. Some additional alternate embodiments corresponding to such will be described in greater detail below. First however, some additional features of the retention loop apparatus 460 will now be described.

Figure 18B:
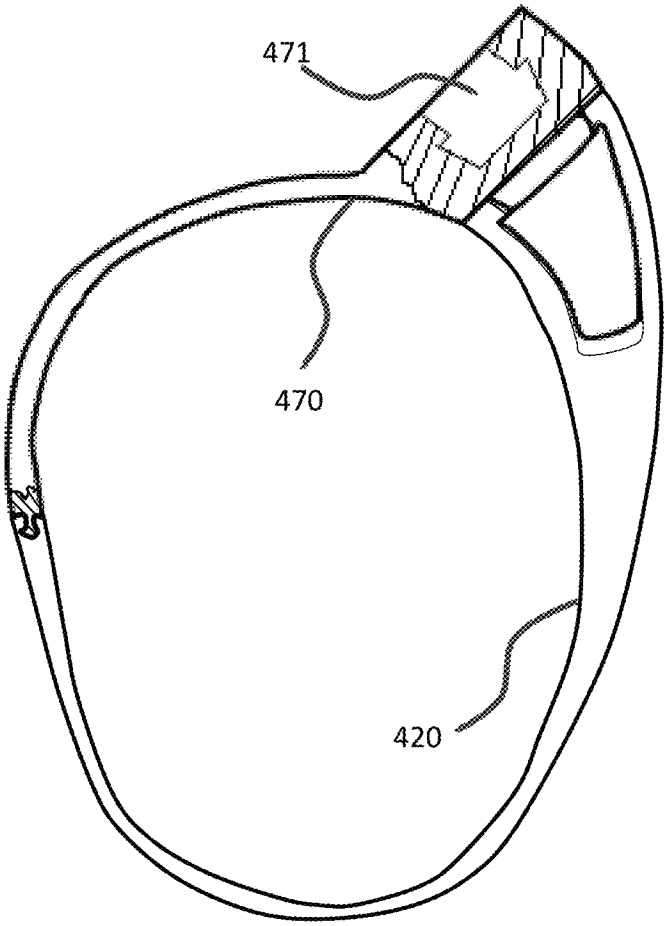
FIG. 18B presents an alternate embodiment of the retention loop apparatus.
Figure 19:
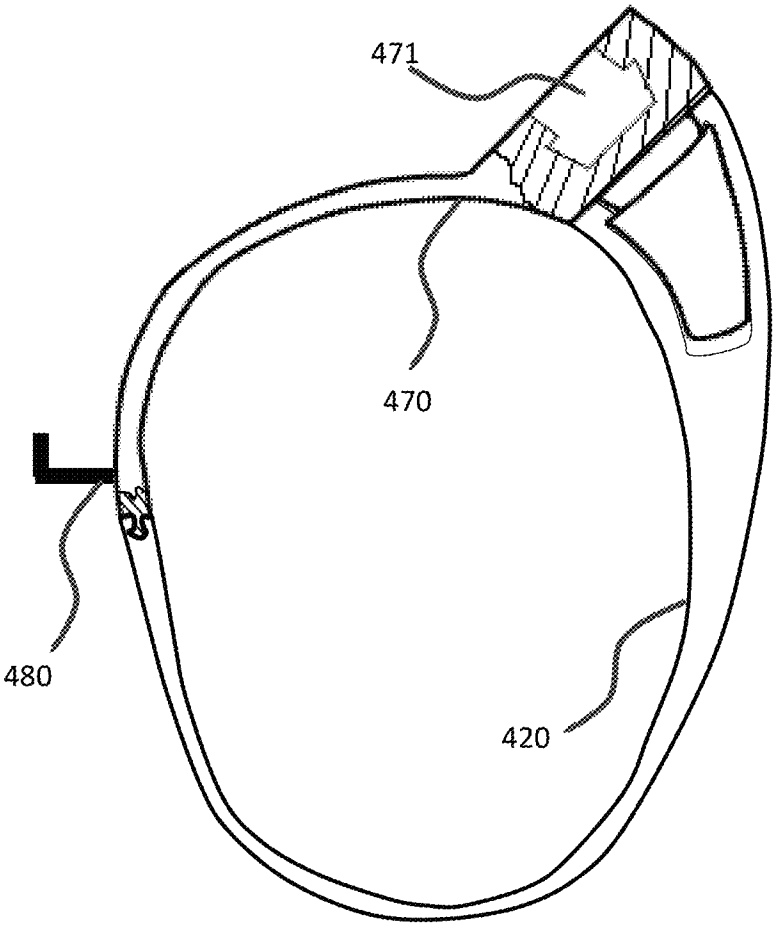
FIGS. 19-25 provide various views for various details of the retention loop apparatus of FIG. 14A.

FIG. 19 (FIG. 18B depicts the original embodiments of FIG. 14A where there is no male connector—the embodiment with the male connector will be the focus here, but again, much of the following is applicable to the embodiment of FIG. 18B as well) depicts an exemplary embodiment of the retention loop apparatus 460, with a partial cross-sectional view of the chassis 470 at two locations (the crown portion (the portion that establishes the female portion 471) and the portion that interfaces with the bottom body (behind the ear) that includes male portion 475 and a total cross-sectional view of the bottom body 420 (cross-hatching has been removed). As can be seen, there is a female portion in the retention loop chassis 470. In an exemplary embodiment, female portion 471 is sized and dimensioned to receive the male portion 431 of the BTE electronics module 430. In an exemplary embodiment, the retention loop chassis 470 is sized and dimensioned so that the chassis 470 snap fits on to the male portion 431 in a removable matter. In this regard, the material of the chassis 470 is configured to elastically deformed so as to snap onto and off of the male portion 431. That said, alternatively and/or in addition to this, is the male portion 431 of the BTE electronics module 430 that is configured to elastically deformed. In an exemplary embodiment, the bottom body 420 is a 70 Shore A, LSR KE-2093 overmolded body. In an exemplary embodiment, the bottom body 420 is has a hardness of between 5 to 90 (inclusive, as is the case with respect to all ranges detailed herein unless otherwise noted) Shore A, and can have any value or range of values therebetween in about one increment. It is also noted that in at least some exemplary embodiments, the chassis 470 can be made of such material as well. In some embodiments, the material is the same and/or the hardness is the same. In some exemplary embodiments, the hardnesses are different. In an exemplary embodiment, the hardness of the chassis can be more than or less than 30%, 25%, 20%, 15%, 10%, 5% the hardness of the loop.

In an exemplary embodiment, the retention loop chassis 470 is a hard material, at least relative to the bottom body 420. In an exemplary embodiment, the bottom body 420 is an elastic material, at least relative to the retention loop chassis 470.

Figure 20A:
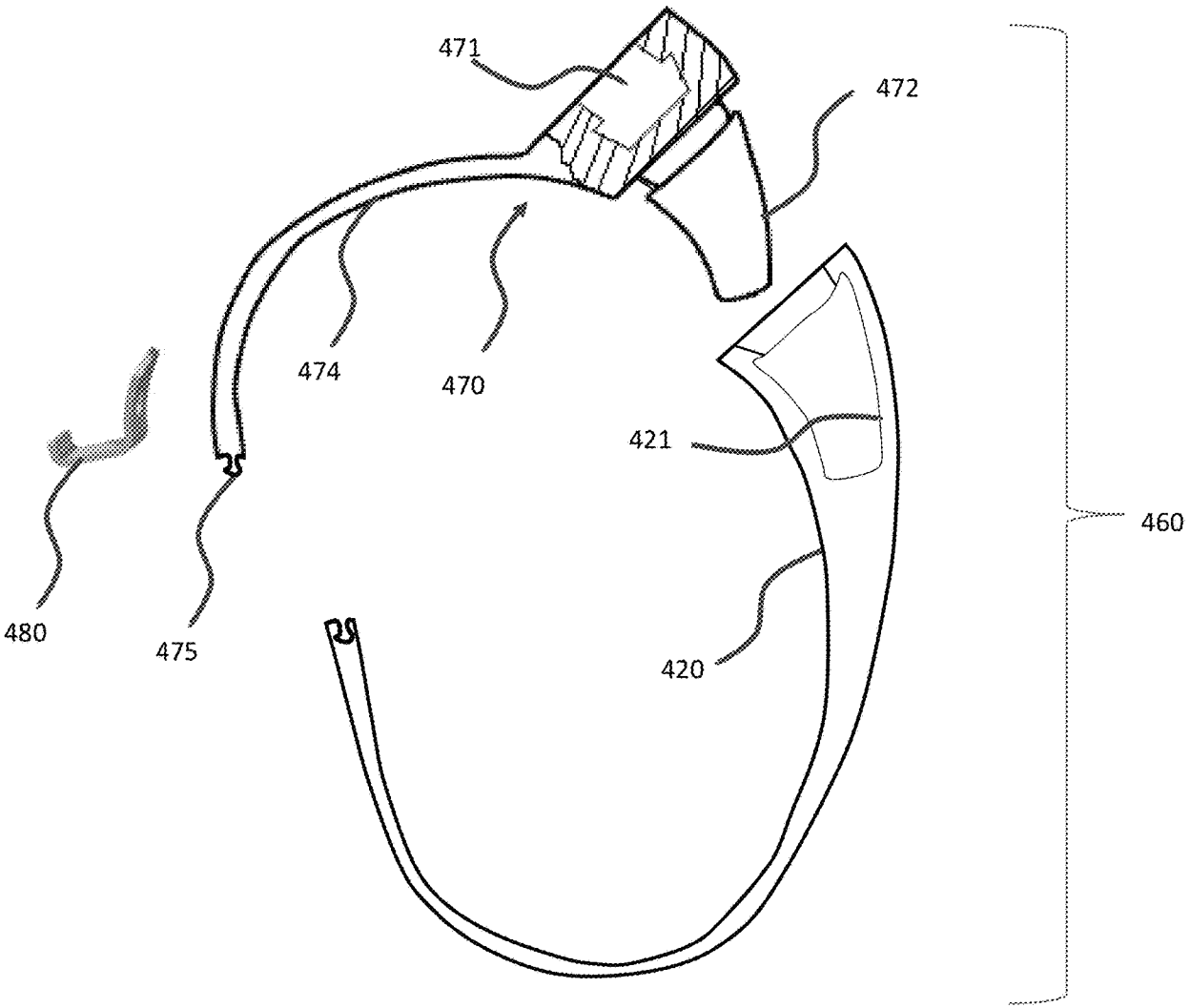
Figure 20B:
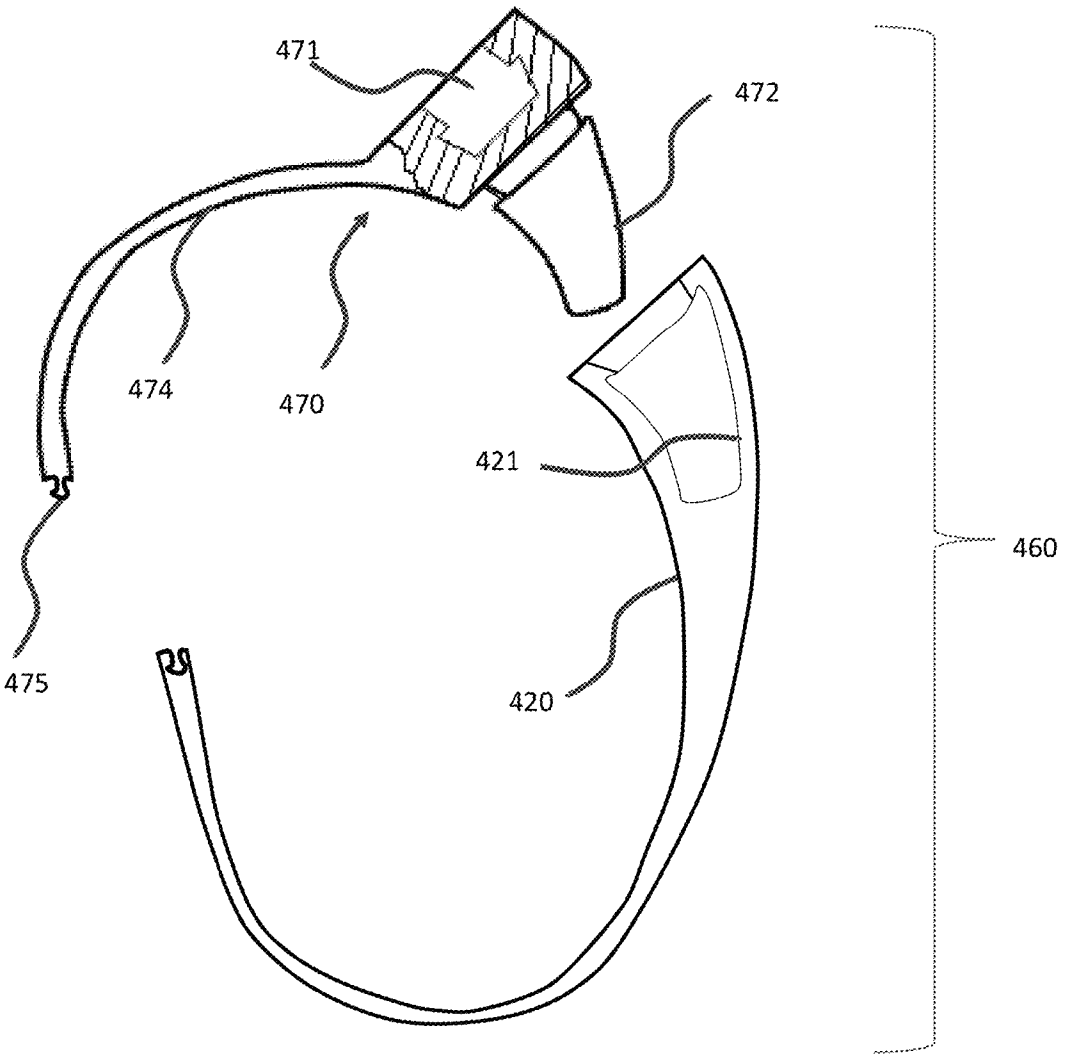

Still with reference to FIG. 19, it can be seen that there is a female portion of the bottom body 420 that receives a male portion of the chassis 470, male portion 472. In this regard, it is noted that in some embodiments, the hook tip 420 is molded around the already formed chassis 470. In this regard, in some embodiments, the retention loop apparatus 460 is three integral but non-monolithic components. FIG. 20A depicts an exploded view of the retention loop apparatus 460 depicting the 3 components, the chassis 470, the male connector 480, and the bottom body 420, and FIG. 20B depicts an exploded view of the retention loop apparatus 460 that does not include the male connector 480. Still with reference to FIGS. 20A and 20B, the retention loop chassis 470 includes a male portion 475 at the end of the spine 474 opposite the crown (the portion that establishes the female portion 471). This portion is utilized to connect one end of the bottom body 420 to the retention loop chassis 470, as will be described in greater detail below. These FIGS. show a partial cross-section of the chassis 470, and a full cross-section of the bottom loop 420 (cross-hatching omitted in FIGS. 20A and 20B).

Figure 21:
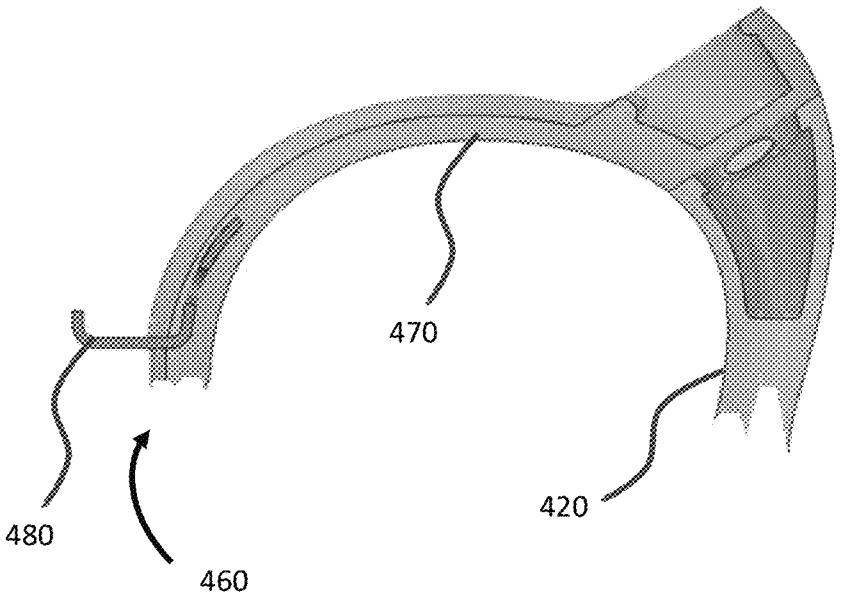

FIG. 21 depicts a transparent/semitransparent version of the retention loop apparatus 460, with the three components connected to each other to form the integral (but not monolithic) apparatus. The bottom portion of the bottom body and the distal tip of the chassis have are not shown.

Figure 22:
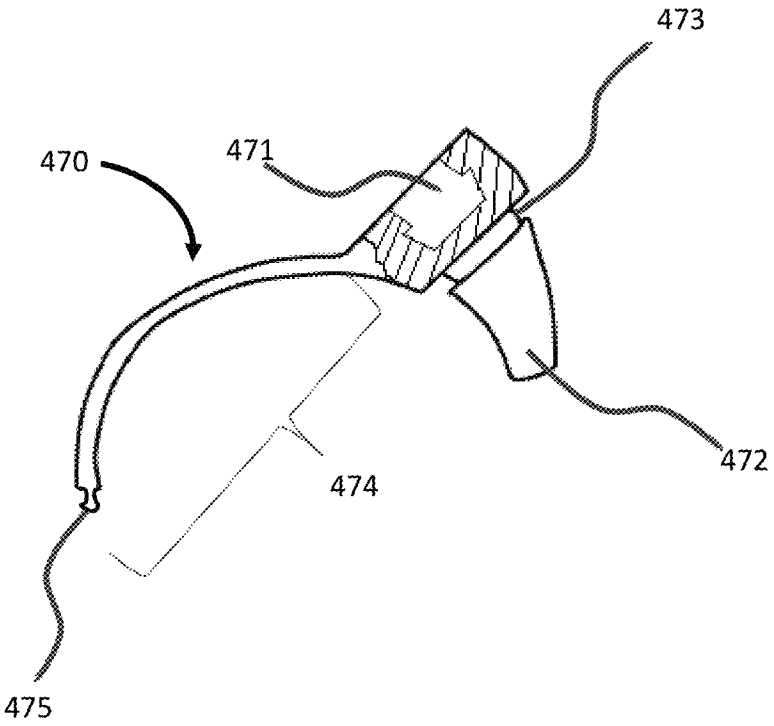

FIG. 22 depicts the retention loop chassis 470 in isolation, with a partial cutout view depicting the female portion 471. As can be seen, female portion 471 includes a section with a relatively constant diameter and then a section with a varying diameter the tapers from a wide diameter to a narrower diameter, that wide diameter again wider than the constant diameter of the beginning portion of the female portion. The wider diameter accommodates the corresponding wider diameter portion of the male component of the BTE electronics module 430 to achieve the apprehension snap coupling between the two components. Also as can be seen, the spine 474 of the retention loop chassis 470 extends from the sub-body that establishes the female portion 471 to a bottom tip. In an exemplary embodiment, the spine is flexible, thus permitting the spine, and thus the portions connected to the spine, to flex about the male connector 480 when the male connector is connected to the BTE device operational assembly (and when the top of the chassis is not connected to the male connector of the BTE electronics module).

In view of the above, it can be understood that in at least some exemplary embodiments, there is a retention loop apparatus, such as retention loop apparatus 460, wherein the retention loop apparatus is configured to attach to a body of a BTE electronics module away from the base thereof. By way of example only and not by way of limitation, the attachment to the body of the BTE electronics module is achieved via reception of the male component of the BTE electronics module 430 into the female component 471 of the retention loop chassis 470. It is to be understood that with respect to the embodiments with the male connector 480, this is delta to the connection established by of the male connector 480 at the base/proximate the base of the BTE electronics module 430, while with respect to embodiments without the male connector 480, this can be the only attachment (in some embodiments—as will be detailed below, some other embodiments utilize a female connector). Also in view of the above, it can be seen that the retention loop chassis 470 is configured to receive the male portion of the body of the BTE electronics module, and thereby facilitate an attachment to the body of the BTE electronics module.

As can be seen, the retention loop chassis includes a first male portion 471 that includes two portions, a first portion having a first, constant diameter (or at least relatively constant diameter), and a second portion having a varying diameter that tapers from the first portions of the second portion with reducing diameter from the first portion to the tip of the second portion.

Figure 23:
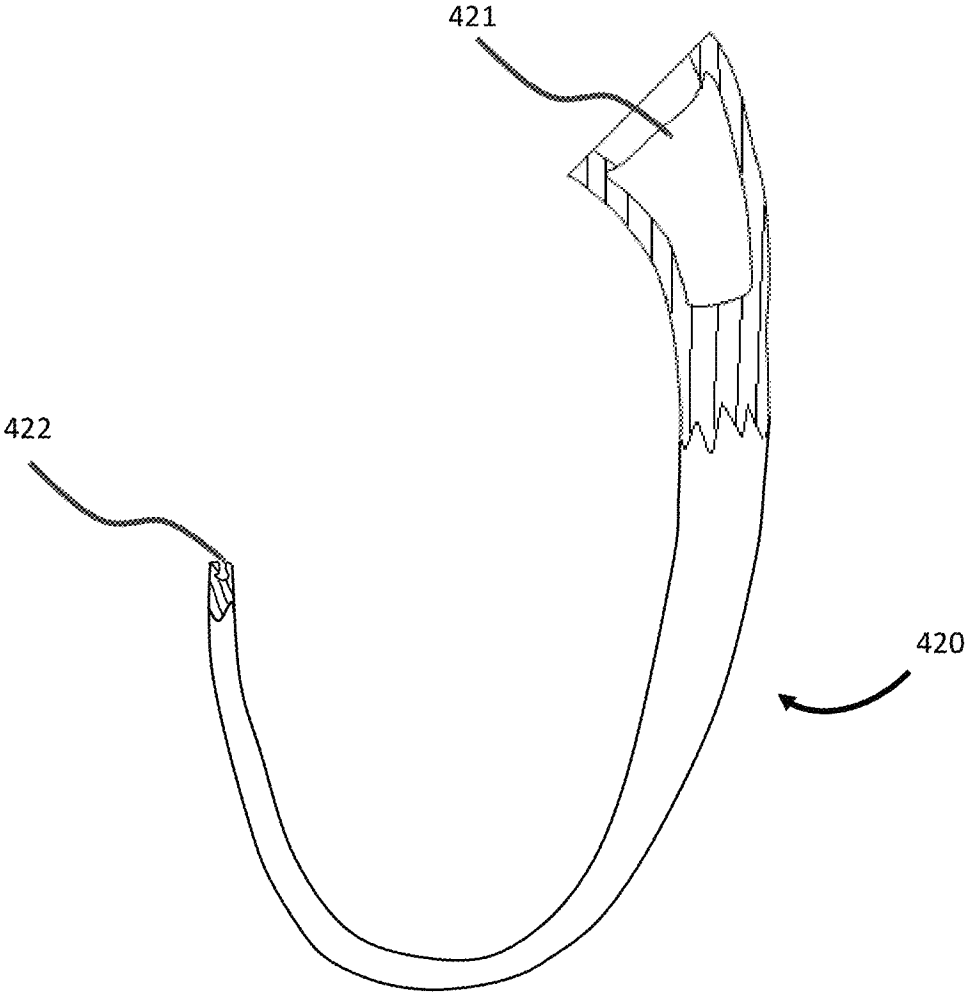

In an exemplary embodiment, these two portions interface with corresponding sections of the bottom body 420, presented in FIG. 23 in isolation from the other components of the retention loop apparatus 460, which includes a female portion 421 as can be seen, and female portion 422 as can be seen, which receives male portion 475. In an exemplary embodiment, the bottom body 420 is molded about the male portion 472 of the retention loop chassis 470 and about the male portion 475, simultaneously in some embodiments. In this regard, in an exemplary embodiment, the entire outer periphery of the male components 472 and 475 are subsumed by the bottom body 420 after the molding. That said, in an alternative embodiment, the bottom body 420 is formed separately from the retention loop chassis 470 and snap coupled thereto (to the male components, which both have lower diameter portions relative to the more distal ends thereof, to establish the snap coupling). In an exemplary embodiment, the snap coupling renders the bottom body 420 removal from the chassis 470, while in other embodiments, the snap coupling renders that bottom body 420 unremovable from the chassis 470 (meaning that it must be plastically deformed or otherwise broken to be removed). It is noted that in at least some exemplary embodiments where the bottom body 420 is molded about the retention loop chassis 470, the bottom body 420 can be removed only by plastically deforming the bottom body 420 or otherwise breaking the bottom body 420. Alternatively, the bottom body 420 can be removed only by plastically deforming the retention loop chassis 470 or otherwise breaking the retention loop chassis 470. Alternatively, the bottom body 420 can be removed only by plastically deforming one or both of the retention loop chassis 470 or the bottom body 420 or otherwise by breaking one or both of the retention loop chassis 470 or the bottom body 420.

Figure 24:
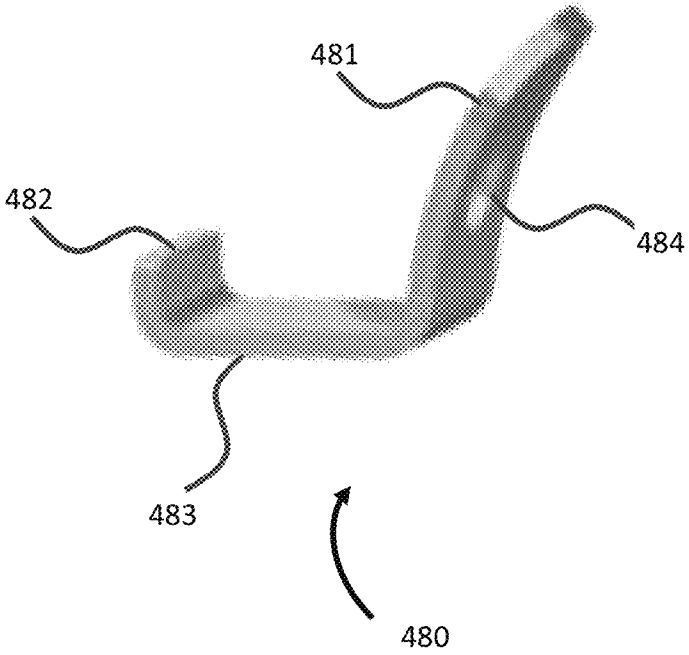
Figure 25:
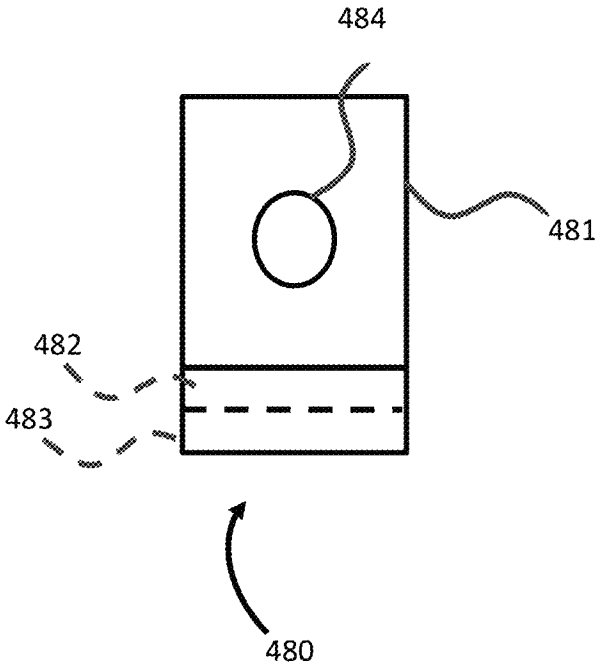

FIG. 24 presents an isometric view of the male connector 480 in isolation from the other components of retention loop apparatus 460, and FIG. 25 presents a front view of the connector 480 (looking towards the face of the person when the BTE device is worn on the person). In an exemplary embodiment, the male connector 480 is a monolithic metal component stamped from a flat tiny plate of stock metal (stainless steel, titanium, aluminum, etc.) The male connector includes three portions. There is a first proximal portion 481 that is, at least in some embodiments, entirely embedded within the retention loop chassis 470. This first proximal portion 481 has a major direction of extension in the vertical direction, and a minor direction of extension in the horizontal direction, and is curved to generally follow the contours of the spine 474 of the retention loop chassis 470. There is also a second portion 483 that extends horizontally away from the first portion, where in some embodiments, only a portion thereof is embedded in the retention loop chassis 470 (while in other embodiments, no portion is embedded in the retention loop chassis 470). The second portion 483 supports the third portion 482, which extends vertically away from the second portion. This third portion 482 establishes the hook of the male connector 480. As can be seen, there is a hole 484 that extends completely through the first portion 481. In an exemplary embodiment, this provides a path for the pertinent portion of the retention loop chassis 4702 extend their through so as to better secure the male connector 480 to the retention loop chassis 470 relative to that which would be the case in the absence of this hole 484. In this regard, in an exemplary embodiment, the male connector 480 is manufactured or otherwise formed separately from the ear chassis 470.

The formed connector 480 is placed into a mold into which, for example, material (e.g., plastic, PTFE, etc.) is injected (e.g., injection molded) to form the retention loop chassis 470. The retention loop chassis 470 is thus molded about the male connector 480, thereby securing the male connector 480 to the retention loop chassis 470. In an exemplary embodiment, the formed connector 480 is insert molded to the chassis. A portion of the male connector 480, at least the first portion 481, is embedded in the retention loop chassis 470. In an exemplary embodiment, the male connector 480 is embedded or otherwise attached to the retention loop chassis 470 such that the male connector 480 cannot be removed from the retention loop chassis 470 without plastically deforming or otherwise breaking the retention loop chassis 470. In an exemplary embodiment, the chassis 470 is made of TR90 $1^{st}$ shot.

In at least some exemplary embodiments, the bottom body 420 and/or the retention loop chassis 470 is made from extruded material, such as by way of example only and not by way of limitation, tubular silicone rubber. That said, in some alternate embodiments, the bottom body 420 and/or the retention loop chassis 470 is made from other types of material that are non-extruded and/or not tubular silicone rubber. By way of example only and not by way of limitation, in an exemplary embodiment, the bottom body 420 and/or the retention loop chassis 470 is made from liquid silicone rubber that is injection molded. In an exemplary embodiment, such can enable a greater range of geometries relative to that which is the case utilizing tubular silicone rubber/extruded rubber. Note also that in at least some exemplary embodiments, the utilization of liquid silicone rubber is utilized so as to be overmolded onto a hard plastic spine or skeleton. In this regard, in an exemplary embodiment, the retention loop chassis 470 and or the bottom body 420 is a liquid silicon rubber that is overmolded onto a hard plastic skeleton.

In view of the above, it is to be understood that in an exemplary embodiment, there is a retention loop apparatus, such as retention loop apparatus 460 detailed above, wherein the male connector is a metal component establishing a concave hook relative to a BTE electronics module (spine) facing side of the ear hook assembly, the chassis 470 is a synthetic based component, and the chassis is molded about a portion of the male connector. Also in view of the above, the bottom body 420 is a separate component from the chassis 470 and is locked onto the chassis 470 (e.g., by injection molding bottom body 420 about the male portions 472 and 473, wherein the male portions 472 and 473 are sized and dimensioned such that with respect to the material that is utilized to make those portions and with respect to the material that is utilized to make the bottom body 420 and the final material properties thereof, the bottom body 420 and/or the retention loop chassis 470 must be plastically deformed or otherwise broken to remove the components from each other.

It is noted that while the embodiments detailed above have focused on the male connector being attached to the retention loop chassis 470, in an alternate embodiment, the male connector can be attached to the bottom body 420. In an exemplary embodiment, such an exemplary embodiment, the spine 474 is not as long as the embodiments depicted in the figures. Conversely, the back portion of the bottom body 420 is longer than that depicted in the figures. Because in at least some exemplary embodiments, the relative position of the male connector relative to the BTE electronics module 430 should be the same, the male connector is thus partially embedded in the bottom body 420. In this regard, the bottom body 420 can be molded about the male connector 480 in a manner the same as or otherwise similar to or otherwise analogous to that detailed herein with respect to molding the retention loop chassis about the portion of the connector 480. It is also noted that while the embodiments depicted above have presented two components that are utilized to form the loop portion that extends about the pinna, in some embodiments, three or more portions are utilized to establish the loop. That said, in some alternate embodiments, the loop is established by a monolithic component. That is, for example, the retention loop chassis 470 and the bottom body 420 are part of a monolithic component. Any arrangement that can enable the teachings detailed herein can be utilized in at least some exemplary embodiments.

As noted above, in an exemplary embodiment, retention loop apparatus is configured so as to attach to one or more components of the BTE device at and/or below a base of a BTE electronics module of the BTE device, and the retention loop apparatus is further configured to attach to a body of the BTE electronics module away from the base. Accordingly, the retention loop apparatus is configured for dual connection to an operational assembly of the BTE device, but can also be configured for single connection, such as with embodiments without the male connector 480. The embodiment detailed above has the second attachment away from the base at the apex. However, in some alternate embodiments, the second attachment can be at other locations, such as a location midway between the base and the apex of the BTE electronics module. In this regard, by way of example only and not by way of limitation, in an exemplary embodiment, the retention loop chassis 470 can include a male portion that protrudes away from the spine 474 of the chassis 470 into the body of the BTE electronics module 430. This male portion could snap fit into the body of the BTE electronics module 430. Alternatively, the chassis 470 can include a female portion that surrounds the entire central body (or upper body) of the retention loop chassis 470. Any arrangement of connecting the retention loop chassis 4702 the BTE electronics module 430 can be utilized in at least some exemplary embodiments.

It is noted that the male connector is stronger than the retention loop chassis. In an exemplary embodiment, the male connector 480 has a yield strength of at least 5, 6, 7, 8, 9, 10, 11, 12, 13, 14, 15, 16, 17, 18, 19, 20, 25, 30, 35, 40, 45, 50, 55, 60, 70, 80, 90, 100, 125, 150, 175, 200, 200, 250, 300, 350, 400, 500, 600, 700, 800, 900, or 1000 times or more than that of the retention loop chassis 470. Still further, in an exemplary embodiment, the material of the chassis 470 is much more flexible/the chassis is sized and dimensioned and manufactured to readily flex relative to the male connector 480.

Still further, in view of the above, it is to be understood that in some exemplary embodiments, the retention loop chassis 470 includes a female receptacle 471 configured to receive a male portion 431 of the BTE electronics module 430 so as to attach the chassis 470 to the BTE electronics module at the apex thereof, and the male connector is configured to lock the chassis to the BTE electronics module 430 and/or to the battery 452.

In view of the above, it can also be seen that the retention loop chassis is a separate component from the bottom body and the male connector, and the male connector is a separate component from the bottom body. Again, as noted above, in an exemplary embodiment, the bottom body and the chassis can be a monolithic component. That is, they can be formed from one and the same body. Note also that in at least some exemplary embodiments, it is possible that the male connector 480 can be a monolithic component with the retention loop chassis 470. It is noted that in some exemplary embodiments, the portion can still be reinforced, such as by utilizing a mesh that extends from the spine of the retention loop chassis 470 into the component that extends into the BTE device operational assembly. In an exemplary embodiment, a sufficiently strong material can be utilized to make the retention loop chassis. That said, in some embodiments, it may not necessarily be required that the retention loop apparatus 460 have the aforementioned childproof features above. Indeed, in some exemplary embodiments, there can be utilitarian value with respect to utilizing the retention loop apparatus 460 with an adult, and thus reaping the benefits of some additional attachment beyond the attachment at the apex of the BTE electronics device 430.

It is noted that all of the embodiments herein with respect to the retention loop apparatus have a loop portion that is configured to enable a pinna of a recipient to be inserted there through, which inner perimeter of the loop portion is non-circular when the loop portion is in a relaxed state, and in at least some exemplary embodiments, the inner perimeter of the loop portion is nonsymmetrical when the loop portion is in a relaxed state. This as opposed to, for example, a circle, which is circular, or, with respect to non-symmetrical, an equidistant oval, which is symmetrical. By relaxed state, it is meant that nothing other than the force of gravity is acting on the retention loop apparatus 460. It is also noted that in at least some exemplary embodiments, these features are also the case with respect to the retention loop apparatus when the retention loop apparatus is attached to the BTE electronics module and/or the BTE battery, or any other component of the BTE device operational assembly. In view of the above, it can be seen that in an exemplary embodiment, there is a device comprising a behind-the-ear (BTE) device ear interface fixture, such as the retention loop apparatus 460 (as this interfaces with the ear), the fixture including a loop portion configured to enable a pinna of a recipient to be inserted there through and an attachment portion configured to removably attach the fixture to a BTE electronics module or a BTE battery, wherein the inner perimeter of the loop portion is non-circular when the loop portion is in a relaxed state, and in some embodiments, non-symmetrical when the loop portion is in a relaxed state.

In some exemplary embodiments, the inner circumference of the loop portion, in a relaxed state, is oblong.

In an exemplary embodiment, the ear interface fixture is a completely integrated fixture. That is, all portions of the ear interface fixture (e.g., the retention loop apparatus 460) are held together by themselves in or otherwise not removable from each other, at least not without plastically deforming or otherwise breaking one or more components.

In an exemplary embodiment, the aforementioned attachment portion is a male portion (e.g., male connector 480) configured to extend into one or more of the BTE electronics module, the BTE battery, or the assembly established by the BTE electronics module and the BTE battery. In an exemplary embodiment, the ear interface fixture includes a second attachment portion, the second attachment portion including a female receptacle (e.g., receptacle 471) configured to receive a male portion (e.g., male portion 431) of the BTE electronics module 430. That said, in at least some exemplary embodiments, this female portion can be configured to receive another male portion of another component of the BTE device operational assembly 441. By way of example only and not by way of limitation, an adapter can be located on the male component 431 of the BTE electronics module 430, which adapter can be received into the female component.

That said, while the embodiments detailed above have focused on the BTE electronics module having a male portion that is received into the female component of the retention loop apparatus 460, some alternate embodiments can have a female portion of the BTE electronics module that receives a male portion of the retention loop chassis 470 or otherwise of the retention loop apparatus 460. Indeed, while the interface between the retention loop chassis 470 and the bottom body 420 has been described in terms of the latter having all female components and the former having all-male components, in some alternate embodiments, the opposite can be the case. Indeed, in some embodiments, any disclosure herein of a male component can correspond to a female component and the opposite mating component can correspond to the other component.

As noted above, in some exemplary embodiments, the retention loop apparatus 460 is a three-part apparatus. In this regard, there are no extra parts other than those three parts. Accordingly, in an exemplary embodiment, the aforementioned ear interface fixture includes only a main body (e.g., retention loop chassis 470), a sub-loop body (e.g., bottom body 420) and a male body (e.g., male connector 480). As noted above, in some exemplary embodiments, the retention loop apparatus 460 is a two-part apparatus. In this regard, there are no extra parts other than those two parts. Accordingly, in an exemplary embodiment, the aforementioned ear interface fixture includes only a main body (e.g., retention loop chassis 470) and a sub-loop body (e.g., bottom body 420). In some embodiments, the loop portion is established by structure only made up of the main body and a sub-loop body, the sub-loop body establishing more than ⅔rds of the perimeter of the loop body. In some embodiments, the loop portion is established by structure only made up of the main body and a sub-loop body. In some embodiments, the sub-loop body establishes more than H percent of the perimeter of the loop body, where H is 10, 15, 20, 25, 30, 35, 40, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, or 95. In some embodiments, the sub-loop body establishes less than H percent of the perimeter of the loop body, or establishes H percent, or establishes any value or range of value between 10 to 95 percent in 0.1% increments (e.g., 33%, 44.1%, 24.7% to 74.2%, etc.).

In view of the manufacturing methods detailed above, it is to be understood that in an exemplary embodiment, the ear interface fixture includes a main body, sub-loop body, and a male body, wherein the sub-loop body is molded about the main body to establish the loop portion.

In an exemplary embodiment, the inner perimeter distance of the loop body is fixed and not adjustable. By "inner perimeter distance," it is meant the distance that must be traveled to travel about the entire perimeter on the inside thereof. In this regard, it is noted that in at least some exemplary embodiments, at least some portions of the loop are flexible (e.g., the bottom body 420 can be an elastic component). Accordingly, the shape of the loop can be deformed by the application of a force. Thus, the shape of the loop can go from an oval shape to a circular shape. However, the inner perimeter distance will not change even though the shape has changed (as opposed to the radius or local radii, or the diameter at various locations, etc.). That said, in some exemplary embodiments, the loop can be configured/the components that form the loop can be configured such that the inner perimeter distance does change, such as changing elastically, such as by way of stretching, and then returns to its inner perimeter. Indeed, such is not mutually exclusive from the features just detailed. That is, the inner perimeter distance can remain constant, not change when the overall shape of the loop is changed in a manner other than stretching (e.g., pushing on the top and the bottom of the loop could change the overall shape of the loop but not the inner perimeter) while stretching (i.e., by pulling on two separate portions of the loop in a direction opposite from one another, and thus the inner perimeter distance changing). It all depends on the force applied to the loop. In this regard, the aforementioned dimensionally stable inner perimeters are results of deformations to the loop other than stretching deformations.

In an exemplary embodiment, as noted above, there is a behind-the-ear (BTE) device, comprising a BTE electronics module (e.g., component 430), and an ear interface, such as retention loop apparatus 460. In this exemplary embodiment, the ear interface includes a portion configured to extend completely about a pinna when the BTE device is worn behind the ear, and the ear interface is an integral component. That is, all portions of the ear interface fixture (e.g., the retention loop apparatus 460) are held together by themselves in or otherwise not removable from each other, at least not without plastically deforming or otherwise breaking one or more components. That said, as noted above, in some embodiments, the ear interface fixture is not an integrated/integral component. In some exemplary embodiments of this embodiment, the BTE device is such that the ear interface includes a main body, sub-loop body, and a male body, wherein the sub-loop body is molded about the main body, and the main body is molded about a portion of the male body. In some embodiments, there is a main portion and a sub-loop portion that are monolithic. Also, in some exemplary embodiments, such as where the outer contours of the retention loop apparatus is smoothly blended with respect to one another with respect to location about the loop, there is no discernible demarcation between the main portion and sub-loop portion. In some exemplary embodiments, the entire loop is established by a monolithic component (which could include a male connector that is not monolithic with the loop structure) but, for example, attached according to the teachings detailed herein or variations thereof, to the loop structure).

Figure 26:
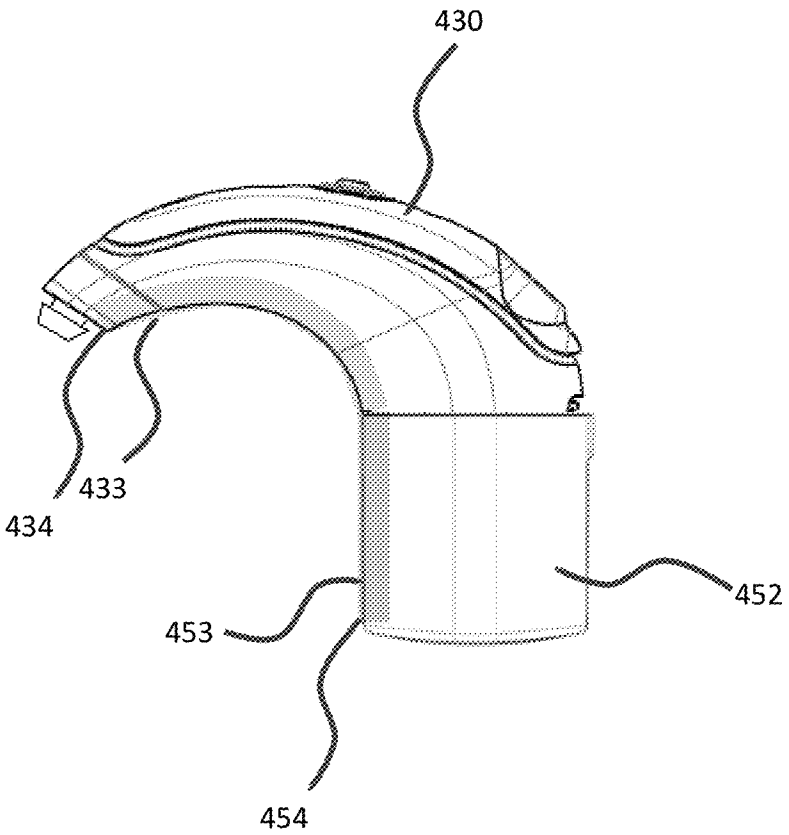
FIGS. 26-29H present additional details of the ear interface.

With respect to embodiments of the BTE device that have the battery attached to the BTE electronics module, in an exemplary embodiment, where a power component attached to the BTE electronics module, the BTE electronics module can include an arcuate surface between a power component interfacing end of the BTE electronics module and a tip of the BTE electronics module opposite the power component interfacing end, the arcuate surface configured to extend over a top of a pinna of a human. The arcuate surface is presented by highlighted area 433 in FIG. 26. As can be seen in FIG. 26, the power component (battery 452) includes a first surface that is parallel to and at least substantially flush with one of the arcuate surface or a surface located between the power component and the power component interfacing end of the BTE electronics module. This first surface is presented by the highlighted area 453 in FIG. 26. With respect to the latter possibility of a surface located between the power component and the BTE electronics module, such can exist in a scenario where there is an adapter between the power component and the BTE electronics module. Indeed, in an exemplary embodiment, the power component can be a remote component. In any event, in some exemplary embodiments of this exemplary embodiment, the ear interface extends parallel with the arcuate surface of the BTE electronics module and the first surface. That said, in some alternate embodiments, the ear interface can extend parallel with the arcuate surface but not the first surface, or vice versa. It is noted that in at least some exemplary embodiments, the ear interface extends parallel to the entire distance of the surface with respect to the arcuate surface and the first surface (with respect to the two dimensional plane of FIG. 26, the curve from the tip of the BTE electronics module to the bottom of the BTE battery—the retention loop apparatus does not extend all the way around the BTE device operational assembly, at least in some embodiments), while in some embodiments, the ear interface extends parallel to only a portion of the distance of the surface with respect to the arcuate surface and the first surface. In an exemplary embodiment, the ear interface extends parallel to less than, more than or equal to H percent of the arcuate distance of the BTE sound processor. In an exemplary embodiment, the ear interface extends parallel to less than, more than or equal to H percent of the linear distance of the BTE battery (where the H's do not have to be equal, but can be).

In an exemplary embodiment, again with respect to embodiments where there is a battery attached to the BTE electronics module, the battery-BTE electronics module assembly (the BTE device operational assembly) has a pinna facing side that extends behind a pinna and over a pinna when placed on an ear, from a bottom end of the battery to a top end of the BTE electronics module. Collectively, this is line 453 plus curve 433 and the associated surfaces. In an exemplary embodiment of this exemplary embodiment, the ear interface contiguously extends between the pinna and the pinna facing side from the bottom end of the battery to the top end of the BTE electronics module. That said, in some alternate embodiments, the ear interface does not so extend.

In an exemplary embodiment, with respect to the aforementioned pinna facing side that extends behind a pinna and over a pinna when placed on an ear, from a bottom end of the battery to a top end of the BTE electronics module, the ear interface prevents any part of the pinna and/or any part of the side of the recipient's head not including hair) from contacting the BTE device operational assembly in totality, or one or more components thereof, such as by way of example only and not by way of limitation, the BTE electronics module 430. That said, in an exemplary embodiment, the ear interface establishes a contiguous barrier between the skin of the recipient and the BTE device operational assembly in totality or one or more components thereof, with respect to a plane passing through the BTE device, such as by way of example only and not by way of limitation, the plane of FIG. 26 extending through the geometric center of the BTE device operational assembly. In an exemplary embodiment, when the BTE device is viewed from the front (the position that would be seen when looking at a recipient wearing the BTE device), the ear interface assembly is in between the viewer along the entire distance or at least a portion of the distance (less than, more than or equal to H) between the bottom tip of the BTE battery, and the opposite tip of the BTE electronics module 430.

Figure 27:
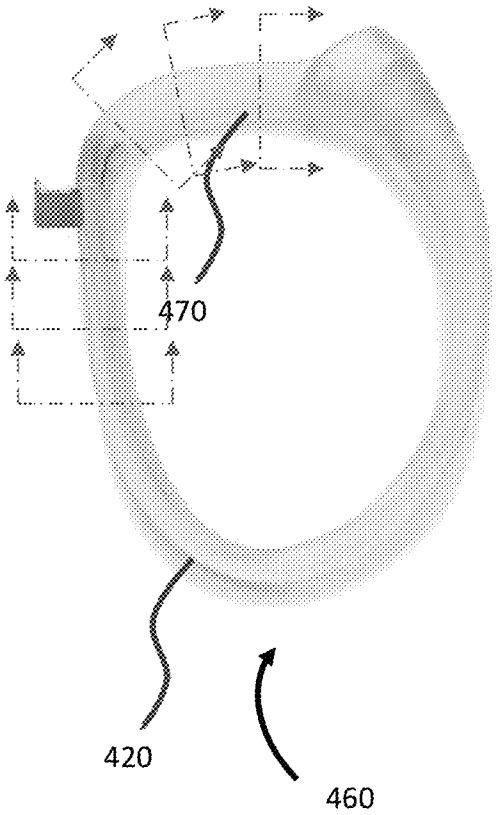
Figure 28:
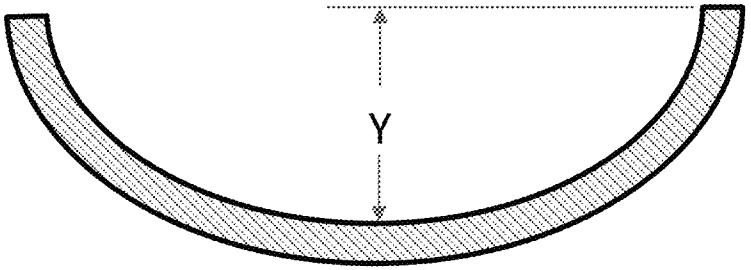
Figure 29A:
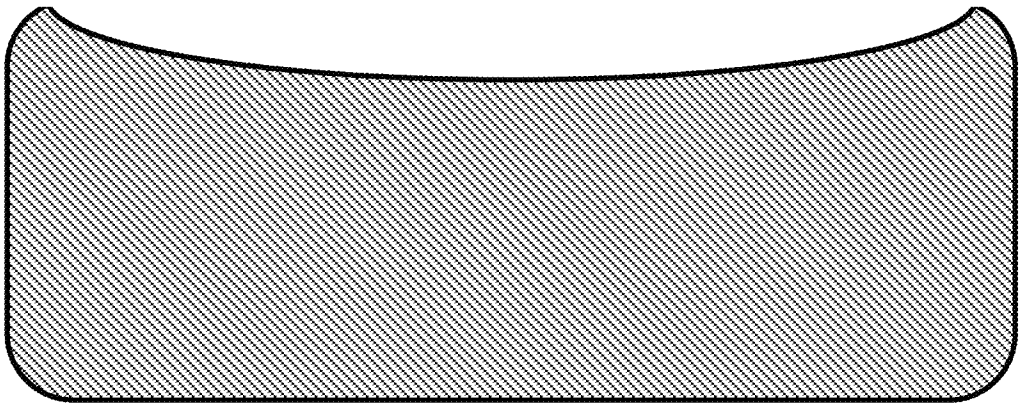

In an exemplary embodiment, the ear interface includes an open concave section that is concave relative to the BTE electronics module, which concave section interfaces with the BTE electronics module such that the BTE electronics module is located in the concave section. FIG. 27 depicts a series of cross-sections indicators through the retention loop apparatus 460 at various locations, and FIG. 28 depicts an exemplary conceptual cross-section that would correspond to that at those locations, clearly showing the concave section. Is noted that that is just an exemplary embodiment. Another exemplary embodiment can be seen in FIG. 29A, depicting a conceptual cross-section.

Figure 29B:
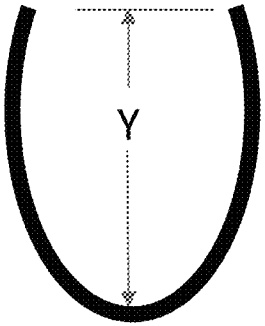
Figure 30:
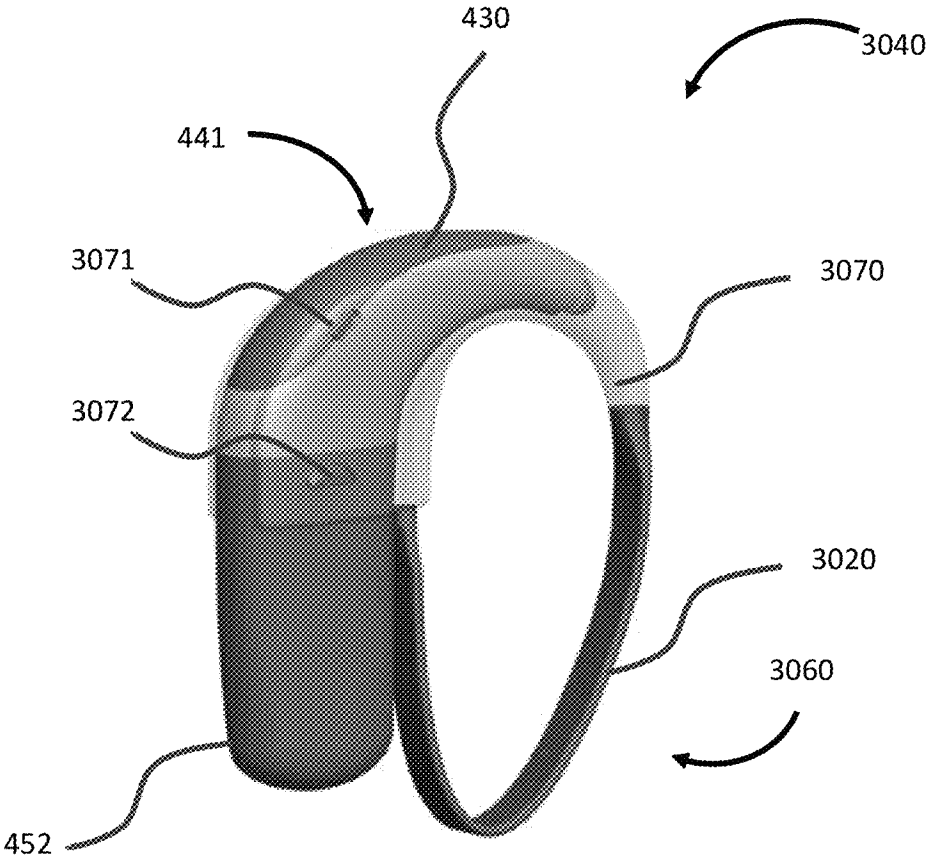
FIGS. 30-32 present some alternate exemplary embodiments.

FIGS. 29B and C depict additional cross-sections, which can correspond to the embodiment of FIG. 30.

FIG. 30 depicts an alternate embodiment of a BTE device 3040, that includes an alternate embodiment of a retention loop apparatus 3060. Here, the retention loop apparatus 3060 includes a retention loop chassis 3070 and a bottom body 3020. In this exemplary embodiment, the bottom body 3020 is more of a strap type device in the sense that it is more of a ribbon component for most of its distance along the loop. That is, the cross-section is such that the thickness of the loop is relatively constant and the width of the loop is relatively constant, and the width is about 2, 3, 4, 5, 6, 7 or 8 times or more the thickness, and a cross-section therethrough is rectangular in shape (with rounded edges in some embodiments). It is noted that this embodiment having the aforementioned ribbon cross-section can be utilized with the male connector method of attaching the BTE and vice versa. As will be detailed below, any feature of any embodiment detailed herein can be combined with any other feature of any other embodiment herein providing that the art enables such.

With respect to the chassis 3070, this chassis has an extended U-shaped cross-section (more on this below) such that it envelops a substantial portion of a lateral circumference, but not all, of the electronics module 430 and develops a substantial portion of a lateral circumference, but not all, of the battery 452. In an exemplary embodiment, the material of the retention loop chassis 3070 resiliently compresses about the BTE electronics module 430 and/or the battery 452 to hold the retention loop apparatus 3070 in place. In an exemplary embodiment, the material of the retention loop chassis snap couples about the electronics module and/or the battery 430. In an exemplary embodiment, the U-shaped and/or C-shaped cross-section of the retention loop chassis 3070 snap fits onto the BTE electronics component. In an exemplary embodiment, there are detent components, as can be seen in the figures (components 3071 and 3072) that are utilized to enable the retention loop chassis 3070 to be retained to the BTE device operational assembly 441 (such can be executed by a C-shaped cross-section, where the ends of the C extend about much of the operational assembly, so as to couple thereto—removal is by pulling the retention loop chassis away from the BTE device operational assembly so as to deform the C-shaped of the retention loop chassis outwards to provide clearance along the BTE device operational assembly so that such can be removed (the deformation is a result of the larger diameter portions of the operational assembly as it moves through the tips of the C). In some embodiments, it is the retention loop apparatus that includes the male portions of the detent, while in other embodiments, it is vice versa, while still in other embodiments, there are some male components one the retention loop apparatus and some male components on the BTE device operational assembly, and some female components one the BTE device operational assembly and some female components on the retention loop apparatus.

Figure 29C:
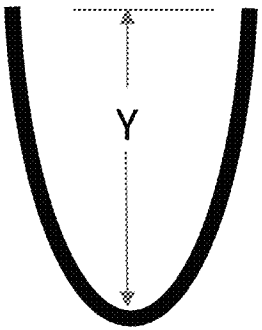

FIG. 29C depicts an exemplary cross-section of the spine of the ear hook chassis which can have utilitarian vale using, for example, detents noted above, and can also have utilitarian value without the detents noted above.

Figure 29D:
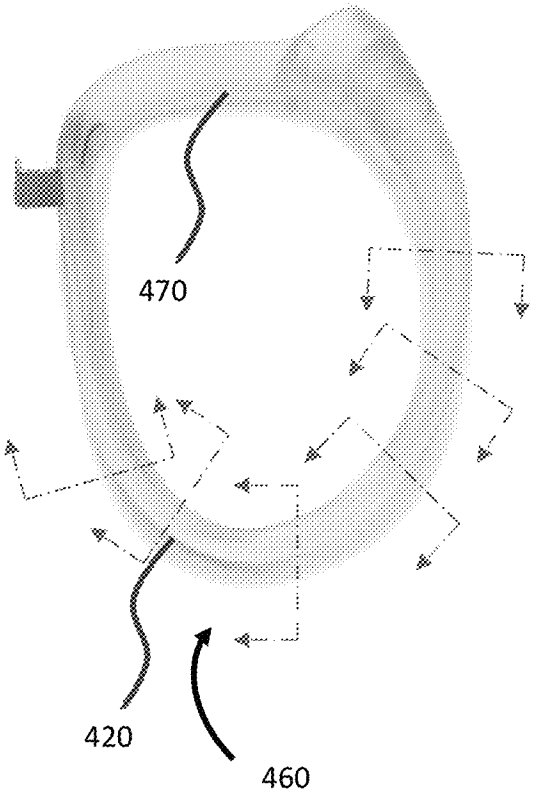
Figure 29E:
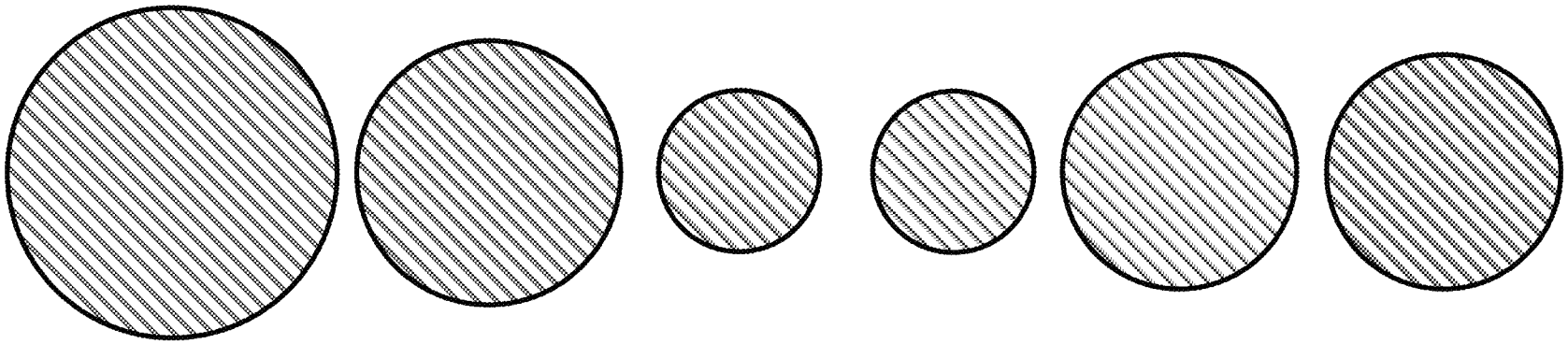
Figure 29F:
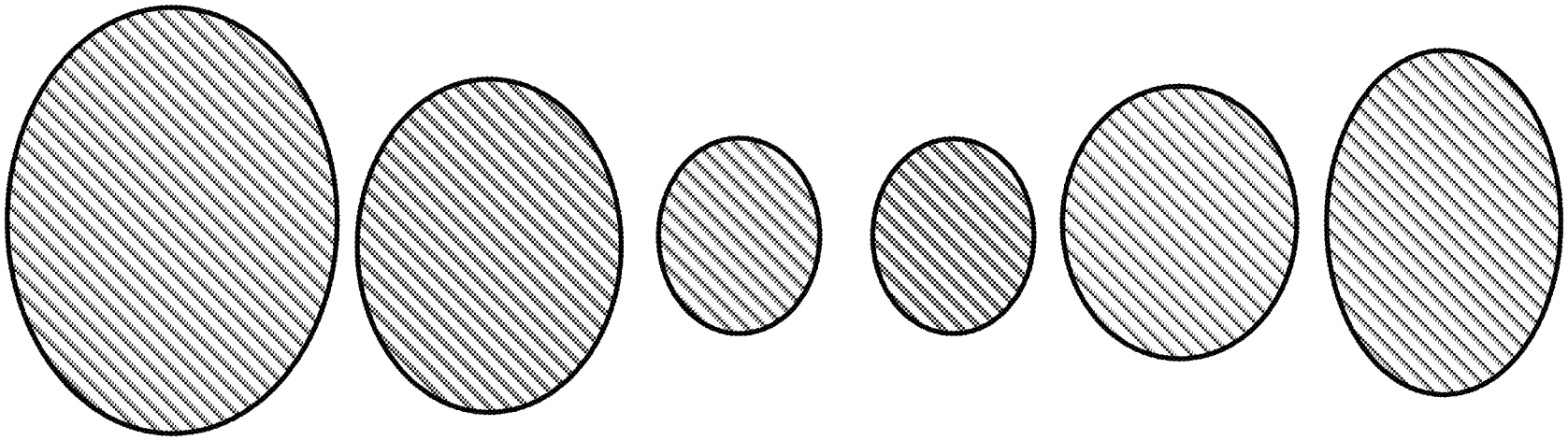
Figure 29G:
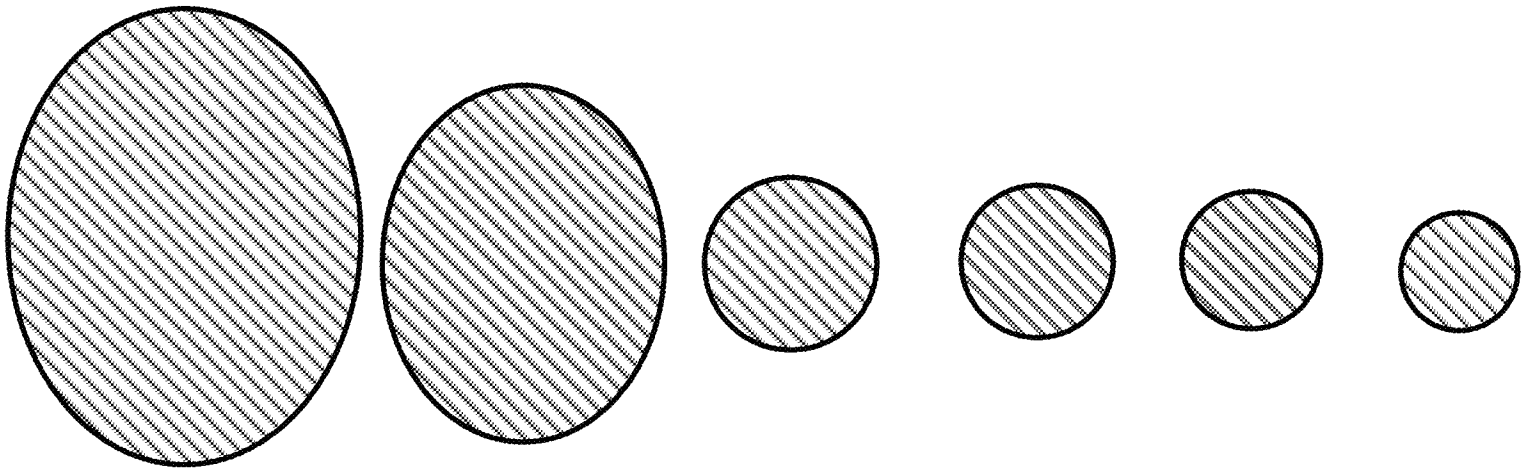
Figure 29H:
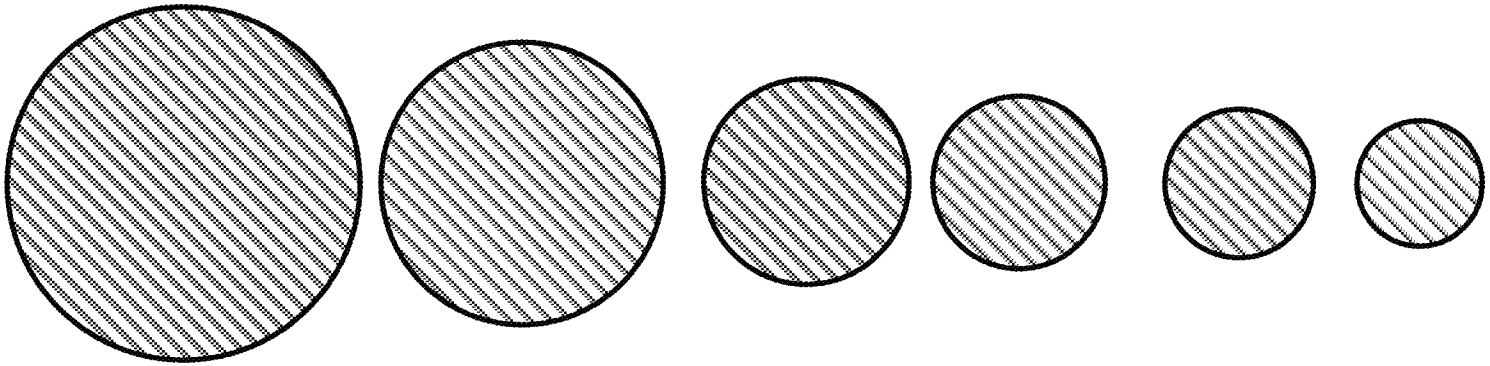

FIG. 29D depicts the retention loop apparatus 460 with different cross-section indicators from those detailed above. Here, the cross-section indicators extend through the bottom body 420. FIG. 29E depicts the various cross-sections, where the cross-sections from left to right correspond to the cross-sections FIG. 29D in a clockwise manner, starting at the top right cross-section. As can be seen, the bottom body 420 has a circular cross-section that varies with location there along. While the embodiment of FIG. 29E depicts circular cross-sections, it is noted that in some alternate embodiments, the cross-sections are oval shape, as seen in FIG. 29F. Also, while the embodiment of FIG. 29F depicts the ovals having the major axis in the vertical direction, in alternate embodiments, the ovals are rotated 90° so that the major axis is in the horizontal direction. While the embodiments of FIG. 29F depict the cross-section getting larger to smaller than larger again, and being all ovals, FIG. 29G depict the cross-section going from larger to smaller. Also, as can be seen, the cross-section transitions from oval shape circular shapes. FIG. 29H depicts circular cross-sections getting progressively smaller. It is noted that in an Lee some exemplary embodiments, other shapes can be utilized, such as for example, crescent-shaped cross-section, as well as nonsymmetrical shapes about a center plane of the BTE (e.g., such can have utilitarian value for either a left or right-handed version of the loop—an asymmetrical/nonsymmetrical shape oriented in one direction can have utility with respect to a right-handed version and one oriented in the opposite direction can have utility with respect to a left-handed version, etc.).

While the embodiments above have focused on a circular or an oval shaped cross-section, in some alternate embodiments, the cross-section can be square or non-square or rectangular shape sections, etc. Any cross-section that can be utilitarian value can be utilized in at least some exemplary embodiments.

In view the above, it can be understood that in at least some exemplary embodiments, the bottom body 420 includes and otherwise utilizes a body having a varying cross-section with location about the loop. That said, in some alternate embodiments, the bottom body 420 can have a uniform cross-section with respect to location about the loop.

It is noted that the embodiment of FIG. 30 is such that the retention loop apparatus 3040 is configured to be retained on to the BTE device operational assembly without completely extending about the lateral circumference of the battery and/or the BTE electronics component.

Figure 31A:
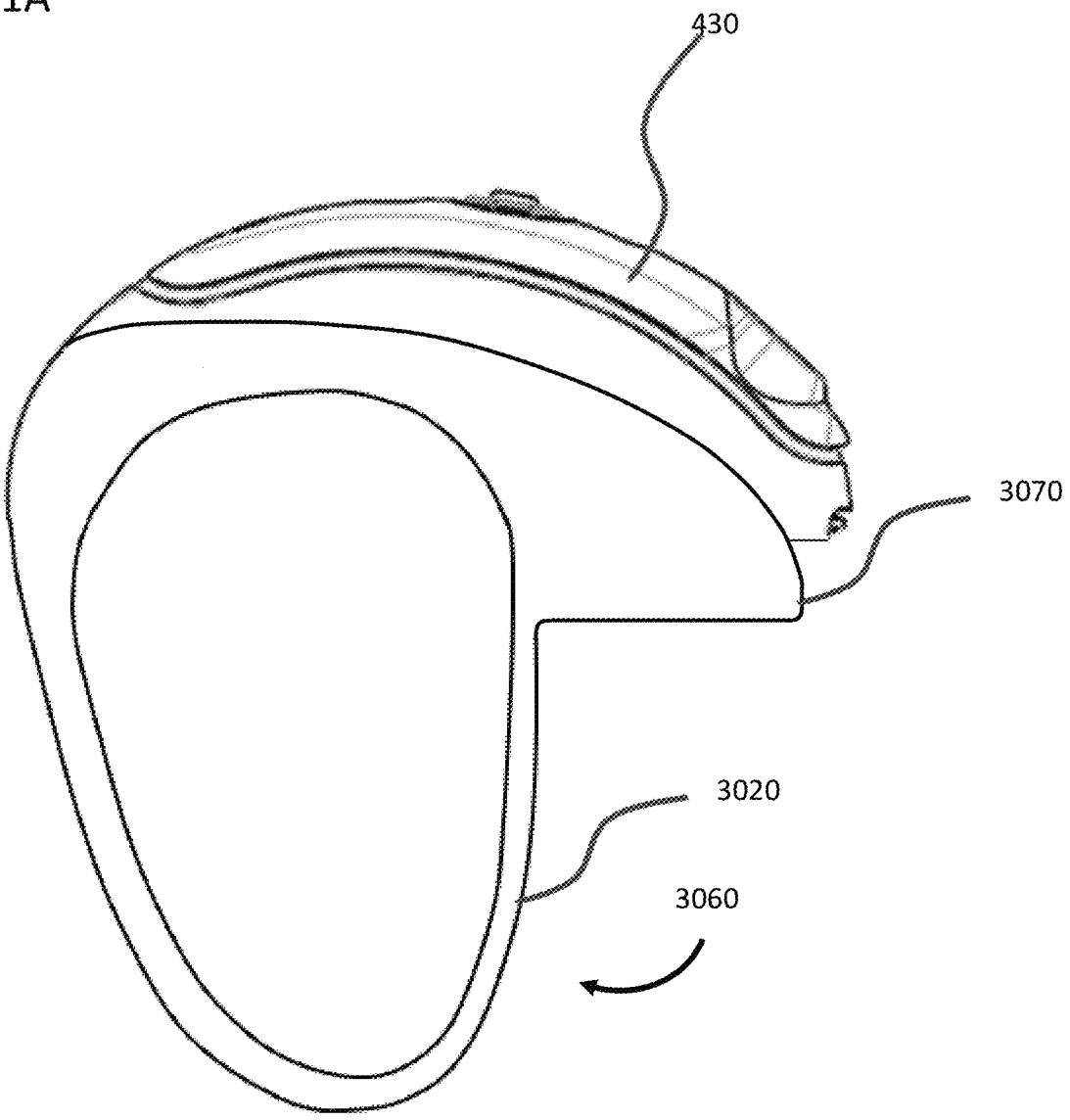
Figure 31B:
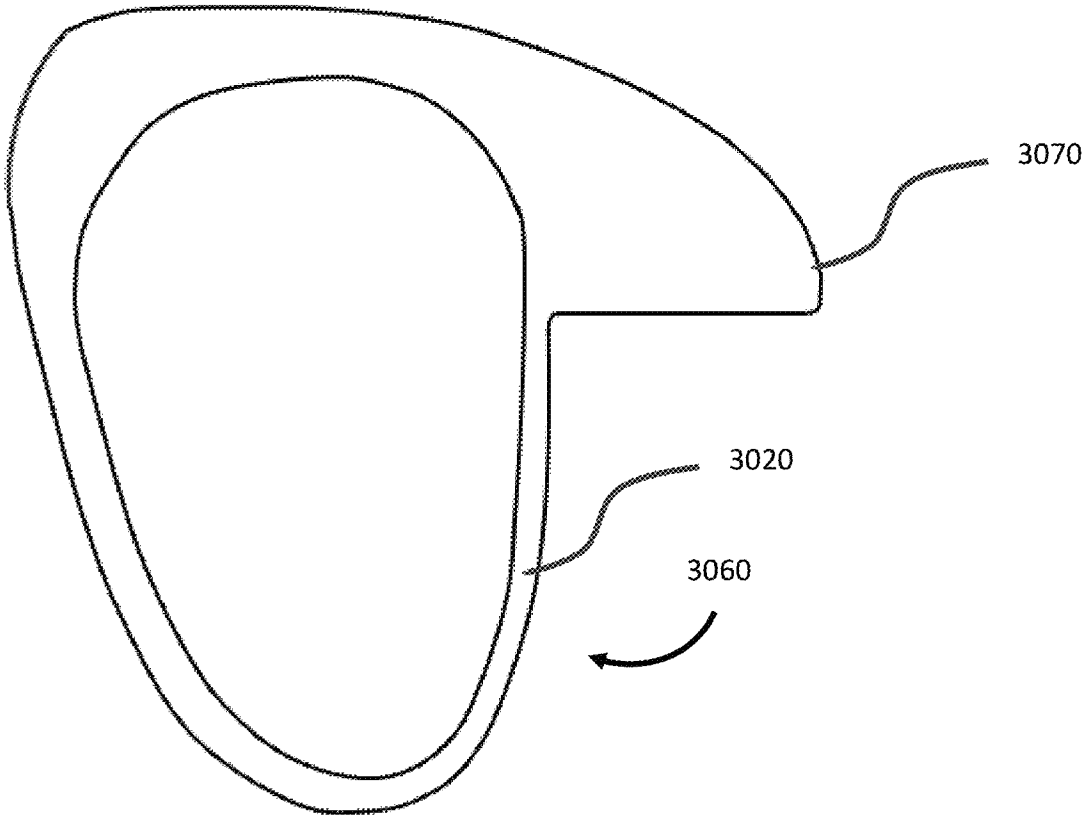

FIG. 31A depicts a side view of the retention loop chassis 3060 attached to the BTE electronics module 430 without the battery. FIG. 31B depicts a side view of the retention loop chassis 3060 without any of the BTE device operational assemblies.

Consistent with the teachings above, in an exemplary embodiment, again with respect to a power component attached to the BTE electronics module, the power component-BTE electronics module assembly has a pinna facing side (i.e., the side established by 433 and 453, the side seen when looking at the front/at the recipient's face), and the ear interface establishes a contiguous barrier between structure of the pinna facing side from a bottom end of the power component-BTE electronics module assembly to a top end of the power component—BTE electronics module assembly (in FIG. 26, from 454 to 434). Again, that said, in some alternate embodiments, the ear interface establishes a contiguous barrier between the structure of the pinna facing side from a location in between the bottom end and the top end. In an exemplary embodiment, this barrier extends less than more than or equal to H from the bottom and to the top end. Still further, again with respect to the embodiment where a battery is attached to the BTE electronics module, consistent with the teachings detailed above with respect to the male connector 480, the ear interface is attached to the BTE electronics module by two separate connections, one of which is established by a portion of the ear interface that extends into the battery-BTE electronics module assembly.

Still with respect to an embodiment where there is a battery attached to the BTE electronics module, the ear interface can be, in some embodiments, devoid of any component that completely extends about the battery. Further, in some embodiments, the ear interface is devoid of any component that completely extends about a main portion of the BTE electronics module (this can also be the case with respect to embodiments where there is no battery attached the BTE electronics module). By main portion of the BTE electronics module, this excludes, for example, the male component 431, which is not a main component.

Figure 33:
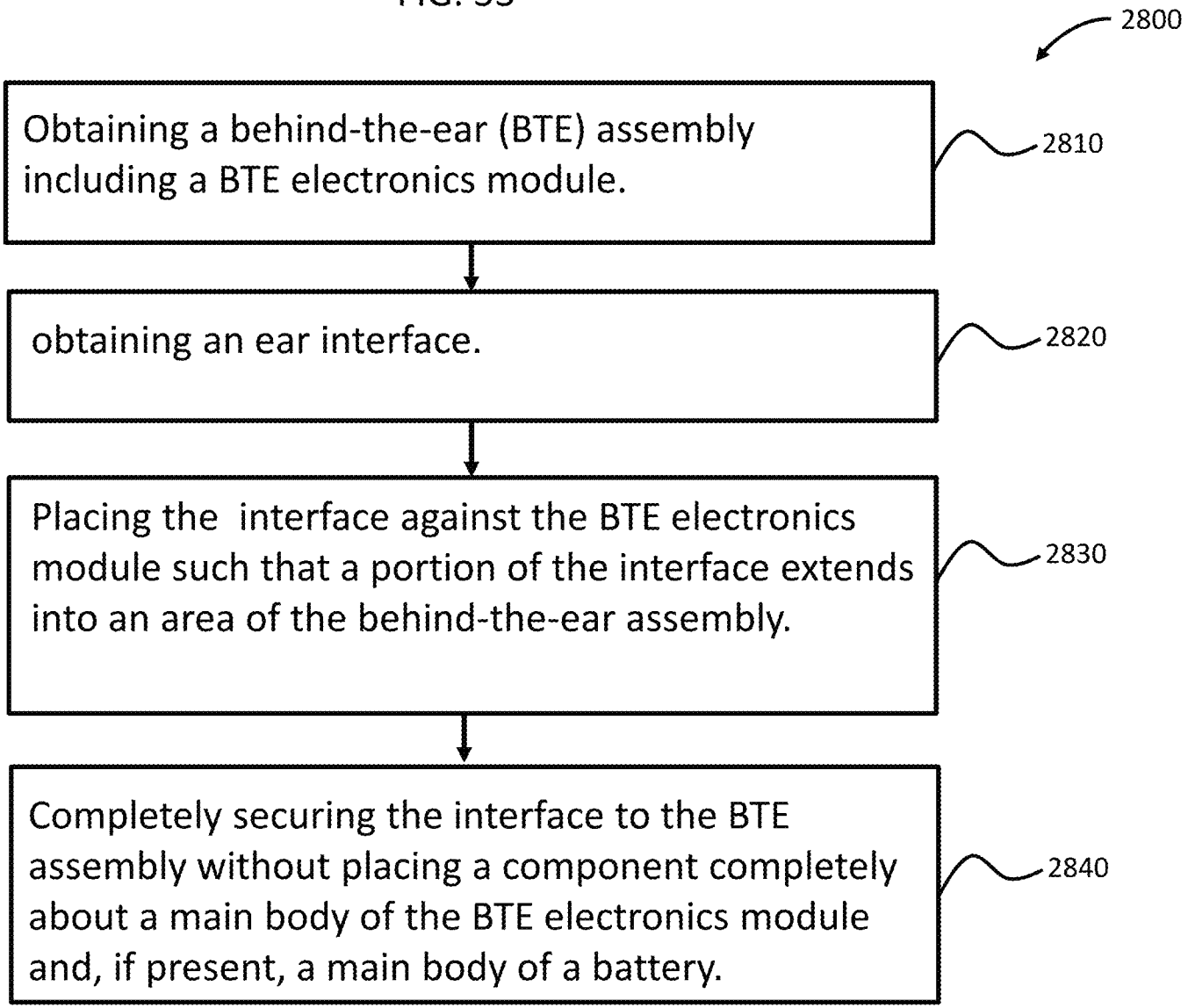
FIGS. 33-36 provide exemplary flowcharts for exemplar methods according to some embodiments.

It is noted that some exemplary embodiments also include methods. In this regard, FIG. 33 presents a flowchart for an exemplary method, method 2800. Method 2800 includes method action 2810, which includes obtaining a behind-the-ear (BTE) assembly including a BTE electronics module, such as BTE electronics module 430. Method 2800 includes method action 2820, which includes obtaining an ear interface, such as ear interface 460 detailed above. Method 2800 further includes method action 2830, which includes placing the ear interface against the BTE electronics module such that a portion of the interface extends into an area of the behind-the-ear assembly. By way of example only and not by way of limitation, such can correspond to the action of placing the male connector 480 into the recess in the base of the BTE electronics module. Still further by way of example only and not by way of limitation, such can correspond to the action of placing the horizontal component of the male connector in between the battery in the BTE electronics module. Still further, by way of example only and not by way of limitation, in an exemplary embodiment, such can correspond to screwing a screw through the spine of the retention loop apparatus 460 into a threaded hole in the concave portion/the side of the BTE electronics module that includes the concave portion. Method 2800 further includes method action 2840, which includes completely securing the ear interface to the BTE assembly without placing a component completely about a main body of the BTE electronics module and, if present, a main body of a battery. By "completely securing," it is meant that there are no further securing actions that are required to secure the ear interface to the BTE assembly vis-à-vis the normal usage thereof (e.g., as opposed to, for example, taking epoxy and gluing the ear interface to the BTE electronics module, taking a string and wrapping it around the battery-ear interface combination, etc., which are actions that can always be executed but are for normal operation).

Consistent with the teachings detailed above, in an exemplary embodiment of method 2800, the ear interface that is the subject of that method includes a structure in the form of a closed loop, such as the loop of the retention loop apparatus 460 detailed above. Also, in some exemplary embodiments, with respect to the action of completely securing the interface to the BTE assembly, method action 2840, that action includes placing the ear interface over a male portion of the BTE electronics module that extends away from the main body of the BTE electronics module (the male portion being, for example, element 431).

Figure 34:
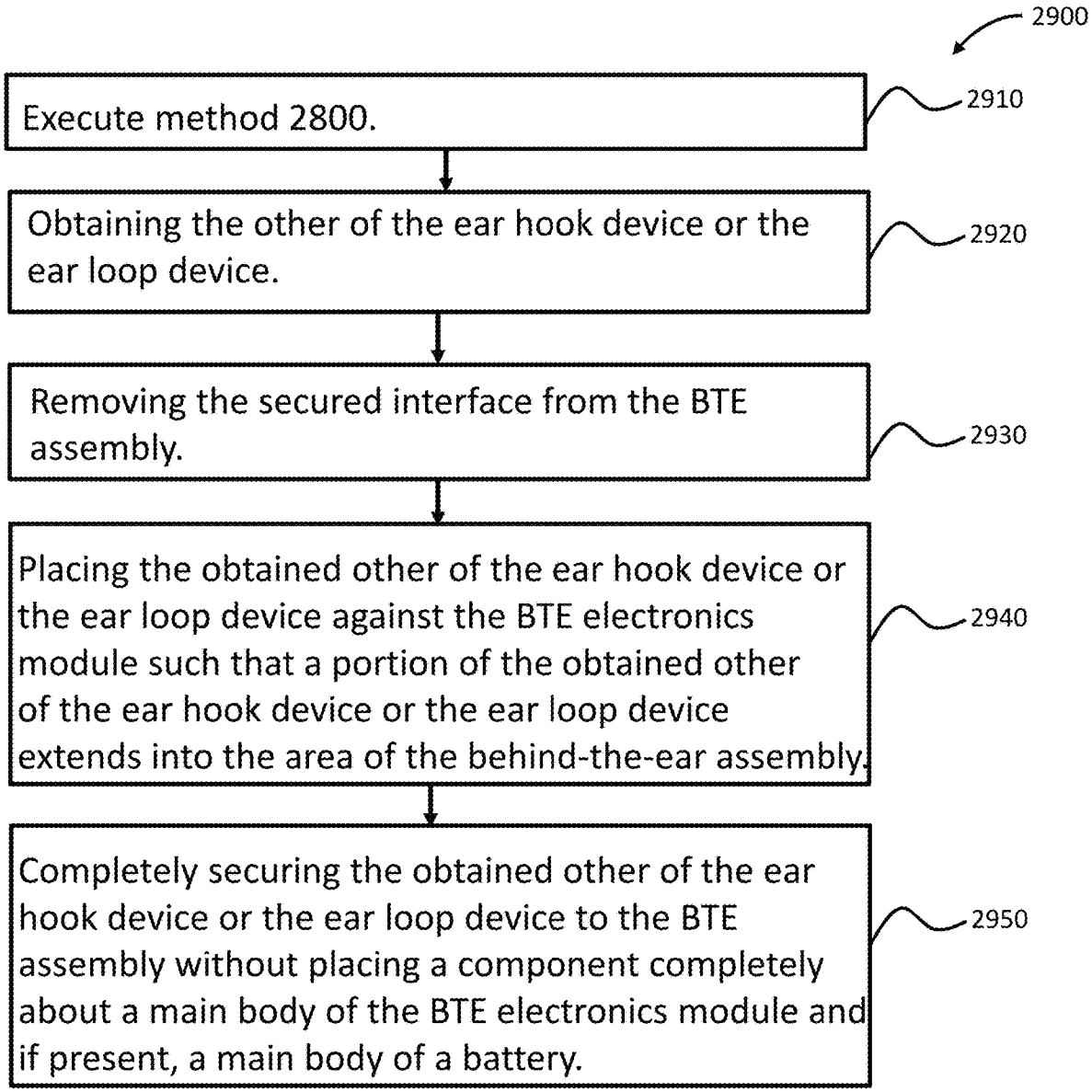

It is noted that exemplary embodiments of the teachings herein can enable retrofitting or otherwise modification of the BTE device that utilizes one type of ear interface, initially, to the utilization of another type of ear interface. To this end, FIG. 34 depicts a flowchart for an exemplary method, method 2900, which includes method action 2910, which includes executing method 2800, wherein the ear interface of method 2800 is one of an ear hook device (e.g., such as ear hook 490) or an ear loop device (such as retention loop apparatus 460). That said, in some broader exemplary embodiments, the ear interface can be another type of ear interface. Method 2900 further includes method action 2920, which includes obtaining a different type of ear interface, such as the other of the ear hook device or the ear loop device. Method 2900 further includes method action 2930, which includes removing the secured ear interface from the BTE assembly, which ever that may be. It is noted that the methods detailed herein are not limited to any particular order unless otherwise specified or unless it is not possible to practice such out of order. That is, while method 2900 presents method action 2920 in front of method action 2930, it is to be understood that method 2900 simply requires those two actions to be executed to practice the method.

Method 2900 also includes method action 2940, which includes placing the obtained other of the ear hook device or the ear loop device against the BTE electronics module such that a portion of the obtained other of the ear hook device or the ear loop device extends into the area of the behind-the-ear assembly (e.g., via the male portion). Method 2900 also includes method action 2950, which includes completely securing the obtained other of the ear hook device or the ear loop device to the BTE assembly without placing a component completely about a main body of the BTE electronics module and, if present, a main body of a battery.

Figure 35:
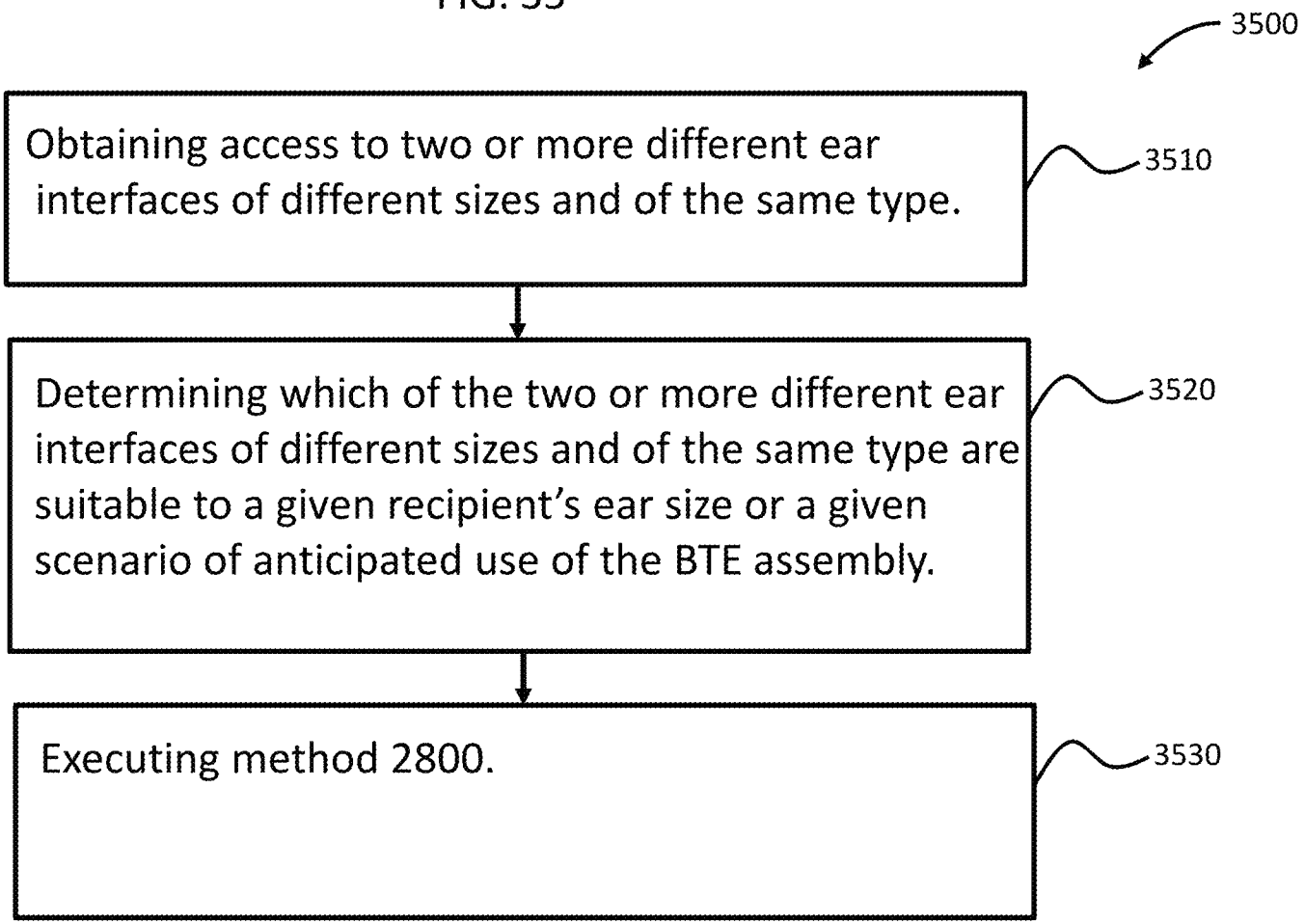

It is also noted that at least some exemplary embodiments include retrofitting or otherwise modifying a BTE device to have a different size retention loop apparatus. That is, in contrast to the method 2900, which method is a method of changing one type of ear interface out and replacing it with another type of ear interface, in this exemplary method, the same type of ear interface is used, it is just that a new different size is the result of the modification. FIG. 35 presents an exemplary flowchart for such an exemplary method, method 3500. Method 3500 includes method action 3510, which includes obtaining access to two or more different ear interfaces of different sizes of the same type. It is noted that method action 3510 can be executed by obtaining a BTE device with the ear interface already there on, or obtaining the BTE device operational assembly with two separate ear interfaces, neither of which are attached or otherwise fully attached to the BTE device operational assembly. Method 3500 further includes method action 3520, which includes determining which of the two or more different ear interfaces of different sizes and of the same type are suitable to one or more of a given recipient's ear size or a given scenario of anticipated use of the BTE assembly. With respect to the former, such can be a result of the recipient's growing, which thus renders the different size loop suitable or unsuitable for the ear. With respect to the latter, such can be a scenario where the recipient may be planning to partake in a somewhat more extreme sporting event that subjects his or her body to higher G forces than otherwise would be the case, during normal activities, etc.

It is briefly noted that this determination feature can also be applicable to the above-noted method 2900. That is, in an exemplary embodiment, prior to the action of obtaining the various ear interfaces, that method can include determining which of the two or more different ear interfaces of different designs and of different type are suitable to one or more of the given recipient's ear size or a given scenario of anticipated use of the BTE assembly. In an exemplary embodiment, the recipient can be provided with two, three, four, five, six, seven, eight, nine or 10 or more different size loops, in the recipient can select from which one he or she will use or otherwise the caregiver can so select. Some size information is provided below. It is also noted that in an exemplary embodiment, the given size of the loop can be generally the same, but the overall geometry can be different with respect to the various loops, where some loop geometry has more utilitarian value when utilized in some scenarios of use as compared to others, and some loop geometry is more comfortable for a given recipient than that which would be the case for another recipient—thus, the aforementioned methods can also include selecting from different geometries of the loop apparatuses.

Method 3500 further includes method action 3530, which includes executing method 2800, wherein the action of obtaining the ear interface includes obtaining the determined one of the two or more different ear interfaces.

Figure 36:
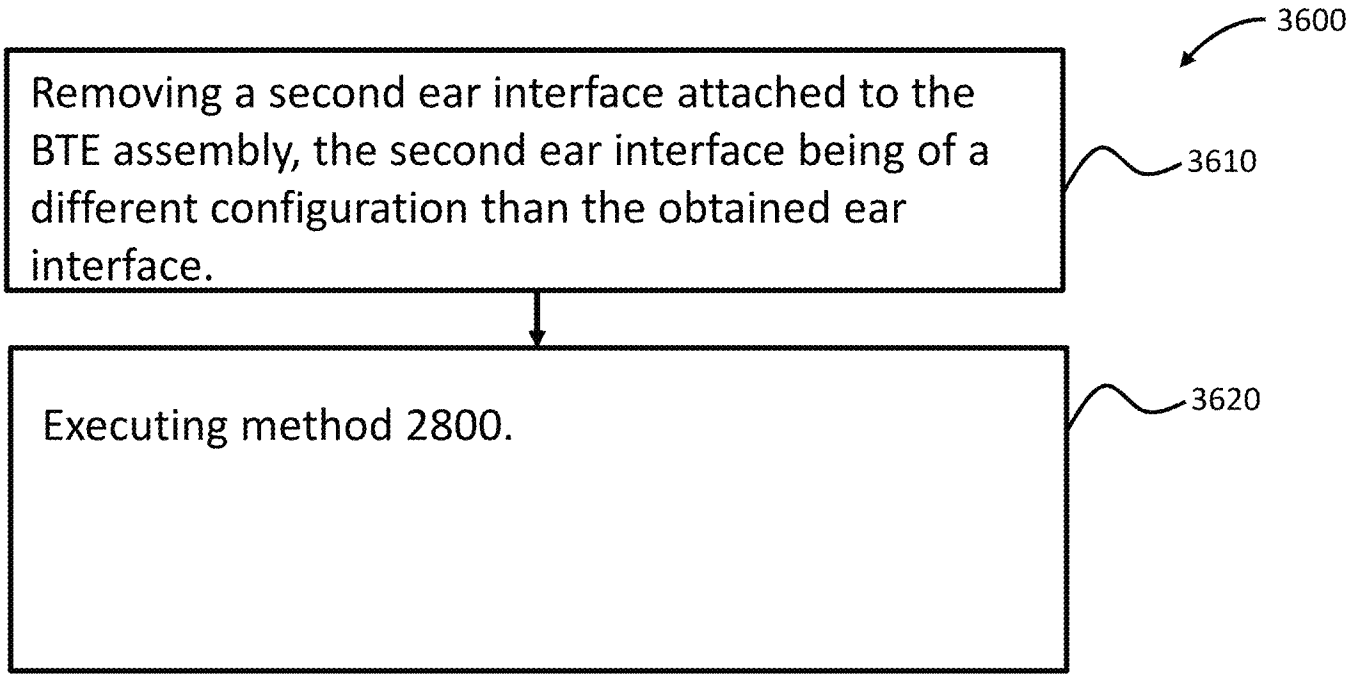

In view of the above, it can be understood that exemplary methods include removing a given ear interface and replacing it with another ear interface. Accordingly, method 3600, represented by the flowchart in FIG. 36, includes the action of, prior to executing method 2800 in method action 3620, executing method action 3610, which includes removing a second ear interface attached to the BTE assembly (where the phrase "second ear interface" is used simply for naming purposes—it has no temporal connotation). In method action 3610, the second ear interface is of a different configuration than the obtained ear interface obtained in method 2800.

It is also noted that the methods can be executed where the ear interface of method 2800 is an ear hook as opposed to a retention loop apparatus.

The teachings detailed herein can have utilitarian value with respect to enabling the utilization of a loop apparatus without having to modify the loop apparatus. That is, in some exemplary embodiments, it can be utilitarian with respect to physically altering the loop of the ear loop apparatus by cutting a portion thereof and shortening the loop by establishing a new bond to another component of the apparatus. Conversely, with respect to some embodiments detailed herein, with respect to method 2800 or any other method for that matter, from before the action of obtaining the ear interface to after the action of completely securing the interface to the BTE assembly, the ear interface remains in pristine condition and the ear interface is an ear loop. By "pristine condition," it is meant that the ear interface is not modified as noted above. That said, in some embodiments, the ear interface can be flexed or bent the like, providing that no damage or otherwise physical alteration of the device occurs, and thus the ear interface will still remain in pristine condition.

Corollary to the above is that in at least some exemplary embodiments, such as where the ear interface is a loop structure, with respect to method 2800 or any other method for that matter, from before the action of obtaining the ear interface to after the action of completely securing the interface to the BTE assembly, and inner perimeter distance remains constant.

Figure 32:
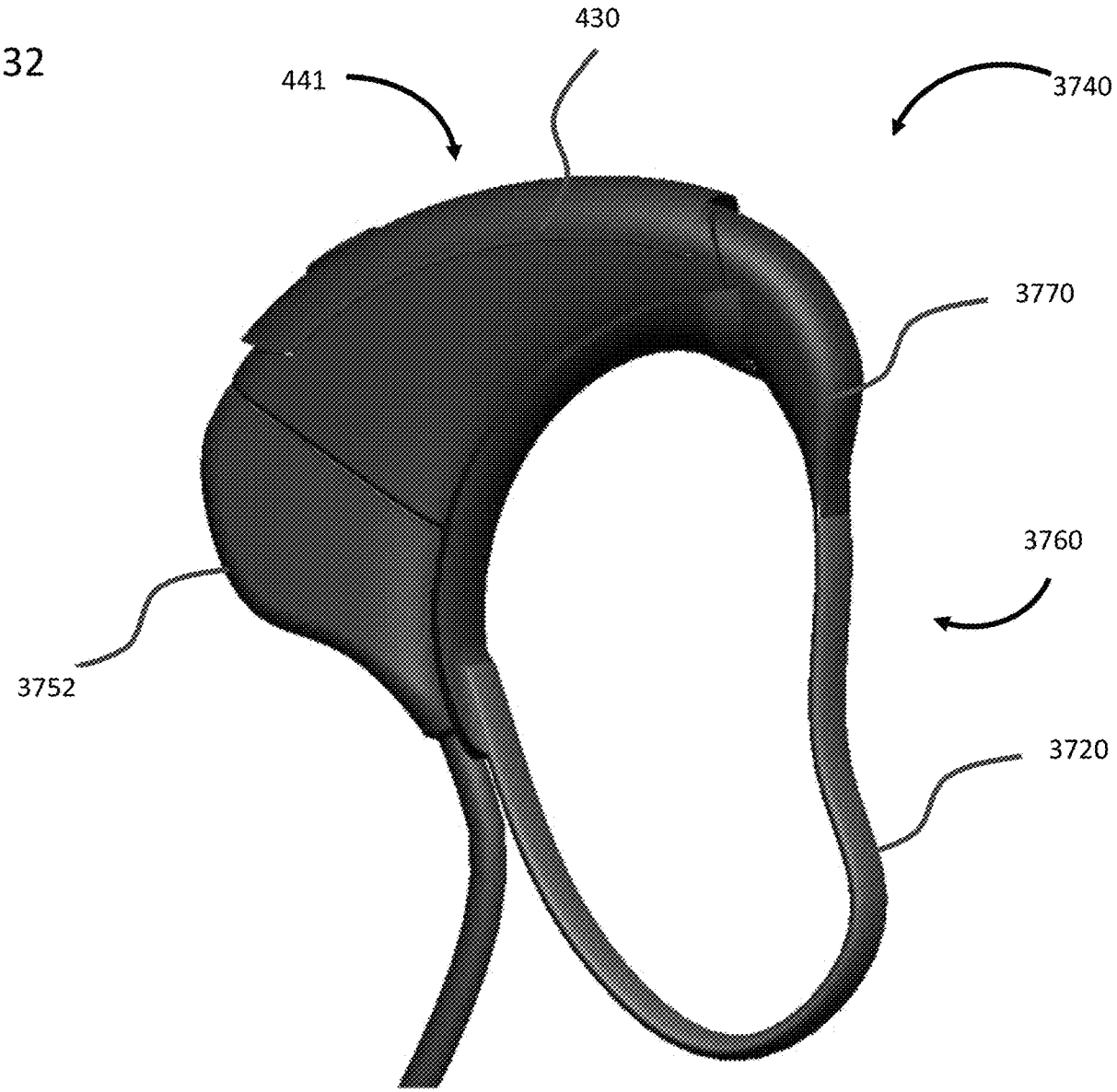

FIG. 32 presents an alternate exemplary embodiment of a BTE device 3740 that includes an alternate retention loop apparatus 3760 as seen. In this regard, there is a retention loop chassis 3770 and a bottom body 3720 as can be seen.

The retention loop chassis 3770 is roughly similar to the retention loop chassis detailed above. That said, as can be seen, the retention loop chassis inner surface subtends an angle of about 180°, as opposed to the embodiments above that subtenant angle less than that. Also as can be seen, the bottom body 420 is somewhat more flat than the bottom bodies detailed above. Also, while the embodiments above with respect to a non-monolithic loop have been presented in the figures in terms of the retention loop chassis having all the male components and the bottom body has the female components, here the portion that attaches to the front portion of the retention loop chassis is a male component and the retention loop chassis has a female component that envelops a portion of the male component. In this embodiment, the retention loop chassis has a interference fit feature that places compression one the bottom body 3720, or more accurately, the upper portion of the bottom body that is fed into the retention loop chassis. In an exemplary embodiment, this area of the retention loop chassis is resiliently biased to press down upon both sides of the bottom body 3720. That is, the female component of the retention loop chassis 3770 can be like a clip (e.g., a binder clip) that compressively grips the bottom body 420. Indeed, in an exemplary embodiment, the length of the bottom body 420 can be adjusted by feeding the bottom body into and out of the retention loop chassis 470. That said, in some alternate embodiments, the length cannot be changed.

With respect to the back portion of the retention loop apparatus 3740, the portion of the bottom body 3720 lies on top of the bottom portion of the retention loop chassis 3770 and the two are mechanically connected or glued together, etc. Thus, in a sense, both are male components. That said, in this exemplary embodiment, the chassis can be molded about the component 3720.

It is also noted that in an exemplary embodiment, the bottom body 3720, at least the outside thereof, is monolithic with the body of the retention loop chassis 3770. By way of example only and not by way of limitation, the bottom body 3720 can include a wire core (e.g., one or more wires, where, with respect to the latter configuration, in some exemplary embodiments, the wires are arrayed relative to one another diameter to diameter in a straight line (as opposed to being bunched) or a metallic core or the like (in, for example, the form of a malleable ribbon), and the material that forms the retention loop chassis 3770 is molded about the core.

Also seen in FIG. 32 is a power apparatus 3752. This component does not include a battery, at least not in the field of view of FIG. 37, but instead includes a wired connection to a power source (not shown).

In an exemplary embodiment of this embodiment, the BTE assembly includes a battery removably attachable to the BTE electronics module, consistent with some of the teachings detailed above. Further, the action of placing the ear interface against the BTE electronics module results in the portion of the ear interface extending underneath the BTE electronics module into a battery interface.

With respect to the embodiments detailed above vis-à-vis the action of placing the interface against the BTE electronics module, such action can also result, in at least some embodiments, in a second portion of the ear interface attaching to a separate portion of the BTE electronics module in a non-locking manner. By way of example only and not by way of limitation, this can correspond to the female portion 471 of the ear interface component 460 receiving the male portion 431 of the BTE electronics module 430.

In an exemplary embodiment, the above-noted ear interface includes three sections including the section extending in front of a pinna, a back section that extends behind the pinna, and a section that extends underneath, and the ear interface is configured to flex such that at least portions of the three sections pull away from the BTE electronics module while the ear interface is locked to the BTE assembly.

Consistent with the above, with respect to the action of placing the ear interface against the BTE electronics module such that a portion of the interface extends into an area of the behind-the-ear assembly, the portion of the ear interface is a male portion extending away from a BTE electronics module.

It is noted that embodiments can have utilitarian value with respect to kits. For example, there can be utilitarian value with respect to changing out a traditional ear hook and replacing it with one of the aforementioned retention loop apparatus as detailed herein, or vice versa. Such can have utilitarian value, at least with respect to the latter, with respect to a child who, as he or she grows older, is no longer need of the retention loop apparatus of the like that has the locking features detailed above, or even with respect to the loop embodiment without the locking features detailed above (i.e., wants to transition from the loop to the ear hook). By way of example only and not by way of limitation, a BTE device can be sold that includes both the ear interface 460 and the ear hook 490, and the recipient or the recipient's parents can swap out the two components as a given scenario provide utilitarian value therefore.

Accordingly, in an exemplary embodiment, there is a kit, comprising, a BTE device as detailed herein or any variation thereof, which can include in ear hook 490 or an ear interface 460, wherein in the kit further includes the other of an ear hook 490 or an ear interface 460. In this exemplary embodiment, both the ear hook and the ear interface are removably attachable to the BTE electronics module when the other is removed there from.

Also in view of the above, it can be seen that in an exemplary embodiment, there is a behind-the-ear (BTE) device, such as BTE device 1540, including a BTE electronics module 430, and an ear interface, such as by way of example by way of limitation, the retention loop apparatus 460. This exemplary embodiment, the ear interface is operationally removable from the BTE electronics module 430, the ear interface includes a portion configured to extend in front of a pinna when the BTE device is worn behind the ear (e.g., portion 420, the bottom body) and the ear interface is safety connected to the BTE electronics module 430.

In an exemplary embodiment, the ear interface is configured to be completely interposed between a concave portion of the BTE electronics module and a pinna of the recipient when worn on the recipient. This is seen in FIG. 17, where the concave portion of the BTE electronics module (the side facing the spine of the retention loop apparatus 460) is the side that interfaces with the retention loop apparatus 460, and thus when worn on the pinna, the retention loop apparatus 460 is completely interposed between that portion and the pinna. It is noted that in some embodiments, the retention loop apparatus 460, or at least the chassis 470, extends at least partially around the lateral sides of the BTE electronics module 430 (less than the embodiment of FIG. 30, in some embodiments). By way of example only and not by way of limitation, in an exemplary embodiment, with respect to distance in the plane of FIG. 17 from the concave portion of FIG. 17 (the part that directly interfaces with the portion of the spine shown in FIG. 17), the retention loop apparatus 460 extends a distance about, more than, or no more than Y, where Y is 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.25, 3.5, 3.75, 4.0, 4.25, 4.5, 4.75, 5.0, 5.25, 5.5, 5.75, 6.0, 6.25, 6.5, 6.75, 7.0, 7.25, 7.5, 7.75, 8.0, 8.25, 8.5, 8.75, 9, 9.25, 9.5, 9.75, or 10.0 mm. This distance is the distance Y shown in the FIG. 28. That said, Y can also be variable with respect to location on the spine length, as can be seen with respect to FIG. 30, so Y (which would reflect the distance to the tips of the C) can be 11, 12, 13, 14, 15, 16, 17, 18, 19, 20, 21, 22, 23, 24, 25, 26, 27, 28, 29 or 30 mm or any values or range of values between any of the aforementioned Y values in 0.01 mm increments.

In an exemplary embodiment, the ear interface is safety connected to the BTE electronics module via an interference connection relative to the BTE electronics module. In this regard, this can be achieved via the male connector 480 as detailed above, where the hook portion of the male connector 480 becomes trapped in between the BTE electronics module 430 and the battery. That is, components of the BTE device operational assembly interfere with components of the retention loop apparatus 460. That said, in an alternative embodiment, a screw is utilized to achieve the interference connection relative to the BTE electronics module. By way of example only and not by way of limitation, in an exemplary embodiment, a hole can be present through the horizontal portion 483 of the male connector 480. In an exemplary embodiment, a threaded bore can be located in the base of the BTE electronics module 430. In an exemplary embodiment, with the battery removed, the screw, such as a Phillips head screw, or a machine screw, can be screwed through the hole and into the threaded bore, thus achieving the aforementioned safety connection via an interference connection. It is noted that in an alternative embodiment, such can also be done or alternatively be done with respect to the battery 454.

It is noted that while the aforementioned embodiment utilizing a screw has been described in terms of utilizing a screw that extends the horizontal portion 483 of the male connector 480, alternatively, and/or in addition to this, the screw can extend through, for example, the portion 481, such as through the hole 484, where, in an exemplary embodiment, the side of the BTE electronics module 430 that has the concave portion has a threaded hole therein to receive this screw. That said, in an alternative embodiment, there is no male connector per se. Instead, a screw is screwed through the retention loop chassis 470 and into the BTE electronics module 430. In some embodiments, there is a reinforced portion embedded within the retention loop chassis 470, such as by way of example only and not by way of limitation, a component corresponding to only the portion 481 of the male connector 480. In this regard, no part of the reinforced portion extends out of the retention loop chassis 470. This reinforced portion provides reinforcement for the aforementioned screw.

In an exemplary embodiment, the ear interface is safety connected to the BTE electronics module via a component of the ear interface that extends between the BTE electronics module and a battery attached to the BTE electronics module, consistent with the embodiment of FIG. 17. In an exemplary embodiment, the ear interface is only removable from the BTE device by removing a battery attached to the BTE electronics module. By way of example only and not by way of limitation, as detailed above, the battery forms a portion of the tunnel through which the male connector 480 extends, and provides reaction force against movement of the male connector and the downward direction. Thus, the hook portion cannot be removed from the recess in which it is located in the BTE electronics module while the battery is connected to the BTE electronics module.

By safety connected to the BTE electronics module, it is meant that the ear interface cannot be removed from the BTE electronics module with the battery connected thereto (in embodiments that rely upon the battery to help secure the ear interface) without breaking the ear interface.

In an exemplary embodiment, the ear interface is connected to the BTE electronics module such that the ear interface cannot be removed by a child of three years old, four years old, five years old, six years old, seven years old, and/or eight years old (at least without removing the battery, in such embodiments), which child is a 50 percentile, 55 percentile, 60 percentile, 65 percentile, 70 percentile, 75 percentile, 80 percentile, 85 percentile, 90 percentile, and/or 95 percentile human factors male and/or female native-born inhabitant of the United States of America as of Jul. 4, 2017, or the closest date thereto where such human factors engineering statistics for such a child are available.

In an exemplary embodiment, the aforementioned human factored child is using only his or her bare hands, and is not utilizing any leverage evoking devices. Such can have utilitarian value by way of example only and not by way of limitation, in an exemplary embodiment, such as scenarios of use by children, children can sometimes find it pleasurable to pull the retention loop apparatus off. In some exemplary scenarios of use by children, children can sometimes find it pleasurable to remove the retention loop apparatus from the BTE electronics module 430. In some exemplary scenarios of use by children, children can sometimes find it pleasurable to chew on the apparatus. In some exemplary scenarios of such use, such can have deleterious results with respect to a scenario where the retention loop becomes dislodged from the BTE electronics module 430, in which case a failure mode could occur corresponding to the child swallowing the retention loop apparatus or otherwise corresponding to movement of the ear hook 490 from the mouth of the child inward. In at least some exemplary scenarios, this failure mode is undesirable. The safety lock device detailed above can avoid this failure mode because the child will not be able to remove the retention loop apparatus from the BTE device operational components.

It is briefly noted that in at least some exemplary embodiments, when viewed from the side (e.g., the frame of reference of FIG. 16) the retention loop apparatus 460 has at least a general inner profile corresponding to the profile of a human pinna.

It is noted that embodiments can include retention loop apparatuses 460 of varying sizes. By way of example only and not by way of limitation, in an exemplary embodiment, retention loop apparatuses can have an inner perimeter distance of about U, an inner perimeter distance no more than U, or an inner perimeter distance greater than U, where U is 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245 or 250 mm. In an exemplary embodiment U is any value or range of values between 50 and 250 mm in 0.1 mm increments.

In an exemplary embodiment, there can be utilitarian value with respect to changing the size of the loop as the recipient grows older and/or changing the size of the loop depending on the scenario of use, as noted above.

In an exemplary embodiment, there is a device, comprising: a behind-the-ear (BTE) device ear interface fixture, the fixture including a loop portion configured to enable a pinna of a recipient to be inserted there through and an attachment portion configured to removably attach the fixture to a BTE electronics module and/or a BTE battery, wherein the inner perimeter of the loop portion is non-circular when the loop portion is in a relaxed state.

In an exemplary embodiment of the device detailed above and/or below, the fixture includes a main body, sub-loop body, and a male body, wherein the sub-loop body is molded about the main body to establish the loop portion. In an exemplary embodiment of the device detailed above and/or below, the inner perimeter distance of the loop body is fixed and not adjustable; and the loop body is non-symmetric in a relaxed state. In an exemplary embodiment of the device detailed above and/or below, the fixture includes a main body and a sub-loop body, wherein the main body is made of a hard material and the sub-loop body is made of an elastic material.

In an exemplary embodiment, there is a behind-the-ear (BTE) device, comprising: a BTE electronics module; and an ear interface, wherein the ear interface includes a portion configured to extend completely about a pinna when the BTE device is worn behind the ear, and the ear interface is an integral component. In an exemplary embodiment of the device detailed above and/or below, the device further includes a battery attached to the BTE electronics module, wherein the ear interface is attached to the BTE electronics module by two separate connections, one of which is established by a portion of the ear interface that extends into the battery-BTE electronics module assembly. In an exemplary embodiment of the device detailed above and/or below, the device further included a battery attached to the BTE electronics module, wherein the ear interface is devoid of any component that completely extends about the battery, and the ear interface is devoid of any component that completely extends about a main portion of the BTE electronics module.

In an exemplary embodiment, there is a method, comprising:

obtaining a behind-the-ear (BTE) assembly including a BTE electronics module;

obtaining an ear interface;

placing the interface against the BTE electronics module such that a portion of the interface extends into an area of the behind-the-ear assembly; and completely securing the interface to the BTE assembly without placing a component completely about a main body of the BTE electronics module and, if present, a main body of a battery.

In an exemplary embodiment of a method detailed above and/or below, the ear interface is an ear hook and/or the ear interface is a loop structure and/or from before the action of obtaining the ear interface to after the action of completely securing the interface to the BTE assembly, an inner perimeter distance remains constant.

It is noted that any embodiment or feature disclosed herein associated with one embodiment can be combined with any other embodiment or any other feature disclosed herein associated with another embodiment unless otherwise specified or unless the art does not enable such. It is further noted that any disclosure herein of a device and/or system further corresponds to a disclosure of a method action of utilizing that device and/or system. Corollary to this is that any disclosure herein of a method action corresponds to a disclosure method action of a device and/or system for executing that method action. It is also noted that any method action herein detailed with respect to fabricating or otherwise making a device and/or system corresponds to a resulting device and/or system that results from that fabrication action. It is also noted that any device and/or system detailed herein corresponds to a disclosure of a method of making that device and/or system.

While various embodiments of the present invention have been described above, it should be understood that they have been presented by way of example only, and not limitation. It will be apparent to persons skilled in the relevant art that various changes in form and detail can be made therein without departing from the spirit and scope of the invention.

What is claimed is:

1. A device, comprising:

a behind-the-ear (BTE) device ear interface fixture, the fixture including:

a loop portion configured to enable a pinna of a recipient to be inserted there through, and an attachment portion configured to removably attach the fixture to a BTE electronics module and/or a BTE battery, wherein the inner perimeter of the loop portion is non-circular when the loop portion is in a relaxed state, wherein the loop portion is a closed loop that is closed irrespective of the presence or absence of the BTE device, and wherein at least one of:

the attachment portion is a male portion configured to extend into one or more of the BTE electronics module, the BTE battery, or the assembly established by the BTE electronics module and the BTE battery; or the inner perimeter of the loop portion is asymmetrical when the loop portion is in the relaxed state.

2. The device of claim 1, wherein:

the fixture is a completely integrated fixture.

3. The device of claim 1, wherein:

the attachment portion is the male portion configured to extend into one or more of the BTE electronics module, the BTE battery, or the assembly established by the BTE electronics module and the BTE battery.

4. The device of claim 3, wherein:

the interface fixture includes a second attachment portion, the second attachment portion including a female receptacle configured to receive a male portion of the BTE electronics module.

5. The device of claim 1, wherein:

the fixture consists of a main body, sub-loop body, and a male body.

6. The device of claim 1, wherein:

the loop portion is established by structure consisting of a main body and a sub-loop body, the sub-loop body establishing more than ⅔rds of the perimeter of the loop portion.

7. A behind-the-ear (BTE) device, comprising:

a BTE electronics module; and an ear interface, wherein the ear interface includes a portion configured to extend completely about a pinna when the BTE device is worn behind the ear, the ear interface is an integral component, and at least one of:

i. the BTE device further includes:

a battery attached to the BTE electronics module, wherein the battery-BTE electronics module assembly has a first pinna facing side that extends behind the pinna and over the pinna when placed on an ear, the first pinna facing side extending from a bottom end of the battery to a top end of the BTE electronics module, and the ear interface contiguously extends between the pinna and the first pinna facing side from the bottom end of the battery to the top end of the BTE electronics module;

ii. the ear interface includes an open concave section that is concave relative to the BTE electronics module, which concave section interfaces with the BTE electronics module such that the BTE electronics module is located in the concave section; or iii. the BTE device further includes:

a power component attached to the BTE electronics module, wherein the power component-BTE electronics module assembly has a second pinna facing side, and the ear interface establishes a contiguous barrier between structure of the second pinna facing side from a bottom end of the power component-BTE electronics module assembly to a top end of the power component-BTE electronics module assembly.

8. The BTE device of claim 7, wherein:

the ear interface includes a main body, sub-loop body, and a male body, wherein the sub-loop body is molded about the main body, and the main body is molded about a portion of the male body.

9. The BTE device of claim 7, further including:

a power device attached to the BTE electronics module, wherein the BTE electronics module includes an arcuate surface between a power device interfacing end of the BTE electronics module and a tip of the BTE electronics module opposite the power device interfacing end, the arcuate surface configured to extend over a top of a pinna of a human, the power device includes a first surface that is parallel to and at least substantially flush with one of the arcuate surface or a surface located between the power device and the power device interfacing end of the BTE electronics module, and the ear interface extends parallel with the arcuate surface of the BTE electronics module and the first surface.

10. The BTE device of claim 7, further including:

the battery attached to the BTE electronics module, wherein the battery-BTE electronics module assembly has the first pinna facing side that extends a behind the pinna and over the pinna when placed on the ear, the first pinna facing side extending from the bottom end of the battery to the top end of the BTE electronics module, and the ear interface contiguously extends between the pinna and the first pinna facing side from the bottom end of the battery to the top end of the BTE electronics module.

11. The BTE device of claim 7, wherein:

the ear interface includes the open concave section that is concave relative to the BTE electronics module, which concave section interfaces with the BTE electronics module such that the BTE electronics module is located in the concave section.

12. The BTE device of claim 7, further comprising:

the power component attached to the BTE electronics module, wherein the power component-BTE electronics module assembly has the second pinna facing side, and the ear interface establishes the contiguous barrier between structure of the pinna facing side from the bottom end of the power component-BTE electronics module assembly to the top end of the power component-BTE electronics module assembly.

13. A method, comprising:

obtaining a behind-the-ear (BTE) assembly including a BTE electronics module;

obtaining an ear interface;

placing the interface against the BTE electronics module such that a portion of the interface extends into an area of the behind-the-ear assembly; and completely securing the interface to the BTE assembly without placing a component completely about a main body of the BTE electronics module and, if present, a main body of a battery, wherein at least one of:

the ear interface includes a structure in the form of a closed loop; or the interface fixture includes an attachment portion, the attachment portion including a female receptacle configured to receive a male portion of the BTE electronics module and envelop an end of the male portion.

14. The method of claim 13, wherein:

the ear interface includes the structure in the form of the closed loop.

15. The method of claim 13, wherein:

the interface fixture includes the attachment portion, the attachment portion including the female receptacle configured to receive the male portion of the BTE electronics module and envelop an end of the male portion.

16. The method of claim 13, wherein:

the ear interface is one of an ear hook device or an ear loop device;

the method further includes obtaining the other of the ear hook device or the ear loop device;

the method further includes removing the secured interface from the BTE assembly;

the method further includes placing the obtained other of the ear hook device or the ear loop device against the BTE electronics module such that a portion of the obtained other of the ear hook device or the ear loop device extends into the area of the behind-the-ear assembly; and the method further includes completely securing the obtained other of the ear hook device or the ear loop device to the BTE assembly without placing a component completely about a main body of the BTE electronics module and, if present, a main body of a battery.

17. The method of claim 13, wherein:

prior to the action of obtaining the ear interface, the method includes obtaining access to two or more different ear interfaces of different sizes and of the same type;

prior to the action of obtaining the ear interface, the method includes determining which of the two or more different ear interfaces of different sizes and of the same type are suitable to one or more of a given recipient's ear size or a given scenario of anticipated use of the BTE assembly; and the action of obtaining the ear interface includes obtaining the determined one of the two or more different ear interfaces.

18. The method of claim 13, wherein:

prior to the action of obtaining the ear interface, the method includes removing a second ear interface attached to the BTE assembly, the second ear interface being of a different configuration than the obtained ear interface.

19. The method of claim 13, wherein:

from before the action of obtaining the ear interface to after the action of completely securing the interface to the BTE assembly, the ear interface remains in pristine condition and the ear interface is a loop structure.

20. The device of claim 1, wherein:

the inner perimeter of the loop portion is asymmetrical when the loop portion is in the relaxed state.

* * * * *